US008820276B2

(12) United States Patent
Vorih et al.

(10) Patent No.: US 8,820,276 B2
(45) **Date of Patent: *Sep. 2, 2014**

(54) VARIABLE LOST MOTION VALVE ACTUATOR AND METHOD

(75) Inventors: Joseph M. Vorih, Suffield, CT (US); Jeffrey Mossberg, Windsor, CT (US); Richard Vanderpoel, Bloomfield, CT (US); Steven Ernest, Windsor, CT (US); Guy Paterson, Simsbury, CT (US); John A. Schwoerer, Storrs, CT (US); Edward T. Leitkowski, Colechester, CT (US); Andrew Brzoska, Bristol, CT (US); Gheorghe Cosma, Windsor, CT (US)

(73) Assignee: Jacobs Vehicle Systems, Inc., Bloomfield, CT (US)

( * ) Notice: Subject to any disclaimer, the term of this patent is extended or adjusted under 35 U.S.C. 154(b) by 583 days.

This patent is subject to a terminal disclaimer.

(21) Appl. No.: 13/021,531

(22) Filed: Feb. 4, 2011

(65) Prior Publication Data

US 2011/0197833 A1 Aug. 18, 2011

Related U.S. Application Data

(60) Continuation of application No. 11/450,286, filed on Jun. 12, 2006, now Pat. No. 7,882,810, which is a continuation-in-part of application No. 10/251,748, filed on Sep. 23, 2002, now Pat. No. 7,059,282, which is a division of application No. 09/749,907, filed on Dec. 29, 2000, now Pat. No. 6,510,824, which is a continuation-in-part of application No. 09/594,791, filed on Jun. 16, 2000, now Pat. No. 6,293,237, which is a continuation of application No. 09/209,486, filed on Dec. 11, 1998, now Pat. No. 6,085,705.

(60) Provisional application No. 60/069,270, filed on Dec. 11, 1997.

(51) Int. Cl.

| | |
|---|---|
| ***F01L 1/34*** | (2006.01) |
| ***F01L 13/08*** | (2006.01) |
| ***F01L 1/18*** | (2006.01) |
| ***F01L 1/24*** | (2006.01) |
| ***F01L 1/08*** | (2006.01) |
| ***F01L 9/02*** | (2006.01) |
| ***F01L 13/00*** | (2006.01) |
| *F01L 1/053* | (2006.01) |
| *F01L 1/344* | (2006.01) |
| *F01L 1/26* | (2006.01) |

(52) U.S. Cl.

CPC ..... *F01L 1/2411* (2013.01); *F01L 13/085* (2013.01); *F01L 1/053* (2013.01); *F01L 2800/01* (2013.01); *F01L 1/185* (2013.01); *F01L 2105/00* (2013.01); *F01L 2001/34446* (2013.01); *F01L 1/08* (2013.01); *F01L 2820/01* (2013.01); *F01L 9/02* (2013.01); *F01L 13/0005* (2013.01); *F01L 1/267* (2013.01)

USPC ..... 123/90.15

(58) Field of Classification Search

CPC ..... F01L 1/12; F01L 1/18

USPC ..... 123/90.1, 90.11, 90.12, 90.15, 345, 123/346, 347, 348

See application file for complete search history.

(56) References Cited

U.S. PATENT DOCUMENTS

| | | | |
|---|---|---|---|
| 4,188,933 | A | 2/1980 | Iizuka |
| 4,224,906 | A | 9/1980 | Happel |
| 4,258,671 | A | 3/1981 | Takizawa et al. |
| 4,408,580 | A | 10/1983 | Kosuda et al. |
| 4,462,353 | A | 7/1984 | Arai et al. |
| 4,469,061 | A | 9/1984 | Ajiki et al. |
| 4,475,497 | A | 10/1984 | Honda et al. |
| 4,509,467 | A | 4/1985 | Arai et al. |
| 4,546,734 | A | 10/1985 | Kodama |
| 4,587,936 | A | 5/1986 | Matsuura et al. |
| 4,593,662 | A | 6/1986 | Baring et al. |
| 4,615,306 | A | 10/1986 | Wakeman |
| 4,615,307 | A | 10/1986 | Kodama et al. |
| 4,696,265 | A | 9/1987 | Nohira |
| 4,768,467 | A | 9/1988 | Yamada et al. |
| 4,889,085 | A | 12/1989 | Yagi et al. |
| 4,913,104 | A | 4/1990 | Mills |

4,924,821 A 5/1990 Teerman
4,930,465 A 6/1990 Wakeman et al.
4,996,957 A 3/1991 Meistrick
5,005,540 A 4/1991 Watanabe
5,012,778 A 5/1991 Pitzi
5,036,810 A 8/1991 Meneely
5,048,480 A 9/1991 Price
5,140,955 A 8/1992 Sono et al.
5,146,754 A 9/1992 Jain et al.
5,146,890 A 9/1992 Gobert et al.
5,158,048 A 10/1992 Robnett et al.
5,161,501 A 11/1992 Hu
5,165,375 A 11/1992 Hu
5,168,848 A 12/1992 Bergmann et al.
5,186,141 A 2/1993 Custer
5,193,494 A 3/1993 Sono et al.
5,195,489 A 3/1993 Reich
5,201,290 A 4/1993 Hu
5,271,360 A 12/1993 Kano et al.
5,325,825 A 7/1994 Schmidt et al.
5,327,814 A 7/1994 Custer et al.
5,357,926 A 10/1994 Hu
5,361,740 A 11/1994 Pitzi
5,365,916 A 11/1994 Freiburg et al.
5,379,737 A 1/1995 Hu
5,385,019 A 1/1995 Kulig et al.
5,386,806 A 2/1995 Allen et al.
5,410,882 A 5/1995 Davies et al.
5,411,003 A 5/1995 Eberhard et al.
5,423,302 A 6/1995 Glassey
5,437,156 A 8/1995 Custer
5,451,029 A 9/1995 Kruger
5,460,131 A 10/1995 Usko
5,460,329 A 10/1995 Sturman
5,462,025 A 10/1995 Israel et al.
5,479,890 A 1/1996 Hu et al.
5,479,896 A 1/1996 Freiburg et al.
5,479,901 A 1/1996 Gibson et al.
5,499,606 A 3/1996 Robnett et al.
5,501,186 A 3/1996 Hara et al.
5,511,460 A 4/1996 Custer
5,537,975 A 7/1996 Cosma et al.
5,537,976 A 7/1996 Hu
5,562,071 A 10/1996 Urushihata et al.
5,619,965 A 4/1997 Cosma et al.
5,622,146 A 4/1997 Speil
5,626,110 A 5/1997 Regueiro
5,628,286 A 5/1997 Kato et al.
5,655,487 A 8/1997 Maas et al.
5,680,841 A 10/1997 Hu
5,699,762 A 12/1997 Horiuchi
5,718,199 A 2/1998 Hu et al.
5,746,175 A 5/1998 Hu
5,749,340 A 5/1998 Warburton et al.
5,758,499 A 6/1998 Sugiyama et al.
5,787,859 A 8/1998 Meistrick et al.
5,809,964 A 9/1998 Meistrick et al.
5,829,397 A 11/1998 Vorih et al.
5,839,400 A 11/1998 Vattaneo
5,839,453 A 11/1998 Hu
5,845,748 A 12/1998 Schaefer et al.
5,947,235 A 9/1999 Schaefer
5,967,115 A 10/1999 Konopka et al.
5,975,251 A 11/1999 McCarthy
5,979,394 A 11/1999 Schmidt
5,996,550 A 12/1999 Israel et al.
6,000,374 A 12/1999 Cosma et al.
6,012,424 A 1/2000 Meistrick
6,082,328 A 7/2000 Meistrick et al.
6,085,705 A 7/2000 Vorih
6,085,721 A 7/2000 Dodi et al.
6,095,115 A 8/2000 Fuchs
6,109,027 A 8/2000 Schaefer
6,112,710 A 9/2000 Egan, III et al.
6,125,828 A 10/2000 Hu
6,138,621 A 10/2000 Albanello et al.
6,152,104 A 11/2000 Vorih et al.
6,170,474 B1 1/2001 Israel
6,179,096 B1 1/2001 Kinerson et al.
6,189,504 B1 2/2001 Israel et al.
6,192,841 B1 2/2001 Vorih et al.
6,213,069 B1 4/2001 Wada et al.
6,237,551 B1 5/2001 Macor et al.
6,240,898 B1 6/2001 Meistrick et al.
6,244,257 B1 6/2001 Hu
6,257,183 B1 7/2001 Vorih et al.
6,267,098 B1 7/2001 Vanderpoel
6,273,057 B1 8/2001 Schwoerer et al.
6,293,237 B1 9/2001 Vorih
6,302,370 B1 10/2001 Schwoerer et al.
6,311,667 B1 11/2001 Satou et al.
6,321,701 B1 11/2001 Vorih et al.
6,325,043 B1 12/2001 Meistrick et al.
6,330,869 B1 12/2001 Yoshiki et al.
6,334,429 B1 1/2002 Little, Jr.
6,354,254 B1 3/2002 Usko
6,354,266 B1 3/2002 Cornell et al.
6,386,160 B1 5/2002 Meneely et al.
6,394,050 B1 5/2002 McCarthy et al.
6,394,067 B1 5/2002 Usko et al.
6,412,457 B1 7/2002 Vorih et al.
6,415,752 B1 7/2002 Janak
6,422,186 B1 7/2002 Vanderpoel
6,450,144 B2 9/2002 Janak et al.
6,474,277 B1 11/2002 Vanderpoel et al.
6,510,824 B2 1/2003 Vorih et al.
6,550,433 B2 4/2003 Vorih et al.
6,591,795 B2 7/2003 Janak
6,594,996 B2 7/2003 Yang
6,637,394 B2 10/2003 Marshall et al.
6,647,954 B2 11/2003 Yang et al.
6,668,773 B2 12/2003 Holtman et al.
6,691,674 B2 2/2004 McCarthy et al.
6,694,933 B1 2/2004 Lester
6,718,940 B2 4/2004 Usko
6,732,686 B1 5/2004 Maeda et al.
6,827,067 B1 12/2004 Yang et al.
6,854,433 B2 2/2005 Vanderpoel
6,866,017 B2 3/2005 Ruggiero et al.
6,868,824 B2 3/2005 Yang et al.
6,883,492 B2 4/2005 Vanderpoel et al.
6,920,868 B2 7/2005 Ruggiero et al.
7,059,282 B2 6/2006 Vorih et al.
RE39,258 E 9/2006 Cosma et al.
7,156,062 B2 1/2007 Vanderpoel
7,162,996 B2 1/2007 Yang
7,237,540 B2 7/2007 Huang
7,276,833 B2 10/2007 Ernest et al.
7,284,533 B1 10/2007 Huang et al.
7,350,502 B2 4/2008 Meistrick et al.
7,392,772 B2 7/2008 Janak et al.
7,484,483 B2 2/2009 Yang et al.
7,500,466 B2 3/2009 Noss et al.
7,555,998 B2 7/2009 Yang et al.
7,559,300 B2 7/2009 Ruggiero
7,565,896 B1 7/2009 Yang
7,600,497 B2 10/2009 Vanderpoel
7,665,432 B2 2/2010 Vanderpoel
7,673,600 B2 3/2010 Yang
7,712,449 B1 5/2010 Schwoerer
7,735,466 B1 6/2010 Moore et al.
7,793,624 B2 9/2010 Janak et al.
7,823,553 B2 11/2010 Meistrick
7,882,810 B2 2/2011 Vanderpoel et al.
7,905,208 B2 3/2011 Ruggiero et al.
7,954,465 B2 6/2011 Huang
7,971,569 B2 7/2011 Meistrick et al.
8,079,338 B2 12/2011 Schwoerer et al.
8,087,392 B2 1/2012 Swanbon et al.
8,151,763 B2 4/2012 Meistrick et al.
8,453,613 B2 6/2013 Yang et al.
8,516,984 B2 8/2013 Schwoerer
8,528,508 B2 9/2013 Meistrick et al.
8,578,901 B2 11/2013 Ruggiero et al.
2011/0214632 A1 9/2011 Pattakos et al.

FOREIGN PATENT DOCUMENTS

| | | | |
|---|---|---|---|
| DE | 42 26 163 | A1 | 2/1994 |
| DE | 43 34 995 | A1 | 4/1995 |
| EP | 0 156 996 | A1 | 10/1985 |
| EP | 0 193 142 | A1 | 9/1986 |
| EP | 0193142 | B1 | 9/1986 |
| EP | 0156996 | B1 | 5/1988 |
| EP | 0 535 275 | A1 | 4/1993 |
| EP | 0 764 769 | A1 | 3/1997 |
| EP | 0 939 205 | A1 | 9/1999 |
| EP | 0 803 642 | B1 | 11/2000 |
| EP | 0 769 613 | B1 | 6/2001 |
| EP | 1038095 | B1 | 11/2011 |
| GB | 1 291 528 | A | 10/1972 |
| GB | 2 165 887 | A | 4/1986 |
| GB | 2 234 291 | A | 1/1991 |
| JP | 53-115408 | | 10/1978 |
| JP | 58-044234 | A | 3/1983 |
| JP | 04-284111 | A | 8/1992 |
| JP | 04-287816 | A | 10/1992 |
| JP | 05-156914 | A | 6/1993 |
| JP | 05-248217 | A | 9/1993 |
| JP | 06-002519 | A | 1/1994 |
| JP | 06-108810 | A | 4/1994 |
| JP | 06-108813 | A | 4/1994 |
| JP | 06-117210 | A | 4/1994 |
| JP | 06-063805 | U | 9/1994 |
| JP | 07-208997 | A | 8/1995 |
| JP | 2961196 | B2 | 10/1999 |
| JP | 2985406 | B2 | 11/1999 |
| WO | 99/04144 | A1 | 1/1999 |
| WO | 99/10629 | A2 | 3/1999 |
| WO | 99/23363 | A1 | 5/1999 |
| WO | 99/23378 | A1 | 5/1999 |

OTHER PUBLICATIONS

"Chapter 3. Approaches to Variable Valve Actuation", Presented Jul. 2, 1996 at University of Canterbury, New Zealand.

Fortschritt-Berichte VDI: "7. Internationales Wiener Motoren-Symposium Apr. 24-25, 1986", VDI Verlag, Published: Apr. 1986. (English translation unavailable).

Fortschritt-Berichte VDI: "14. Internationales Weiner Motorensymposium Mai 6.-7., 1993", VDI Verlag, Published: May 1993. (English translation unavailable).

"Experiences with an Electrohydraulic Variable Valve Actuation System on a Four-Cylinder SI Engine", F. Vattaneo, FIAT Research Center—Orbassano, Turin.

"Analysis of a Lost-Motion-Type Hydraulic System for Variable Valve Actuation", Burak Gecim, General Motors Research, Published Aug. 22, 1993.

"Hydraulics. Theory and Applications", Robert Bosch, GmbH Automation Technology Division, Published: 1998.

F. Payri, J.M. Desantes, and J.M. Corberan, "A Study of the Performance of SI Engine Incorporating a Hydraulically Controlled Variable Valve Timing System," SAE Technical Paper Series, International Congress and Exposition, Detroit Michigan, Feb. 29-Mar. 4, 1988.

International Search Report in related application No. PCT/US1998/026496, Apr. 8, 2009.

International Search Report in related application No. PCT/US2000/035522, Jun. 28, 2001.

Supplementary European Search Report in related application No. EP 98 96 3899, Jun. 11, 2009.

Supplementary European Search Report in related application No. EP 00 98 9562, Sep. 21, 2011.

English language translation of Official Action for related Japanese patent application No. 2000-524562, mailed Jan. 30, 2007.

English language translation of Notice to File a Response for related Korean patent application No. 10-2000-7006295, dated Sep. 12, 2005.

*Primary Examiner* — John Kwon

(74) *Attorney, Agent, or Firm* — Day Pitney LLP; Brian R. Pollack

(57) ABSTRACT

A lost motion engine valve actuation system and method of actuating an engine valve are disclosed. The system may comprise a valve train element, a pivoting lever, a control piston, and a hydraulic circuit. The pivoting lever may include a first end for contacting the control piston, a second end for transmitting motion to a valve stem and a means for contacting a valve train element. The amount of lost motion provided by the system may be selected by varying the position of the control piston relative to the pivoting lever. Variation of the control piston position may be carried out by placing the control piston in hydraulic communication with a control trigger valve and one or more accumulators. Actuation of the trigger valve releases hydraulic fluid allowing for adjustment of the control piston position. Means for limiting valve seating velocity, filling the hydraulic circuit upon engine start up, and mechanically locking the control piston/lever for a fixed level of valve actuation are also disclosed.

28 Claims, 70 Drawing Sheets

VARIABLE LOST MOTION VALVE ACTUATOR AND METHOD

CROSS REFERENCE TO RELATED PATENT APPLICATION

This application is a continuation of, relates to, and claims priority on U.S. utility patent application Ser. No. 11/450,286, filed Jun. 12, 2006, which application is a continuation-in-part of, relates to, and claims priority on U.S. utility patent application Ser. No. 10/251,748, filed Sep. 23, 2002 and now U.S. Pat. No. 7,059,282, which application is a divisional of, relates to, and claims priority on U.S. utility patent application Ser. No. 09/749,907, filed Dec. 29, 2000 and now U.S. Pat. No. 6,510,824, which application is a continuation-in-part of, relates to, and claims priority on U.S. patent application Ser. No. 09/594,791, filed Jun. 16, 2000 and now U.S. Pat. No. 6,293,237, which application is a continuation of, relates to, and claims priority on U.S. patent application Ser. No. 09/209,486, filed Dec. 11, 1998 and now U.S. Pat. No. 6,085,705, which application relates to and claims priority on provisional application Ser. No. 60/069,270, filed Dec. 11, 1997.

FIELD OF THE INVENTION

The present invention relates generally to methods and apparatus for intake and exhaust valve actuation in internal combustion engines.

BACKGROUND OF THE INVENTION

Valve actuation in an internal combustion engine is required in order for the engine to produce positive power, as well as to produce engine braking. During positive power, intake valves may be opened to admit fuel and air into a cylinder for combustion. The exhaust valves may be opened to allow combustion gas to escape from the cylinder.

During engine braking, the exhaust valves may be selectively opened to convert, at least temporarily, an internal combustion engine into an air compressor. This air compressor effect may be accomplished by partially opening one or more exhaust valves near piston top dead center position for compression-release type braking, or by maintaining one or more exhaust valves in a partially open position for much or all of the piston motion for bleeder type braking. In doing so, the engine develops retarding horsepower to help slow the vehicle down. This can provide the operator increased control over the vehicle and substantially reduce wear on the service brakes of the vehicle. A properly designed and adjusted engine brake can develop retarding horsepower that is a substantial portion of the operating horsepower developed by the engine in positive power.

The braking power of an engine brake may be increased by selectively opening the exhaust and/or intake valves to carry out exhaust gas recirculation (EGR) in combination with engine braking. Exhaust gas recirculation denotes the process of channeling exhaust gas back into the engine cylinder after it is exhausted out of the cylinder. The recirculation may take place through the intake valve or the exhaust valve. When the exhaust valve is used, for example, the exhaust valve may be opened briefly near bottom dead center on the intake stroke of the piston. Opening of the exhaust valve at this time permits higher pressure exhaust gas from the exhaust manifold to recirculate back into the cylinder. The recirculation of exhaust gas increases the total gas mass in the cylinder at the time of the subsequent engine braking event, thereby increasing the braking effect realized.

For both positive power and engine braking applications, the engine cylinder intake and exhaust valves may be opened and closed by fixed profile cams in the engine, and more specifically by one or more fixed lobes which may be an integral part of each of the cams. The use of fixed profile cams makes it difficult to adjust the timings and/or amounts of engine valve lift needed to optimize valve opening times and lift for various engine operating conditions, such as different engine speeds.

One method of adjusting valve timing and lift, given a fixed cam profile, has been to incorporate a "lost motion" device in the valve train linkage between the valve and the cam. Lost motion is the term applied to a class of technical solutions for modifying the valve motion dictated by a cam profile with a variable length mechanical, hydraulic, or other linkage means. In a variable valve actuation lost motion system, a cam lobe may provide the "maximum" (longest dwell and greatest lift) motion needed for a full range of engine operating conditions. A variable length system may then be included in the valve train linkage, intermediate of the valve to be opened and the cam providing the maximum motion, to subtract or lose part or all of the motion imparted by the cam to the valve.

This variable length system (or lost motion system) may, when expanded fully, transmit all of the cam motion to the valve, and when contracted fully, transmit none or a partial amount of the cam motion to the valve. An example of such a system and method is provided in Vorih et al., U.S. Pat. No. 5,829,397 (Nov. 3, 1998), Hu, U.S. Pat. No. 6,125,828, and Hu U.S. Pat. No. 5,537,976, which are assigned to the same assignee as the present application, and which are incorporated herein by reference.

In some lost motion systems, an engine cam shaft may actuate a master piston which displaces fluid from its hydraulic chamber into a hydraulic chamber of a slave piston. The slave piston in turn acts on the engine valve to open it. The lost motion system may include a solenoid valve and a check valve in communication with a hydraulic circuit connected to the chambers of the master and slave pistons. The solenoid valve may be maintained in an open or closed position in order to retain hydraulic fluid in the circuit. As long as the hydraulic fluid is retained, the slave piston and the engine valve respond directly to the motion of the master piston, which in turn displaces hydraulic fluid in direct response to the motion of a cam. When the solenoid position is changed temporarily, the circuit may partially drain, and part or all of the hydraulic pressure generated by the master piston may be absorbed by the circuit rather than be applied to displace the slave piston.

Historically, lost motion systems, while beneficial in many aspects, have also been subject to many drawbacks. For example, the provision of hydraulic passages in various engine components, as is required in lost motion systems, may decrease the structural stiffness, and thus the effectiveness, accuracy, and lifespan of such components. The need for added components or components of increased size in order to accommodate a lost motion system may also increase valve train inertia to the point that it becomes problematic at high engine speeds. The use of hydraulics may also result in initial starting difficulties as the result of a lack of hydraulic fluid in the system. It may be particularly difficult to charge the system with hydraulic fluid when the fluid is cold and has a higher viscosity. Lost motion systems may also add complexity, cost, and space challenges due to the number of parts required. Furthermore, the need for rapid and repeated hydraulic fluid flow in prior art systems has also resulted in undesirable levels of parasitic loss and overheating of hydraulic fluid in the system.

Thus there is a need for, and the various embodiments of the present invention provide: improved structural stiffness compared to other lost motion systems that depend on displaced oil volumes to transmit motion; increased maximum valve closing velocities as compared to other lost motion systems; reduced cost and complexity due to the reduced number of high speed trigger valves and check valves required for the system; improved performance at initial start-up and decreased susceptibility to cold hydraulic fluid; decreased size and improved capability for integration into the cylinder head; reduced parasitic loss as compared with other lost motion systems; and improved hydraulic fluid temperature control.

The complexity of, and challenges posed by, lost motion systems may be increased by the need to incorporate an adequate fail-safe or "limp home" capability into such systems. In previous lost motion systems, a leaky hydraulic circuit could disable the master piston's ability to open its associated valve(s). If a large enough number of valves cannot be opened at all, the engine cannot be operated. Therefore, one valuable feature of various embodiments of the invention arises from the ability to provide a lost motion system which enables the engine to operate at some minimum level (i.e. at a limp home level) should the hydraulic circuit of such a system develop a leak. A limp home mode of operation may be provided by using a lost motion system which still transmits a portion of the can motion to the valve after the hydraulic circuit associated with the cam leaks or the control thereof is lost. In this manner the most extreme portions of a cam profile still can be used to get some valve actuation after control over the variable length of the lost motion system is lost and the system has contracted to a reduced length. The foregoing assumes, of course, that the lost motion system is constructed such that it will assume a contracted position should control over it be lost and that the valve train will provide the valve actuation necessary to operate the engine. In this manner the lost motion system may be designed to allow the engine to operate such that an operator can still "limp home" and make repairs.

A fundamental feature of lost motion systems is their ability to vary the length of the valve train. Not many lost motion systems, however, have utilized the high speed mechanisms that are required to rapidly vary the length of the lost motion system on a valve event-by-event basis. Lost motion systems accordingly have not been variable such that they may assume two functional lengths per cycle of the engine. The lost motion system that is the subject of this application is considerably advanced in comparison to other known systems due to its ability to provide variable valve actuation (VVA) on a valve event-by-event basis with each cycle of the engine. By using a high speed mechanism to vary the length of the lost motion system, more precise control may be attained over valve actuation, and accordingly optimal valve actuation may be attained for a wide range of engine operating conditions.

Applicants have determined that the lost motion system and method of the present invention may be particularly useful in engines requiring valve actuation for positive power, compression release engine braking, exhaust gas recirculation, cylinder flushing, and low speed torque increase. Typically, compression release and exhaust gas recirculation events involve much less valve lift than do positive-power-related valve events. Compression release and exhaust gas recirculation events may, however, require very high pressures and temperatures to occur in the engine. Accordingly, if left uncontrolled (which may occur with the failure of a lost motion system), compression release and exhaust gas recirculation could result in pressure or temperature damage to an engine at higher operating speeds. Therefore, it may be beneficial to have a lost motion system which is capable of providing control over positive power, compression release, and exhaust gas recirculation events, and which will provide only positive power or some low level of compression release and exhaust gas recirculation valve events, should the lost motion system fail. It may also be beneficial to provide a lost motion system capable of providing post main exhaust valve events which may be used to achieve cylinder flushing and low speed torque increases.

An example of a lost motion system and method used to obtain retarding and exhaust gas recirculation is provided by the Gobert, U.S. Pat. No. 5,146,890 (Sep. 15, 1992) for a Method And A Device For Engine Braking A Four Stroke Internal Combustion Engine, assigned to AB Volvo, and incorporated herein by reference. Gobert discloses a method of conducting exhaust gas recirculation by placing the cylinder in communication with the exhaust system during the first part of the compression stroke and optionally also during the latter part of the inlet stroke. Gobert uses a lost motion system to enable and disable retarding and exhaust gas recirculation, but such system is not variable within an engine cycle.

In view of the foregoing, there is a significant need for a system and method of controlling lost motion which: (i) optimizes engine operation under various engine operating conditions; (ii) provides precise control of lost motion; (iii) provides acceptable limp home and engine start-up capability; and (iv) provides for high speed variation of the length of a lost motion system. The lost motion system that is the subject of this application meets these needs, as well as others.

As noted above, one constraint on the use of lost motion systems arises from the addition of bulk in the engine compartment. Known systems for providing lost motion valve actuation have tended to be non-integrated devices which add considerable bulk to the valve train. As vehicle dimensions have decreased, so have engine compartment sizes. Accordingly, there is a need for a less bulky lost motion system, and in particular for a system which is compact and has a relatively low profile.

Furthermore, there is a need for low profile lost motion systems capable of varying valve actuation responsive to engine and ambient conditions. Variable actuation of intake and exhaust valves in an internal combustion engine may be useful for all potential valve events (positive power and engine braking). When the engine is in positive power mode, variation of the opening and closing times of intake and exhaust valves may be used in an attempt to optimize fuel efficiency, power, exhaust cleanliness, exhaust noise, etc., for particular engine and ambient conditions. During engine braking, variable valve actuation may enhance braking power and decrease engine stress and noise by modifying valve actuation as a function of engine and ambient conditions.

In an attempt to develop a functional and robust variable valve actuation system that is useful for both positive power and engine braking applications, Applicants have had to solve several design challenges. These design challenges have resulted in the development of sub-systems that not only allow the subject system to work effectively, but which may also be useful in other variable valve actuation systems.

For example, engine valves are required to open and close very quickly, therefore the valve spring is typically very stiff. When the valve closes, it may impact the valve seat with such force that it eventually erodes the valve or the valve seat, or even cracks or breaks the valve. In mechanical valve actuation systems that use a valve lifter to follow a cam profile, the cam lobe shape provides built-in valve-closing velocity control. In common rail hydraulically actuated valve assemblies, however, there is no cam to self-dampen the closing velocity of an engine valve. Likewise, in hydraulic lost motion systems such as the present ones, a rapid draining of fluid from the hydraulic circuit may allow an engine valve to "free fall" and seat at an unacceptably high velocity.

The system that is the subject of this application, being a lost motion system, presents valve seating challenges. The variable valve actuation capability of the present system may result in the closing of an engine valve at an earlier time than that provided by the cam profile. This earlier closing may be carried out by rapidly releasing hydraulic fluid (to an accumulator in the preferred embodiment) in the lost motion system. In such instances engine valve seating control is required because the rate of closing the valve is governed by the hydraulic flow to the accumulator instead of by the fixed cam profile. Engine valve seating control may also be required for applications (e.g. centered lift) in which the engine valve seating occurs on a high velocity region of the cam.

Applicants approached the valve seating challenge with the understanding that valve seating velocity should be less than approximately 0.4 msec. Absent steps to control valve seating velocity, however, the valves could seat at a velocity that is an order of magnitude greater. Applicants also determined that valve seating control preferably should be designed to function when the closing valve gets within 0.5 to 0.75 mm of the valve seat. The combination of valve thermal growth, valve wear, and tolerance stack-up can exceed 0.75 mm, resulting in the complete absence of seating velocity control or in an exceedingly long seating event if measures are not taken to adjust the lash of the valve seating control to account for such variations. It is also assumed that, preferably, valve seating control should not significantly reduce initial engine valve opening rate, and valve seating control should be capable of operating over a wide range of valve closing velocities and oil viscosities.

Existing devices used to control valve seating velocity may use hydraulic fluid flow restriction to produce pressure that acts on an area of the slave piston to develop a force to slow the slave piston and reduce seating velocity. The area on which the pressure acts may be very small in such devices which in turn requires that the pressure opposing the valve return spring be high, and the controlling flow rate be low. Low controlling flow rates result in an increased sensitivity to leakage. In addition, these devices may restrict the hydraulic fluid flow that produces valve opening.

In view of the foregoing there is a need for a valve catch sub-system for valve seating control that provides fine control of hydraulic fluid flow through the sub-system. There is also a need for a sub-system that does not adversely affect hydraulic fluid flow for valve opening and which is less susceptible to dimensional tolerances affecting leakage. In particular, there is a need for valve seating that is improved by a flow control that becomes more restrictive as the valve approaches the seat.

There is also a need for a valve catch that adjusts for lash differences between the engine valve and the valve catch. Although most variable valve actuation (VVA) systems are inherently self lash adjusting, valve seating control is not. Systems that do not need manual adjustment, either initially or as the system ages, are desirable. Previous valve seating control mechanisms have required a manual lash adjustment or a separate set of lash adjustment hardware. The design of a conventional hydraulic lash adjustor capable of transmitting compression-release braking loads would be challenging due to structural and compliance requirements.

The valve catch embodiment(s) of the present invention meet the aforementioned needs and provide other benefits as well. The valve catch embodiment(s) disclosed herein provide acceptable engine valve seating velocity in a VVA system, such as a lost motion or common rail system. For a lost motion WA system, engine valve seating control is provided for early engine valve closing, where the rate of closing is governed by the hydraulic flow from the control piston to the accumulator as opposed to a cam profile. Engine valve seating control also may be provided for a high velocity region of the cam. The lash adjusting portion of this mechanism provides an additional amount of seating control for the last few hundredths of a millimeter of valve closing.

The valve catch embodiment(s) of the present invention includes a variable flow area in the sub-system plunger. The valve catch embodiment(s) of the invention may also be designed to have relatively high flow rates, large orifices, and utilize small pressure drops. The valve catch embodiment(s) of the present invention may also experience reduced peak valve catch pressure as compared with some known valve catch systems. Furthermore, the variable flow restriction design of the valve catch embodiment(s) of the present invention is expected to be more robust than the constant flow restriction design with respect to engine valve velocity at the point of valve catch engagement and oil temperature and aeration control. Variable flow restriction may allow the displacement at the point of valve catch/slave piston engagement to be reduced, so that the valve catch has less undesired effect on the breathing of the engine.

Furthermore, Applicants implementation of a variable valve actuation system using lost motion hydraulic principles may require a sub-system for effecting initial start up of the system. An initial start mechanism (ISM) may be required to (i) accelerate the process of charging the subject lost motion system with hydraulic fluid, and/or (ii) permit actuation of the engine valve until such time as the subject system is fully charged with hydraulic fluid. Absent such a system, starting and/or smooth operation of the engine could be delayed due to the inaction of the engine valves until there is sufficient hydraulic fluid in the system to produce the desired valve motions. An added advantage of such a system is that it may provide a limp-home mode of operation for the engine as well in the event that the system is incapable of being charged with hydraulic fluid. Therefore, there is a need for a sub-system that provides valve actuation between the initial cranking of an engine and the charging of the variable valve actuation system with hydraulic fluid.

Still other advancements that may be required for operation of the subject system include an accumulator sub-system. In order to broaden the range of possible valve actuations that may be produced with the subject system, it may be beneficial to improve the rate at which the accumulator can absorb fluid and the rate at which it can supply fluid for re-fill operations. Improvement of this response time may permit more rapid variation of the motion of the engine valves in the system and may limit the loss of cam follow during periods of hydraulic fluid flow from the accumulator to the high-pressure hydraulic circuit. Accordingly, there is a need for a system accumulator with improved response time.

A basic method of improving accumulator response time is to increase the strength of the spring biasing the accumulator piston into its refill position. However, accumulator spring force cannot be increased indefinitely without incurring associated costs. For example, the accumulator spring force should be limited relative to the engine valve spring force so as to avoid engine valve float. In turn, the engine valve spring force may be limited by spring envelope constraints and the need to minimize parasitic loss of the VVA system.

Furthermore, the accumulator design would ideally prevent the high-pressure circuit pressure from dropping below ambient or the accumulator piston from bottoming out in its bore, because these situations could cause cavitation and evolution of dissolved air in the oil. This problem may be particularly troublesome during an early engine valve closing event, where oil must quickly flow to the accumulator to affect the early closing and then flow back to the high-pressure circuit when the engine valve seats or valve catch engages.

Despite all of the foregoing design challenges, Applicants have designed a compact and efficient accumulator system that provides improved response time. Applicants have designed a relatively low pressure accumulator system which provides improved performance as the result of synergy attributable to the combination of a low restriction trigger valve, shorter and larger fluid passages between the system elements, use of fewer or no check valves, larger yet low inertia accumulator pistons, reduced accumulator piston travel, and a gallery arrangement of multiple accumulators in common hydraulic communication.

Control feature advancements also appear to be desirable in view of the capabilities of the subject VVA system. For example, in some embodiments of the present invention, each of the engine valves in the subject system may be independently turned "on" or "off" for a prolonged period. Accordingly, there is a need for advanced control features, such as cylinder cut-out capability, which may reduce fuel consumption by only activating individual engine valves or engine valves associated with individual cylinders, on an as needed basis.

Control over cylinder cut-out necessarily requires active control over cylinder re-start. Assuming the cylinder cut-out is controlled in response to engine load (the lower the load, the less cylinders needed for power), then cylinder re-start must also be provided responsive to increasing engine load. Embodiments of the present invention provide for such active control over cylinder re-start, as well as cylinder cut-out.

The use of hydraulic actuation also may necessitate control features that modify the timing of hydraulic actuation based on the viscosity of the hydraulic fluid in the system. Typically, the viscosity of hydraulic fluid, such as engine oil, lowers as it increases in temperature. As viscosity lowers, the response time for hydraulic actuation involving the fluid may decrease. Because the temperature of the hydraulic fluid used in connection with the various embodiments of the present invention may vary by more than 100 degrees Celsius, there is a need to adjust the timing of some hydraulic actuation events based on the temperature and/or viscosity of the hydraulic fluid. Various embodiments of the present invention provide for modification of hydraulic actuation based on the temperature and/or viscosity of the hydraulic fluid used for such actuation.

Others have attempted to provide for the modification of valve actuation systems. U.S. Pat. No. 5,423,302 to Glassey discloses a fuel injection control system having actuating fluid viscosity feedback using several sensors including a crankshaft angular speed sensor, an engine coolant temperature sensor, and a voltage sensor. U.S. Pat. No. 5,411,003 to Eberhard et al. ("Eberhard") discloses a viscosity sensitive auxiliary circuit for a hydromechanical control valve for timing the control of a tappet system. Eberhard utilizes a pressure divider chamber to influence timing control. U.S. Pat. No. 4,889,085 to Yagi et al. discloses a valve operating device for an internal combustion engine that utilizes a damper chamber in connection with a restriction mechanism. Some of these inventions attempt to compensate for increased viscosity by modifying the flow of working fluid, rather than the timing of the operation of the valves themselves. In addition, many of these devices are complex and difficult to maintain. Accordingly, there remains a need for a method and apparatus for modifying the opening and closing of engine valves based on an engine fluid temperature and/or viscosity that is accurate, easy to implement, cost effective, and easy to calibrate by the user.

As may be evident, the embodiments of the present invention disclosed herein may be particularly useful in a wide variety of internal combustion engines. Such engines are often considered to emit undesirably high levels of noise. Accordingly, various embodiments of the invention may also incorporate control features which tend to reduce the level of noise produced by such engines, both during positive power and during engine braking.

OBJECTS OF THE INVENTION

It is therefore an object of the present invention to provide a system and method for optimizing engine operation under various engine and ambient operating conditions through variable valve actuation control.

It is another object of the present invention to provide a system and method for providing high speed control of the lost motion in a valve train.

It is a further object of the present invention to provide a system and method of valve actuation which provides a limp-home capability.

It is yet another object of the present invention to provide a system and method for selectively actuating a valve with a lost motion system for positive power, compression release braking, and exhaust gas recirculation modes of operation.

It is still a further object of the present invention to provide a system and method for valve actuation which is compact and light weight.

It is still another object of the present invention to provide a system and method for seating an engine valve after actuation thereof.

It is still another object of the present invention to provide a system and method for actuating the engine valves in a lost motion system prior to charging the system with hydraulic fluid.

It is still another object of the present invention to provide a system and method for accelerating the process of charging a lost motion system with hydraulic fluid.

It is still another object of the present invention to provide a system and method for improving the response time of the accumulator used in a variable valve actuation system.

It is still another object of the present invention to provide a system and method for selectively cutting-out and re-starting the operation of engine valves for particular cylinders.

It is still another object of the present invention to provide a system and method for improving positive power fuel economy of an engine.

It is still another object of the present invention to provide a system and method for decreasing the noise produced by an engine, particularly compression release engine braking noise.

It is still another object of the present invention to provide a system and method for decreasing emissions produced by an engine.

It is still another object of the present invention to provide a system and method for modifying the timing of hydraulic actuation in a variable valve actuation system to account for changes in hydraulic fluid temperature and/or viscosity.

It is still another object of the present invention to provide systems and methods for hydraulically and electronically controlling the actuation of engine valves for positive power and engine braking applications.

Additional objects and advantages of the invention are set forth, in part, in the description which follows, and, in part, will be apparent to one of ordinary skill in the art from the description and/or from the practice of the invention.

SUMMARY OF THE INVENTION

In response to this challenge, Applicants have developed an innovative and reliable engine valve actuation system comprising: means for containing the system; a piston bore provided in the system containing means; a low pressure fluid supply passage connected to the piston bore; a piston having (i) a lower end residing in the piston bore, and (ii) an upper end extending out of the piston bore; a pivoting lever including first, second, and third contact points, wherein the first contact point of the lever is adapted to impart motion to the engine valve, and the third contact point is adapted to contact the piston upper end; a motion imparting valve train element contacting the second contact point of the pivoting lever; and means for repositioning the piston relative to the piston bore, said means for repositioning intersecting the low pressure fluid supply passage.

Applicants have also developed an innovative engine valve actuation system adapted to selectively provide main valve event actuations and auxiliary valve event actuations, said system comprising: means for containing the system, said containing means having a piston bore and a first fluid passage communicating with the piston bore; a lever located adjacent to the containing means, said lever including (i) a first repositionable end, (ii) a second end for transmitting motion to an engine valve, and (iii) a centrally located cam roller; a piston disposed in the piston bore and connected to the first repositionable end of the lever; a cam in contact with the cam roller; a fluid control valve in communication with the piston bore via the first fluid passage; means for actuating the fluid control valve to control the flow of fluid from the piston bore through the first fluid passage; and means for supplying low pressure fluid to the piston bore.

Applicants have further developed an innovative apparatus for limiting the seating velocity of an engine valve comprising: a housing; a seating bore provided in the housing; means for supplying fluid to the seating bore; an outer sleeve slidably disposed in the seating bore and defining an interior chamber; a cup piston slidably disposed in the outer sleeve, said cup piston having a lower surface adapted to transmit a valve seating force to the engine valve; a cap connected to an upper portion of the outer sleeve, said cap having an opening there through; a disk disposed within the interior chamber between the cup piston and the cap, said disk having at least one opening there through; a central pin disposed in the interior chamber between the cup piston and the disk; a spring disposed around the central pin and between the disk and the cup piston; an upper seating member slidably disposed in the seating bore; and a means for biasing the upper seating member towards the cap.

Applicants have also developed an innovative valve actuation system for controlling the operation of an engine valve, said system comprising: means for hydraulically varying the amount of engine valve actuation; a solenoid actuated trigger valve operatively connected to the means for hydraulically varying; and means for determining trigger valve actuation and deactuation times based on a selected engine mode, and engine load and engine speed values.

Applicants have further developed an innovative valve actuation system for controlling the operation of at least one valve of an engine at different operating temperatures, comprising: means for determining a present temperature of an engine fluid; means for operating the at least one valve; and means for modifying the operation of the at least one valve in response to the determined temperature.

Applicants have also developed an innovative valve actuation system for controlling the operation of at least one valve of an engine at different engine fluid operating viscosities, comprising: means for determining a present viscosity of an engine fluid; means for operating the at least one valve; and means for modifying the operation of the at least one valve in response to the determined viscosity.

Applicants have further developed an innovative method of modifying the timing of at least one engine valve, said method comprising the steps of: determining a current temperature of an engine fluid; determining a timing modification for the operation of the at least one engine valve based on the determined current temperature; and modifying the timing of the operation of the at least one engine valve in response to the determined timing modification.

Applicants have also developed an innovative method of modifying the timing of at least one engine valve, said method comprising the steps of: determining a current viscosity of an engine fluid; determining a timing modification for the operation of the at least one engine valve based on the determined current viscosity; and modifying the timing of the operation of the at least one engine valve in response to the determined timing modification.

Applicants have further developed an innovative lost motion engine valve actuation system comprising: a rocker lever adapted to provide engine valve actuation motion, said rocker lever having a first repositionable end and a second end for transmitting valve actuation motion; means for hydraulically varying the position of the first end of the rocker lever; and means for maintaining the position of the first end of the rocker lever during periods of time that the means for hydraulically varying is inoperative.

Applicants have still further developed an innovative lost motion engine valve actuation system comprising: a lost motion piston and a means for locking said lost motion piston into a fixed position during engine start-up.

Applicants have further developed an innovative lost motion engine valve actuation system comprising: a lost motion piston and a means for locking said lost motion piston into a fixed position at times when hydraulic fluid pressure is below a predetermined threshold.

It is to be understood that both the foregoing general description and the following detailed description are exemplary and explanatory only, and are not restrictive of the invention as claimed. The accompanying drawings, which are incorporated herein by reference, and which constitute a part of this specification, illustrate certain embodiments of the invention and, together with the detailed description, serve to explain the principles of the present invention.

BRIEF DESCRIPTION OF THE DRAWINGS

Various embodiments and elements of the invention are shown in the following figures, in which like reference numerals are intended to refer to like elements.

DETAILED DESCRIPTION OF THE PREFERRED EMBODIMENTS

Figure 1:
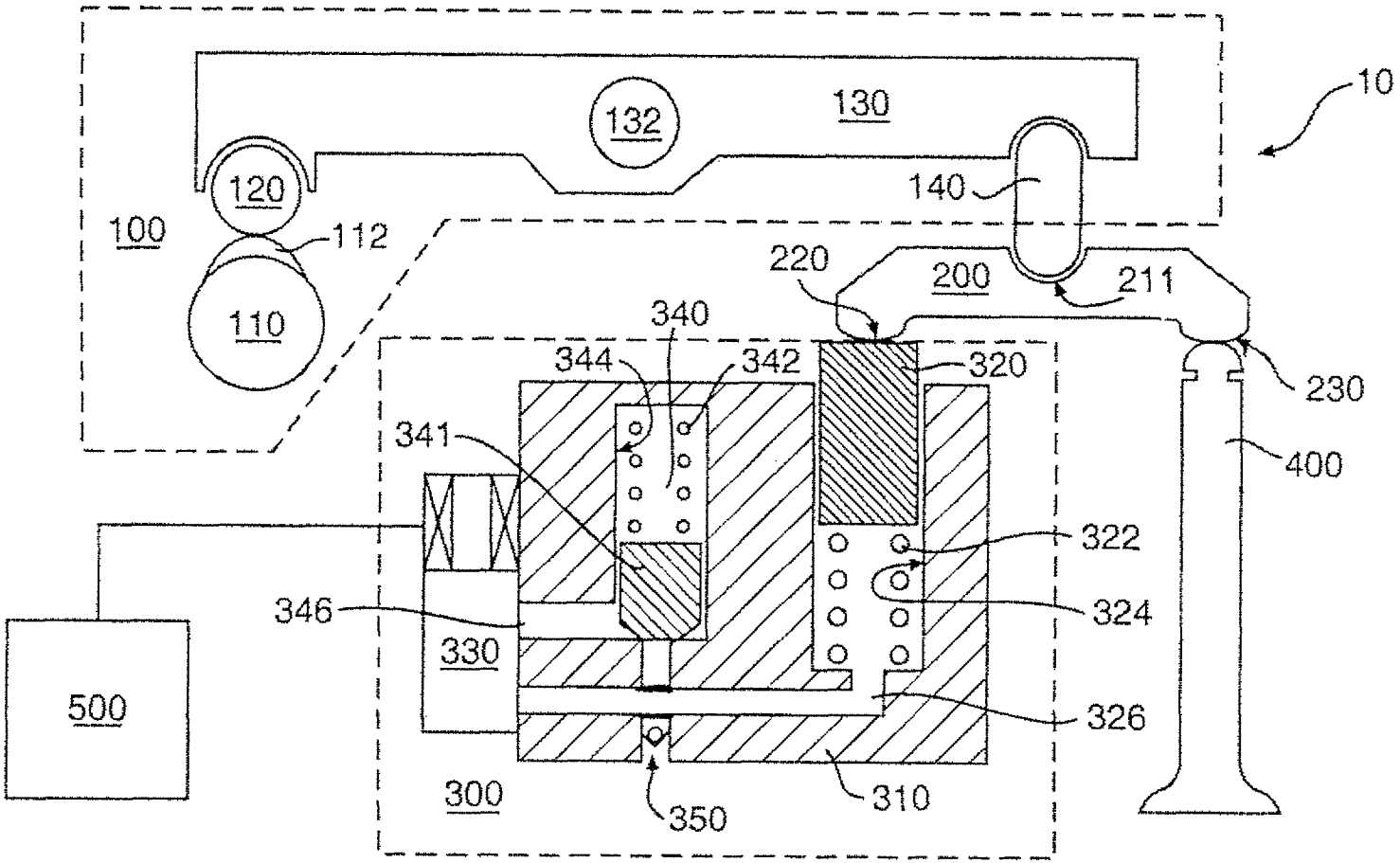
FIG. 1 is a cross-section of a variable valve actuation system embodiment of the invention.

Reference will now be made in detail to a first embodiment of the present invention, an example of which is illustrated in the accompanying drawings. A first embodiment of the present invention is shown in FIG. 1 as an engine valve actuation system 10.

Engine valve actuation system 10 may include a means for providing valve actuation motion 100. The motion means 100 may include various valve train elements, such as a cam 110, a cam roller 120, a rocker arm 130, and a lever pushrod 140. A fixed valve actuation motion may be provided to the motion means 100 via one or more lobes 112 on the cam 110. Displacement of the roller 120 by the cam lobe 112 may cause the rocker arm 130 to pivot about an axle 132. Pivoting of the rocker arm 130 may, in turn, cause the lever pushrod 140 to be displaced linearly. The particular arrangement of elements that comprise the motion means 100 may not be critical to the invention. For example, cam 110 alone could provide the linear displacement provided by the combination of cam 110, roller 120, rocker arm 130, and lever pushrod 140, in FIG. 1.

Motion means 100 may contact a pivoting bridge 200 at a pivot point 211 (which may or may not be recessed in the bridge). The position of the surface 220 may be adjusted by adjusting the position of the surface on which the surface 220 rests. The pivoting bridge 200 may also include a surface 220 for contacting an adjustable piston 320, and a surface 230 for contacting a valve stem 400. Valve springs (not shown) may bias the valve stem 400 upward and cause the surface 220 to be biased downward against a system 300 for providing a moveable surface.

System 300 may include a housing 310, a piston 320, a trigger valve 330, and an accumulator 340. The housing 310 may include multiple passages therein for the transfer of hydraulic fluid through the system 300. A first passage 326 in the housing 310 may connect the bore 324 with the trigger valve 330. A second passage 346 may connect the trigger valve 330 with the accumulator 340. A third passage 348 (see, e.g., FIG. 6) may connect the accumulator 340 with a check valve 350.

The piston 320 may be slidably disposed in a piston bore 324 and biased upward against the surface 220 by a piston spring 322. The biasing force provided by the piston spring 322 may be sufficient to hold the piston 320 against the surface 220, but not sufficient to resist the downward displacement of the piston when a significant downward force is applied to the piston by the surface 220.

The accumulator 340 may include an accumulator piston 341 slidably disposed in an accumulator bore 344 and biased downward by an accumulator spring 342. Hydraulic fluid that passes through the trigger valve 330 may be stored in the accumulator 340 until it is used to refill the bore 324.

Linear displacement may be provided by the motion means 100 to the pivoting bridge 200. Displacement provided to the pivoting bridge 200 may be transmitted through surface 230 to the valve stern 400. The valve actuation motion that is transmitted by the pivoting bridge 200 to the valve stem 400 may be controlled by controlling the position of the surface 220 relative to the pivot point 211. Given the input of a fixed downward motion on the pivoting bridge 200 by the pushrod 140, if the position of the surface 220 is raised relative to the pivot point 211, then the downward motion experienced by the valve stem 400 is increased relative to what it would have otherwise been. Conversely, if the position of the surface 220 is lowered relative to the pivot point 211, then the downward motion experienced by the valve stem 400 is decreased. Thus, by selectively lowering the position of the surface 220, relative to the pivot point 211, motion imparted by the motion means 100 to the pivoting bridge 200 may be selectively "lost".

When the motion means 100 applies a downward displacement to the pivoting bridge 200, the displacement experienced by the valve stem 400 may be controlled by controlling the position of piston 320 at the time of such downward displacement. During such downward displacement, piston 320 pressurizes the hydraulic fluid in bore 324 beneath the piston. The hydraulic pressure is transferred by the fluid through passage 326 to the trigger valve 330. Thus, selective bleeding of hydraulic fluid through the trigger valve 330 may enable control over the position of the piston 320 in the bore 324 by controlling the volume of hydraulic fluid in the bore underneath the piston.

It may be desirable to use a trigger valve 330 that is a high speed device; i.e. a device that is capable of being opened and closed at least once per engine cycle. A two-position/two-port valve may provide the level of high speed required. The trigger valve 330 may, for example, be similar to the trigger valves disclosed in the Sturman U.S. Pat. No. 5,460,329 (issued Oct. 24, 1995), for a High Speed Fuel Injector; and/or the Gibson U.S. Pat. No. 5,479,901 (issued Jan. 2, 1996) for a Electro-Hydraulic Spool Control Valve Assembly Adapted For A Fuel Injector. Preferably, the trigger valve 330 may include a solenoid actuator similar to the one shown in FIG. 7. The trigger valve 330 may include a passage connecting first passage 326 and second passage 346, a solenoid, and a passage blocking member responsive to the solenoid. The amount of hydraulic fluid in the bore 324 may be controlled by selectively blocking and unblocking the passage in the trigger valve 330. Unblocking the passage through the trigger valve 330 enables hydraulic fluid in the bore 324 and the first passage 326 to be transferred to the accumulator 340.

An electronic valve controller 500 may be used to control the position of the moveable portion of the trigger valve 330. By controlling the time at which the passage through the trigger valve is open, the controller 500 may control the amount of hydraulic fluid in the bore 324, and thus control the position of the piston 320.

With regard to a method embodiment of the invention, the system 300 may operate as follows to control valve actuation. The system 300 may be initially charged with oil, or some other hydraulic fluid, through an optional check valve 350. Trigger valve 330 may be kept open at this time to allow oil to fill passages 348, 346, and 326, and to fill bore 324. Once the system is charged, the controller 500 may close the trigger valve 330, thereby locking the piston 320 into a relatively fixed position based on the volume of oil in the bore 324. Thereafter, the controller 500 may determine a desired level of valve actuation and determine the required position of the piston 320 to achieve this level of valve actuation. The controller 500 may then selectively open the trigger valve 330 so that oil is free to escape from the bore 324 as the motion means 100 forces the piston 320 into the bore. If the motion means is not in position to force the piston 320 downward, opening the trigger valve 330 may result in the addition of hydraulic fluid to the bore 324. Once the trigger valve 330 is closed again, the piston 320 is locked and the motion means 100 may then apply a fixed displacement motion to the pivoting bridge 200, while the pivoting bridge is supported on one end by the piston 320. The cycle of opening and closing the trigger valve may be repeated once per engine cycle to selectively lose a portion or all of a valve event.

The system 300 may be designed to provide limp home capability should the system develop a hydraulic fluid leak. Limp home capability may be provided by having a piston 320, piston spring 322, and bore 324 of a particular design. The combined design of these elements may be such that they provide a piston position which will still permit some level of valve actuation when the bore 324 is completely devoid of hydraulic fluid. The system 300 may provide limited lost motion, and thus limp home capability, in three ways. Limiting the travel of the piston 320 in its bore 324 may limit lost motion; limiting the travel of the accumulator piston 341 in the accumulator bore 344 may limit lost motion; and contact between the pivoting bridge surface 220 and the housing 310 may limit lost motion. Limiting lost motion through contact between the pivoting bridge surface 220 and the housing 310 may be facilitated by making surface 220 wider than the bore 324 so that the outer edges of the surface 220 may engage the housing 310.

Figure 2:
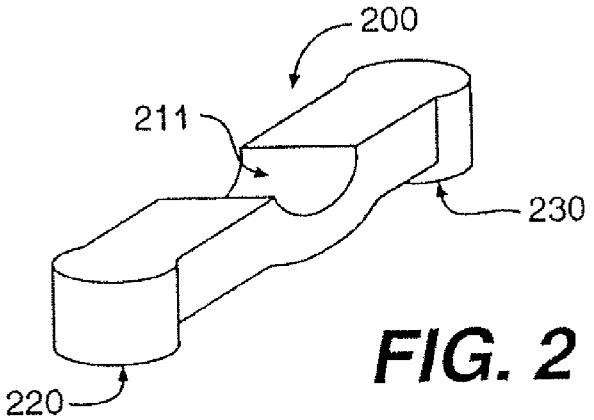
FIG. 2 is a pictorial illustration of a pivoting bridge element of the present invention.
Figure 3:
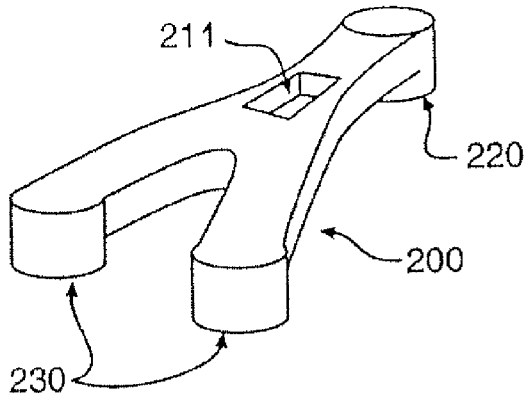
FIG. 3 is a pictorial illustration of an alternative pivoting bridge element of the present invention.
Figure 5:
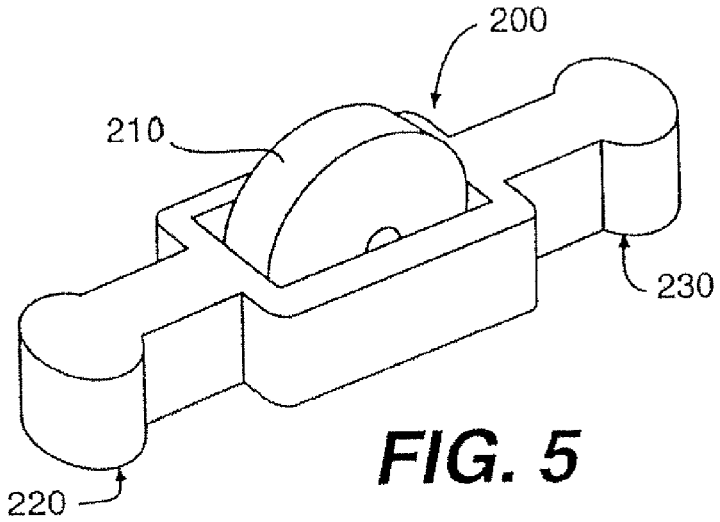
FIG. 5 is a pictorial illustration of an alternative pivoting bridge element of the present invention.

Alternative designs for the pivoting bridge 200 which fall within the scope of the invention, are shown in FIGS. 2, 3 and 5. The pivoting bridge 200 shown in FIG. 3 is a Y-shaped yoke that includes two surfaces 230 for contacting two different valve stems (not shown). The pivoting bridge 200 shown in FIG. 5 includes a cam roller 210 for direct contact with a cam.

In alternative embodiments of the invention, the trigger valve 330 need not be a solenoid activated trigger, but could instead be hydraulically or mechanically activated. No matter how it is implemented, the trigger valve 330 preferably may be capable of providing one or more opening and closing movements per cycle of the engine and/or one or more opening and closing movements during an individual valve event.

Figure 4:
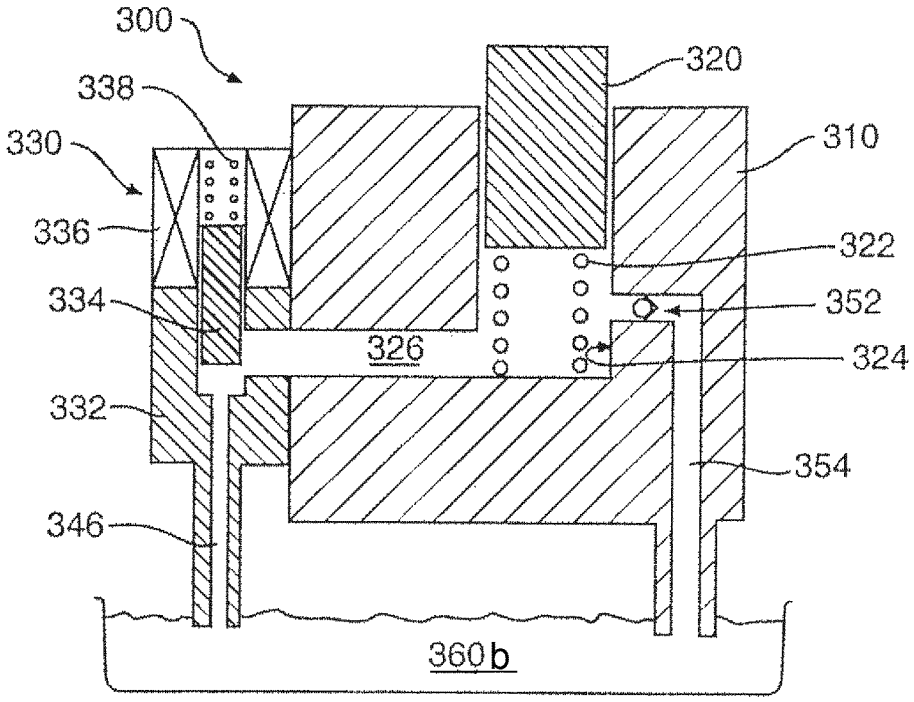
FIG. 4 is a cross-section of an alternative variable valve actuation system embodiment of the invention.

An alternative embodiment of the system 300 of FIG. 1 is shown in FIG. 4, in which like reference numerals refer to like elements. With reference to FIG. 4, the piston 320 may be slidably provided in a bore 324, and biased upward by a piston spring 322. The bore 324 may be charged with hydraulic fluid provided through a fill passage 354 from a fluid source 360*b*. Hydraulic fluid may be prevented from flowing back out of the bore 324 into the fill passage 354 by a check valve 352.

Hydraulic fluid in the bore 324 may be selectively released back to the fluid source 360*b* through a trigger valve 330. The trigger valve 330 may communicate with the bore 324 via a first passage 326. The trigger valve 330 may include a trigger housing 332, a trigger plunger 334, a solenoid 336, and a plunger return spring 338. Selective actuation of the solenoid 336 may result in opening and closing the plunger 334. When the plunger 334 is open, hydraulic fluid may escape from the bore 324 and flow back through the trigger valve and passage 346 to the fluid source 360*b*. The selective release of fluid from the bore 324 may result in selective lowering of the position of the piston 320. When the plunger 334 is closed, the volume of hydraulic fluid in the bore 324 is locked, which may result in maintenance of the position of the piston 320, even as pressure is applied to the piston from above.

Figure 6:
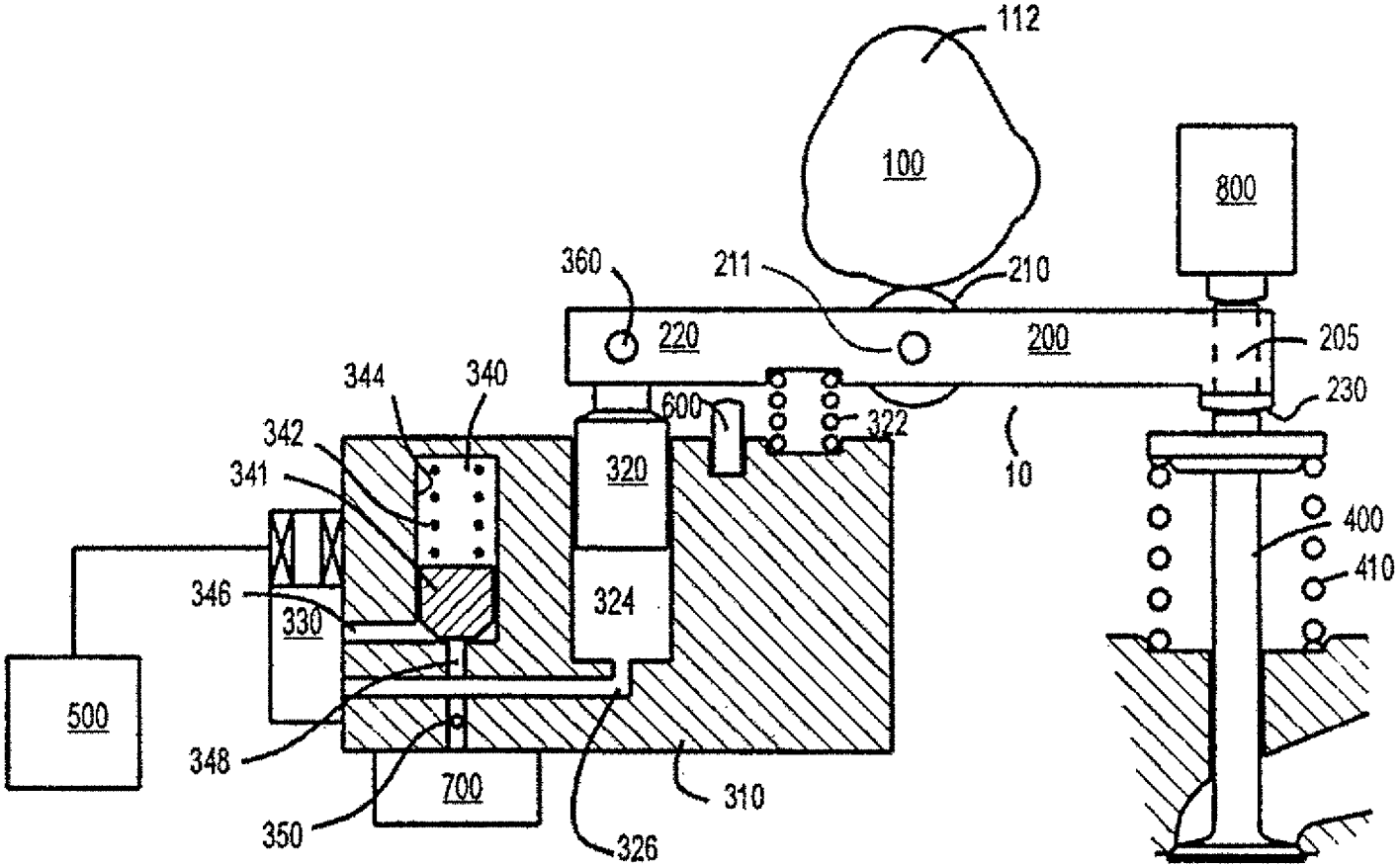
FIG. 6 is a cross-section of a second variable valve actuation system embodiment of the invention.

With reference to FIG. 6, in which like reference numerals refer to like elements, a preferred variable valve actuation system 10 embodiment of the invention is shown. In FIG. 6, the means for providing valve actuation motion 100 is shown as a cam. As with the previously described embodiments, the motion means 100 may include various valve train elements, such as a cam (shown in FIG. 6), or a rocker arm or lever pushrod (shown in FIG. 1). A fixed valve actuation motion may be provided by the motion means 100 via one or more lobes 112 on the cam.

Motion means 100 may contact a pivoting lever (bridge) 200 at a centrally defined point 211. A cam roller 210 may be provided at the central point. The lever 200 may also include a pinned end 220 connected to an adjustable piston 320, and a contact stem 205 with a surface 230 in contact with a valve stem 400. Depending upon the needs of the valve actuation system, the lever 200 may be Y-shaped so that a single lever is used to actuate two engine valves. Furthermore, bridges (not shown in FIG. 6) may be used at either the valve contact end 230 or the pinned end 220 of the lever 200, so that two or more engine valves are linked to one piston 320.

Valve springs 410 may bias the valve stem 400 upward and cause the adjustable piston 320 to be slidably biased downward into a bore 324 provided in the housing 310. As in the embodiment shown in FIG. 1, the housing 310 may further support a trigger valve 330, an accumulator 340, and a piston spring 322. References throughout the specification to the housing 310 should be interpreted to cover any means of containing the system 10, whether the containing means is a separate housing or a preexisting engine component such as an engine head or valve cover.

In addition to the foregoing elements, which are also included in the embodiment of the invention shown in FIG. 1, the embodiment shown in FIG. 6 may also include an electronic valve controller 500 including specialized control algorithms, an initial start mechanism 600, an optional modified low pressure (i.e. less than a couple hundred psi) hydraulic supply system 700, and a Self Adjusting Valve Catch (SAVC) 800. Detailed discussion of these additional elements is provided below.

The housing 310 may include multiple passages therein for the transfer of hydraulic fluid through the system. A first passage 326 in the housing 310 may connect the bore 324 with the trigger valve 330. A second passage 346 may connect the trigger valve 330 with the accumulator 340. A third passage 348 may connect the accumulator 340 with an hydraulic fluid supply system 700 through a check valve 350. In an alternative embodiment of the invention, the check valve 350 may not be required.

The piston 320 may be connected by a pin 360, or other connection means to the lever 200, which is biased upward by the spring 322. The biasing force provided by the spring 322 may be sufficient to hold the lever 200 against the motion means 100, but not so large as to cause engine valve float. The spring 322 may comprise a single spring directly under the lever 200 or two or more springs laterally spaced from the longitudinal axis of the lever.

The accumulator 340 may include an accumulator piston 341 slidably disposed in an accumulator bore 344 and biased downward by an accumulator spring 342. Low pressure hydraulic fluid (in the preferred embodiment) that passes through the trigger valve 330 may be stored in the accumulator 340 until it is used to refill the bore 324.

Figure 8:
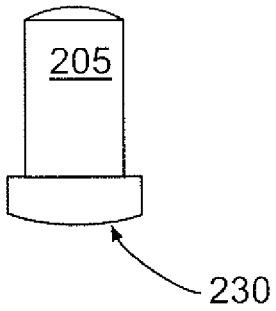
FIG. 8 is a side view of an embodiment of the valve stem contact pin portion of the present invention.

Linear displacement may be provided by the motion means 100 to the lever 200. Displacement provided to the lever 200 may be transmitted through surface 230 of the contact stem 205 to the valve stem 400. With reference to FIG. 8, the surface 230 of the contact stem 205 may have a dual radius of curvature so as to assist in self-correction of engine valve displacement differences that result from machining and assembly tolerances. The contact stems 205 may also serve to decelerate the lever 200 during Early Valve Closing or Centered Lift operational modes by contacting the SAVC 800 just prior to seating of the engine valve.

Figure 9:
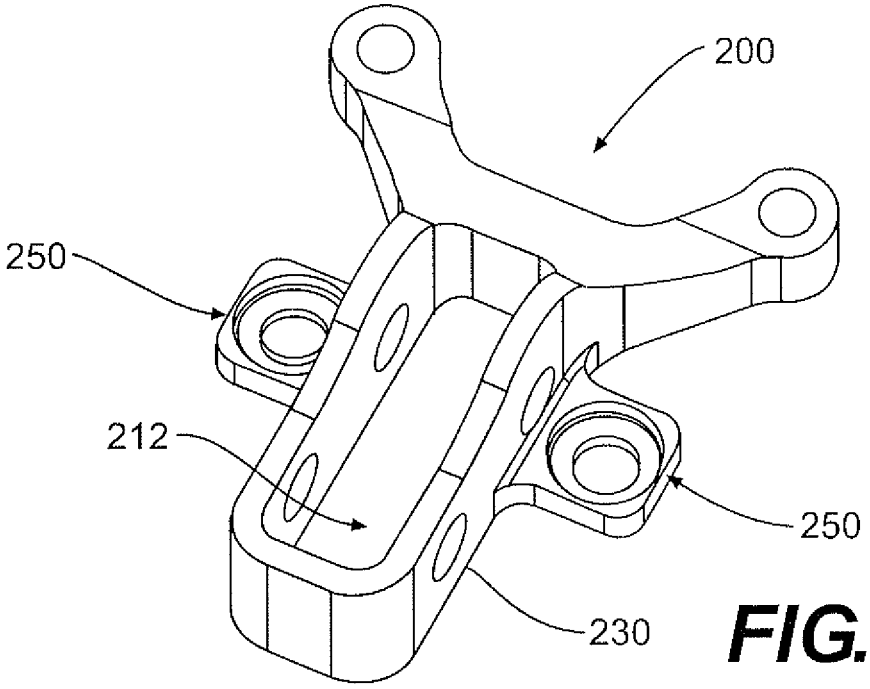
FIG. 9 is a pictorial view of an embodiment of the y-bridge lever portion of the present invention.

FIG. 9, in which like reference numerals refer to like elements, is a detailed pictorial illustration of a preferred embodiment of a Y-shaped lever 200 that may be used with the system shown in FIG. 6. The lever 200 shown in FIG. 9 includes laterally extending flanges 250 which are adapted to receive laterally spaced springs (shown in FIG. 6). The Y-shaped lever 200 may include a relatively wide space to accommodate a cam roller (not shown) and a recess 212 to accommodate pinning the piston (not shown) to the pinned end 230 of the lever.

With renewed reference to FIG. 6, the valve actuation motion that is transmitted by the motion means 100 to the valve stem 400 via the lever 200 may be controlled by controlling the position of the pinned end 220 of the lever. Given the input of a fixed downward motion by the motion means 100, if the position of the pinned end 220 of the lever is lowered, then the downward motion experienced by the valve stem 400 is decreased relative to what it would have been otherwise. Thus, by selectively lowering the position of the pinned end 220 through adjustment of the piston 320, motion imparted by the motion means 100 to the lever 200 may be selectively "lost."

With continued reference to FIG. 6, as with the system shown in FIG. 1, the displacement experienced by the valve stem 400 may be controlled by controlling the release of the fluid in the bore 324 that holds the piston 320 in place at a selective time during a downward displacement imparted by the motion means 100. During such a downward displacement, the piston 320 pressurizes the hydraulic fluid in bore 324 beneath the piston. The (now high pressure) hydraulic fluid extends from the bore 324 through the first passage 326 to the trigger valve 330. Thus, selectively timed opening of the trigger valve 330 causes the piston 320 to slide into the bore 324 and results in the loss of the motion imparted by the motion means 100.

A normally open (or closed) high-speed solenoid trigger valve 330 permits lost motion at the pinned end 220 of the lever 200 or prevents the loss of motion transmitted to the engine valve(s) 400 if it is activated by current from the engine controller 500 (which may contain a microprocessor linked to the engine fuel injection ECM). It may be desirable to use a trigger valve 330 that is a high speed device; i.e. a device that is capable of being opened and closed at least once during an engine cycle, and even as rapidly as on a cam lobe-by-lobe basis. Such rapid trigger valve actuation permits high speed valve actuation, such as is required for two cycle compression release engine braking (where a compression release event occurs each time the engine piston rotates through top dead center position). The trigger valve 330 may, for example, be similar to the trigger valves disclosed in the Sturman U.S. Pat. No. 5,460,329 (issued Oct. 24, 1995), for a High Speed Fuel Injector; and/or the Gibson U.S. Pat. No. 5,479,901 (issued Jan. 2, 1996) for a Electro-Hydraulic Spool Control Valve Assembly Adapted For A Fuel Injector. The trigger valve 330 may include a passage connecting the first passage 326 and the second passage 346, a solenoid, and a passage blocking member responsive to the solenoid. The amount of hydraulic fluid in the bore 324 may be controlled by selectively blocking and unblocking the passage in the trigger valve 330. Unblocking the passage through the trigger valve 330 enables hydraulic fluid in the bore 324 and the first passage 326 to be transferred to the accumulator 340.

Figure 7:
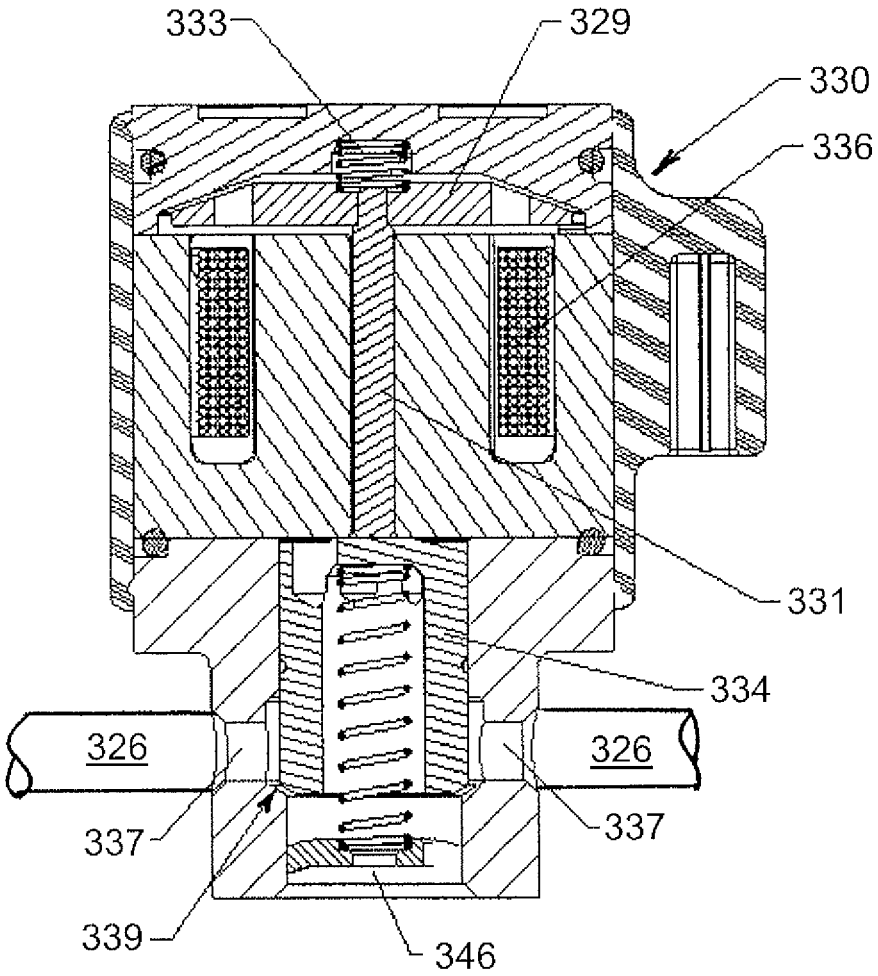
FIG. 7 is a cross-section of an embodiment of the trigger valve portion of the present invention.

The preferred trigger valve 330 that may be used with the invention is shown in FIG. 7. The trigger valve 330 may include an upper solenoid actuator 336 and a lower piston 334. A central pin 331 provided in the upper solenoid actuator 336 may be biased downward by an upper spring 333 into contact with the lower piston 334. The lower piston 334 may be biased upward by a lower spring 335 into contact with the central pin 331. When the trigger valve 330 is deactivated, the bias of the lower spring 335 overcomes the bias of the upper spring 333, and the lower piston 334 opens to allow the flow of hydraulic fluid from the first passage 326 to the second passage 346. When the trigger valve 330 is activated, the central pin 331 and the armature 329 are magnetically attracted downward, allowing the lower piston 334 to be displaced downward onto its seat 339, and thereby preventing hydraulic communication between the first and second passages 326 and 346.

With renewed reference to FIG. 6, the system 10 may operate as follows to control valve actuation. The system may be initially charged with oil, or some other hydraulic fluid, through a check valve 350 (this check valve may be eliminated in an alternative embodiment). The trigger valve 330 may be kept open at this time to allow oil to fill the first passage 326 and the piston bore 324. Once the system is charged, the controller 500 may close the trigger valve 330, thereby locking the piston 320 into a relatively fixed position based on the volume of oil in the bore 324. Thereafter, the controller 500 may determine a desired level of valve actuation and determine the required position of the piston 320 to achieve this level of valve actuation.

During the time that the motion means 100 is applying a force to the lever 200, the controller 500 may open the trigger valve 330 at a selective time, which results in the piston 320 being forced down into the bore 324, which in turn drives fluid from the bore. Hydraulic fluid (oil) that is driven from the bore 324 as a result of lost motion operation may pass through the trigger valve 330 to the low pressure accumulator gallery that includes one or more individual accumulators 340 fed with cylinder head port oil. The accumulator gallery is connected to one or more accumulators 340 in order to conserve displaced fluid and promote refilling of the bore 324 upon the next cycle of engine valve actuation. Bleed orifices or diametrical clearances may be provided in the low pressure section of the accumulator 340 and the valve catch 800 to provide cooling of the system through gradual cycling of the fluid in the system.

After the piston 320 completes the loss of the motion imparted by the motion means 100 fluid pressure from the accumulator 340 may force the piston 320 back upward as the motion means returns to its base state (i.e. base circle for a cam).

With continued reference to FIG. 6, the system 10 may also be designed to provide limp home capability should an hydraulic fluid leak occur. Limp home capability may be provided by having a piston 320 and bore 324 of a particular design, an accumulator piston and accumulator bore of a particular design, or a lever 200 and a housing 310 of a particular design. The combined design of these elements may be such that they provide a piston position which will still permit some level of main event valve actuation and possibly a lower level of valve actuation for some auxiliary event(s) when the bore 324 loses hydraulic fluid pressure. Limp home capability may also be provided by an external fixed stop used when the system 10 contains insufficient hydraulic fluid.

Figure 6A:
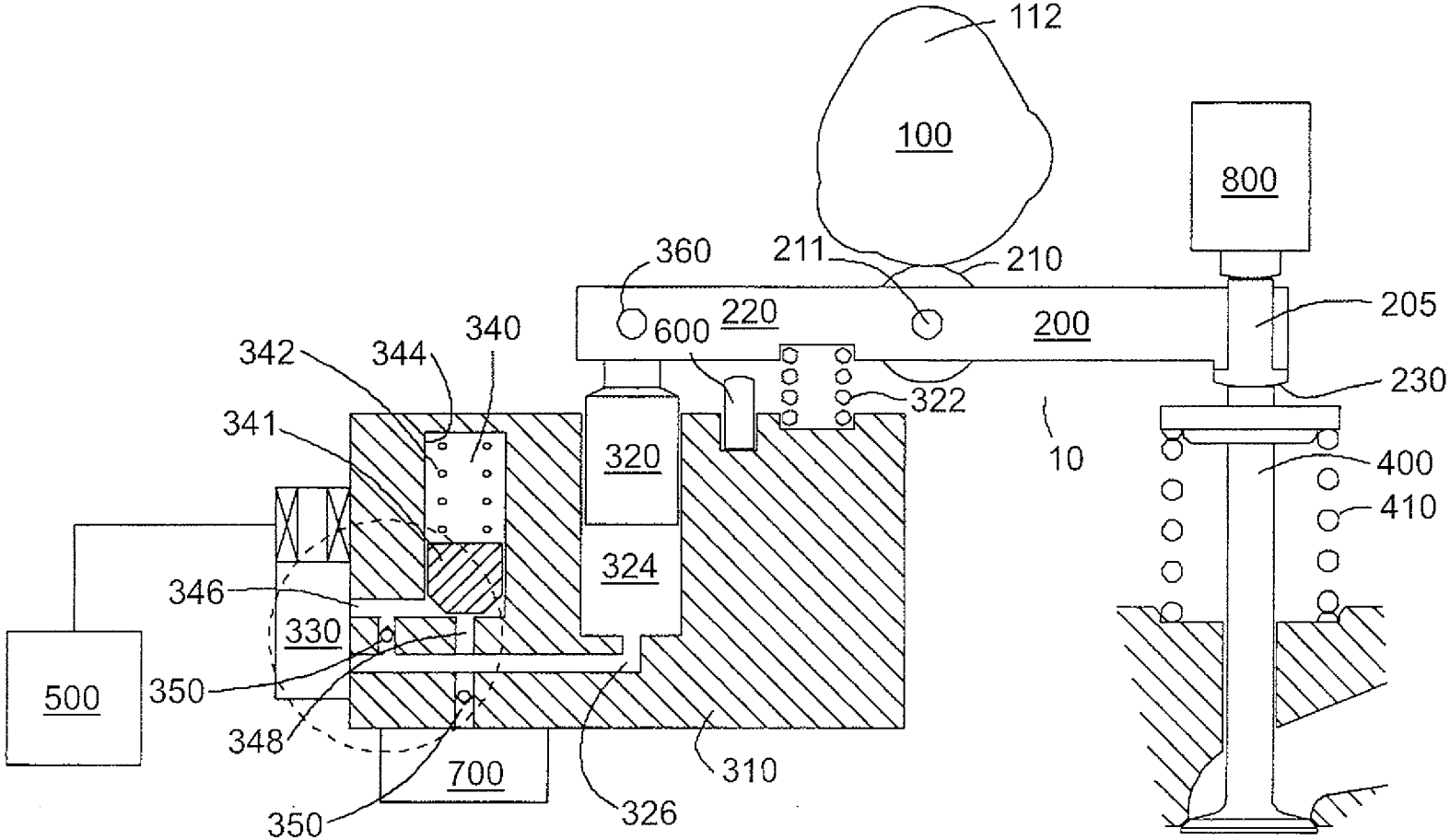
FIG. 6A is a cross-section of the variable valve actuation system shown in FIG. 6 with the addition of an optional bypass passage connecting the first passage 326 and the second passage 346.

FIG. 6A shows an alternative embodiment of the invention that is very similar to that shown in FIG. 6. In FIG. 6A, a passage connecting the first passage 326 and the second passage 346 is added. A check valve 350 is provided in this additional passage so that fluid flow may only occur from the second passage 346 to the first passage 326. This additional passage may be used to provide a constant feed of hydraulic fluid to the piston bore 324 regardless of the operational state of the trigger valve 330.

Reference will now be made in detail to the self adjusting valve catch (SAVC) portions of the present invention. The following described valve catch may be used in the various embodiments of the invention, such as those shown in FIGS. 6 and 11-19, in the position of valve catch 800.

Figure 10:
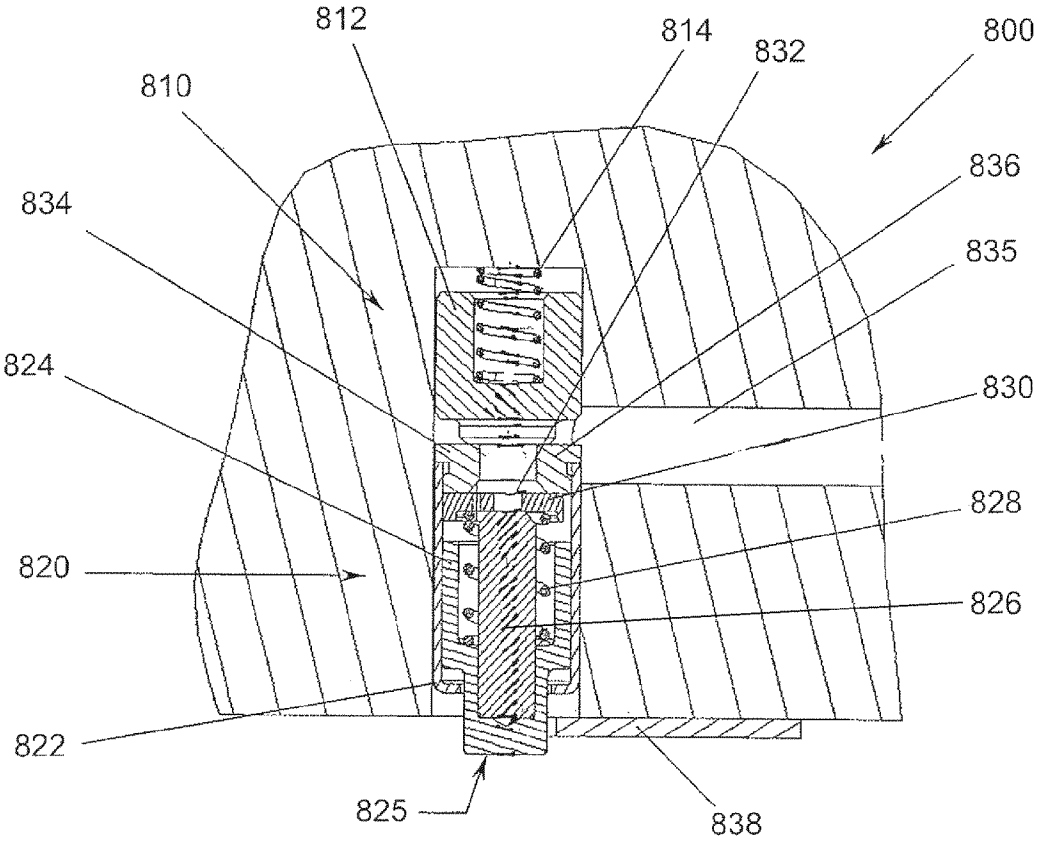
FIG. 10 is a cross-section of an embodiment of the valve catch portion of the present invention.

FIG. 10 is a cross-section of the valve catch portion of the present invention. The valve catch 800 includes an upper member 810 and a lower member 820. The upper member 810 may include an upper piston 812 and an upper piston spring 814 which biases the upper piston downward. The lower member 820 may include a sleeve 822, a cup piston 824, a central pin 826, a lower spring 828, a throttling disk 830, a cap 836, and a retaining member 838. The throttling disk 830 may include a center passage 832 and an off-center passage 834. The cup piston 824 may include a lower surface 825 adapted to contact a contact pin, another feature of the rocker lever, or a valve stem directly. It should be noted that in an alternative embodiment the upper member 810 and the lower member 820 may be fixedly connected together.

The components in FIG. 10 are in the position they would assume when the engine valve 400 is seated, i.e. between valve events. The upper piston spring 814 has pushed the upper piston 812 down into contact with the lower member 820 and has pushed both the upper and lower members down until the cup piston 824 has contacted the Y-bridge 200 or engine valve 400 as appropriate. Hydraulic fluid leaks past the outer diameter of the upper piston 812 to fill the area around the upper piston spring 814. The upper piston 812 is hydraulically locked and cannot move quickly. When the engine valve 400 opens, low pressure fluid in the supply passage 835 will cause the lower member 820 to move downward until the sleeve 822 contacts the retaining member 838. Fluid will also flow in through the center of the cap 836, past the throttling disk 830 and push the cup piston 824 down until it hits the end of the sleeve 822. Leakage past the upper piston 812 is so slow that the upper piston will have virtually no movement during the time the engine valve 400 is off of its seat. When the engine valve 400 is closing and approaches its seat, the valve stem or lever 200 will first hit the cup piston 824, pushing the lower member 820 upward until the cap 836 hits the upper piston 812. Continued engine valve motion will force the cup piston 824 upward within the sleeve 822, forcing fluid out of the holes in the throttling disk 830 and back into the supply passage 835. The restricted flow through the holes in the throttling disk 830 will produce an internal pressure in the lower member 820, slowing the engine valve motion. As the engine valve gets closer to its seat, the central pin 826 will start to block the central orifice 832, further restricting fluid flow there through and controlling the seating velocity. The stroke of the cup piston 824 within the lower member 820 and the diameter of orifices 832 and 834 can be adjusted to produce the desired seating velocity with a large variation in valve closing velocities.

Figure 11:
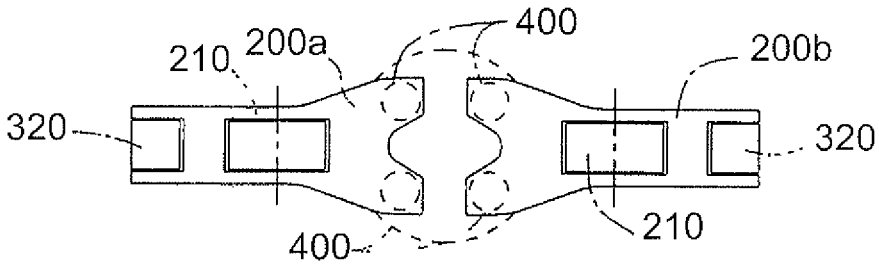
FIGS. 11, 12, 14, 16, and 18 are top plan views of various embodiments of the rocker lever portion of the present invention.
Figure 12:
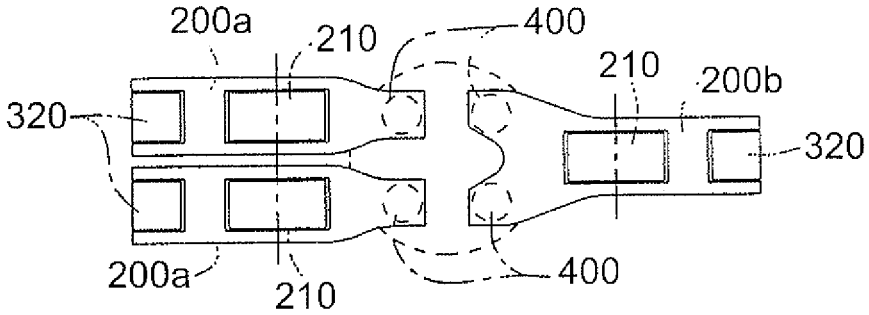

FIGS. 11 and 12 are top plan views of various combinations of lever arms 200 that may used in accordance with various embodiments of the invention. FIG. 11 shows a Y-shaped intake lever 200*a* and a Y-shaped exhaust lever 200*b* disposed over intake and exhaust valves 400. FIG. 12 shows two individually actuated intake levers 200*a* and a Y-shaped exhaust lever 200*b*. The individually actuated intake levers 200*a* permit the introduction and control of intake swirl into the cylinder by slightly advancing or delaying the opening or closing of one of the intake levers.

Figure 13:
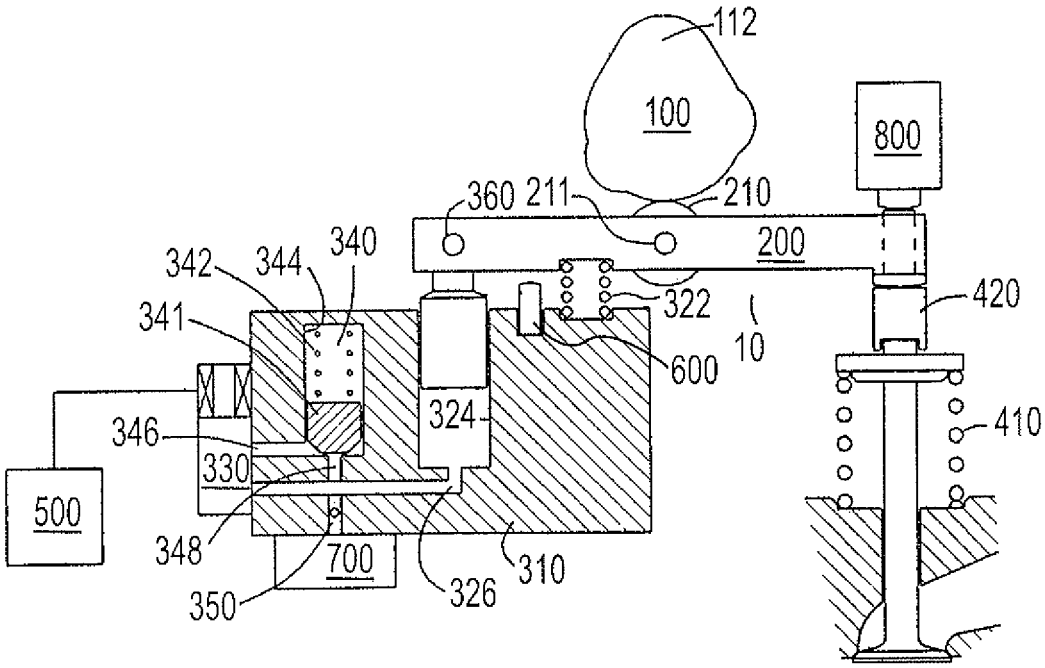
FIG. 13 is a cross-section of a third variable valve actuation system embodiment of the invention.
Figure 14:
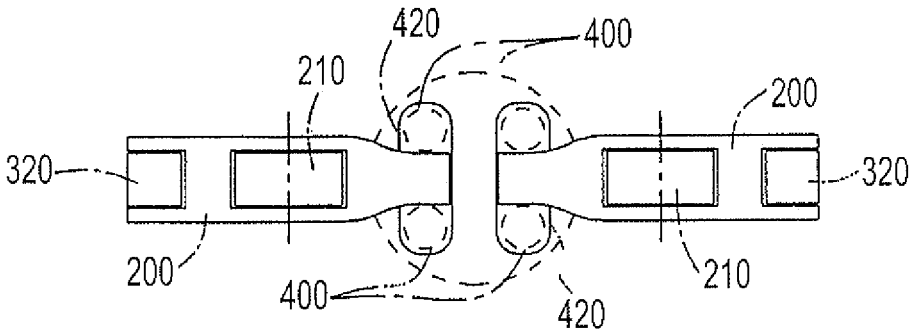

An alternative embodiment of the invention is shown in FIGS. 13 and 14, in which like reference numerals refer to like elements. With reference to FIGS. 13 and 14, a bridge 420 is disposed between the lever 200 and two valve stems 400. The bridge 420 permits the valve actuation provided by a single bar-shaped lever 200 to be transmitted to two engine valves 400.

Figure 15:
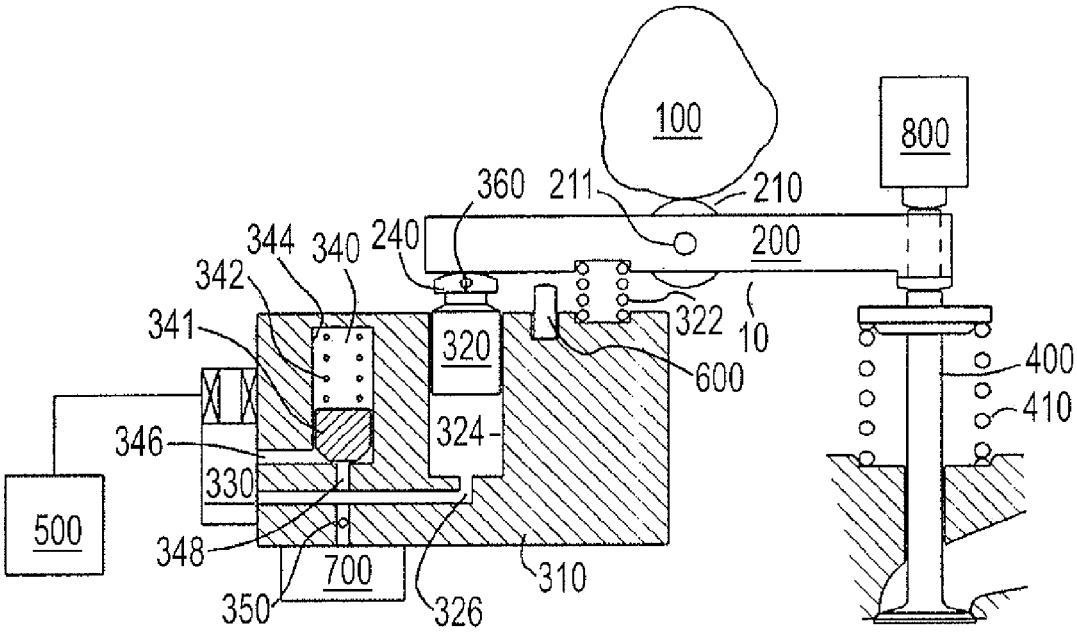
FIG. 15 is a cross-section of a fourth variable valve actuation system embodiment of the invention.
Figure 16:
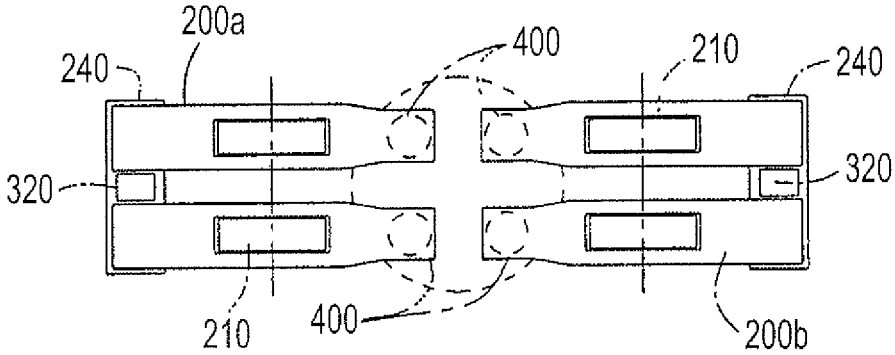

Another alternative embodiment of the invention is shown in FIGS. 15 and 16, in which like reference numerals refer to like elements. With reference to FIGS. 15 and 16, a rear bridge 240 is connected to a piston 320 by a pin 360. The bridge 240 permits a single piston 320 to be used to adjust the vertical position of the pinned end of two levers 200.

Figure 17:
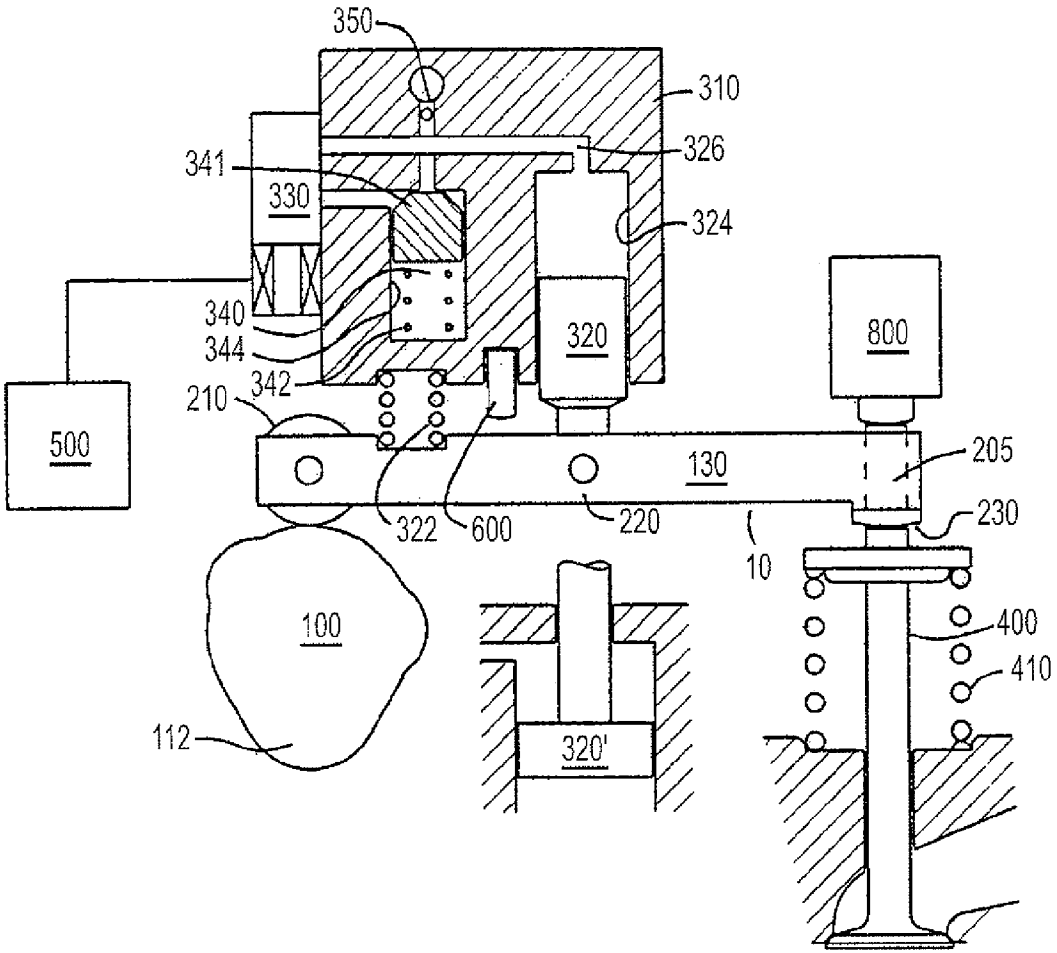
FIG. 17 is a cross-section of a fifth variable valve actuation system embodiment of the invention.
Figure 18:
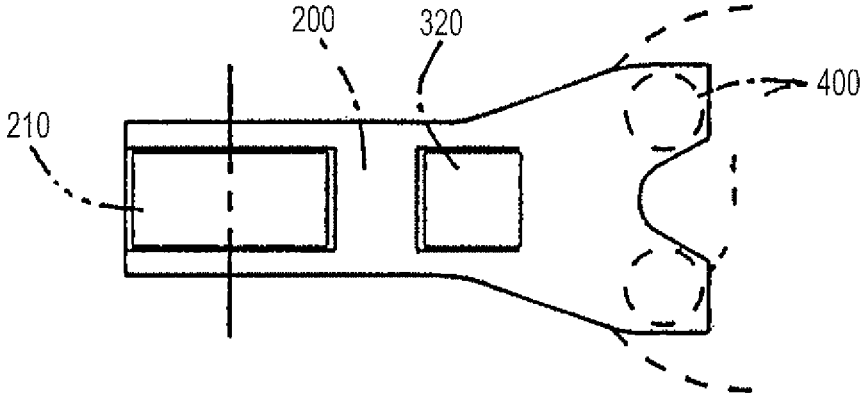

Still another alternative embodiment of the invention is shown in FIGS. 17 and 18, in which like reference numerals refer to like elements. With reference to FIGS. 17 and 18, the location of the cam roller 210 has been moved to the end of the lever 200, and the piston 320 is pinned to the lever at a point between the cam roller and the contact stem 205. Furthermore, the piston 320 resides in an overhead assembly.

The lower control piston 320' shown in FIG. 17 may be used instead of the control piston 320 in an alternative embodiment of the invention. The lower control piston 320' may be located on the same side of the lever as the cam 100 if the position of the lower control piston 320' is dictated by fluid flow to and from a chamber located above the control piston as opposed to below the control piston.

Figure 19:
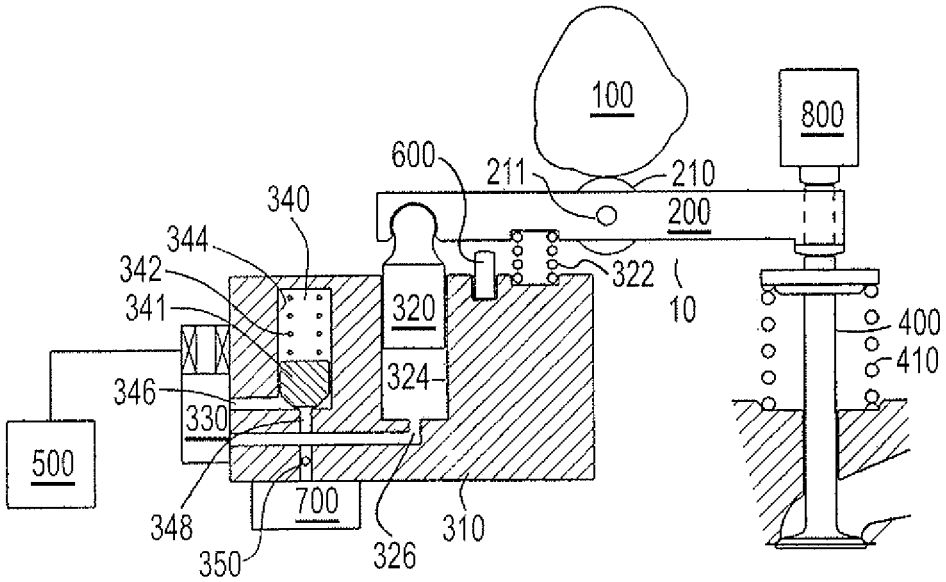
FIG. 19 is a cross-section of a sixth variable valve actuation system embodiment of the invention.

Still another alternative embodiment of the invention is shown in FIG. 19, in which like reference numerals refer to like elements. The piston 320 and the lever 200 may be connected using a ball and socket arrangement. Although the ball is shown as part of the piston 320 and the socket is shown as part of the lever 200, it is appreciated that the ball could be integrally formed with the lever and the socket could be formed in the piston.

The Initial Start Mechanism and Hydraulic Fluid Supply System

The VVA systems shown in FIGS. 6-19 each need to be charged with hydraulic fluid in order to operate properly. It is typically the case, however, that the hydraulic fluid contained in these systems will largely drain out once the engine is shut off. The recharging of the system with hydraulic fluid upon initial start of the engine may take some time, during which there will be no "hydraulically actuated" valve motion. Thus, there is a need for a system that accelerates the process of charging the VVA systems with hydraulic fluid, and/or for a system that provides some fixed level of valve actuation even when the VVA systems are devoid of hydraulic fluid. Applicants have developed several initial start mechanisms 600 and several modified hydraulic fluid supply systems 700 in an attempt to meet the foregoing needs.

Two general types of initial start mechanisms (ISMs) 600 are disclosed herein. The first type of ISMs provide a fixed stop near the pinned end 220 of the lever 200. In these systems, the fixed stop may be automatically removed once the overall VVA system is charged with hydraulic fluid. These types of ISMs are depicted in FIGS. 20-26. The second type of ISMs are those that lock the piston 320 into a fixed position until the overall VVA system is charged with hydraulic fluid. These ISMs are depicted in FIGS. 27-41 and 81-83.

Figure 20:
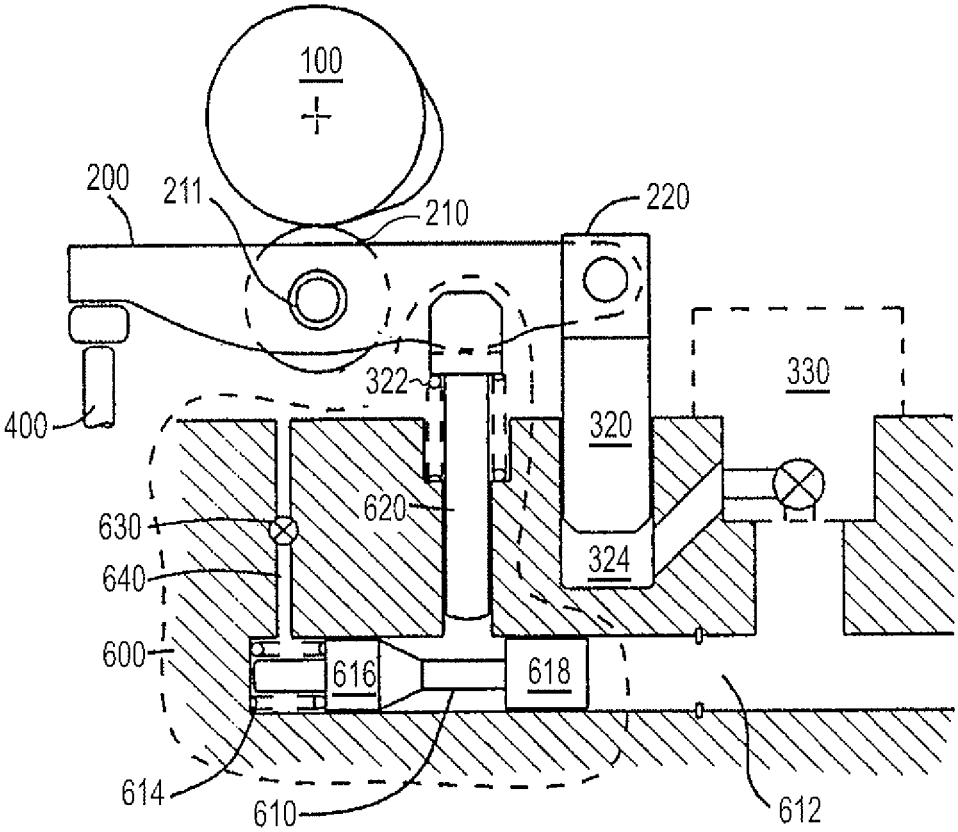
FIG. 20 is a cross-section of a first embodiment of the ISM portion of the present invention.

With reference to FIG. 20, an ISM 600 is installed below the pinned end 220 of the lever 200. The ISM 600 includes an ISM piston 610 slidably disposed in a bore 612 that receives oil from the low pressure supply 700 (i.e. the engine) used to charge the VVA system. The bore 612 is vented to atmosphere by passage 640. The ISM piston 610 is biased by a spring 614 such that the piston body 616 is directly below the locking shaft 620 when there VVA system is devoid of hydraulic fluid. When the ISM piston 610 is in this position it provides a bottom support for the locking shaft 620, thereby permitting the locking shaft to support the pinned end 220 of the lever 200 when the piston 320 is incapable of doing so.

The locking shaft 620 is biased upward into contact with the lever 200 by the piston spring 322. When the locking shaft 620 is supported by the piston body 616 it provides a fixed stop for the lever 200. The length of the locking shaft may be selected such that with the exception of the main intake and main exhaust events, the motion of all cam lobes is lost. Such actuation is typically preferred during engine starting. When the piston body 616 is not below the locking shaft 620, however, the locking shaft is free to be displaced downward against the bias of the piston spring 322 into the bore 612.

After initial starting of the engine, hydraulic fluid is supplied to the bore 612. This hydraulic fluid acts on the ISM piston plunger head 618 and forces the ISM piston 610 back into the bore 612 against the bias of the spring 614. Movement of the ISM piston 610 is possible due to the venting of hydraulic fluid past the piston through the passage 640. As the ISM piston 610 slides back, the bottom support for the locking shaft 620 is removed, thereby eliminating the locking shaft's ability to act as a fixed stop. The continued flow of hydraulic fluid into the VVA system passes through the trigger valve 330 and into the piston bore 324. At this point the trigger valve 330 may be closed, and support for the lever 200 may be provided by the piston 320.

With continued reference to FIG. 20, the ISM 600 may also be provided with an optional valve 630. The optional valve 630 may provide a limp-home mode of operation for the VVA system when there is some hydraulic pressure, but not sufficient pressure for the system to operate properly. When the valve 630 is closed, low pressure hydraulic fluid may leak past the plunger head 618 and the piston body 616 into the rear portion of the bore 612. This leakage may cause a buildup of hydraulic pressure behind the ISM piston 610 causing it to move forward in the bore 612 until it provides a support for the locking shaft 620.

Figure 21:
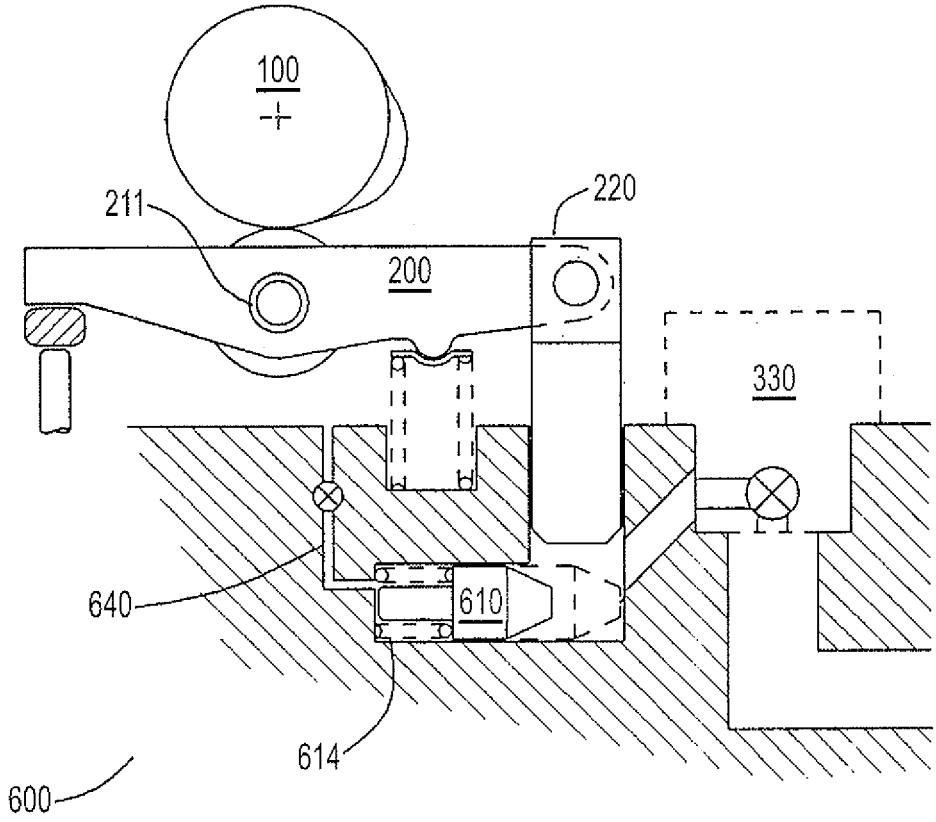
FIG. 21 is a cross-section of a second embodiment of the ISM portion of the present invention.

A similar system to that shown in FIG. 20 is shown in FIG. 21, in which like reference numerals refer to like elements. With reference to FIG. 21, the ISM piston 610 is slidably disposed in the bore 612 such that it provides a fixed support for the piston 320 when the VVA system is devoid of hydraulic fluid. Application of hydraulic fluid to the system through the trigger valve 330 and into the bore 612 not only charges the system with fluid, but also pushes the ISM piston 610 back into the bore 612 so that the piston 320 is free to slide to the bottom of the bore 324.

Figure 22:
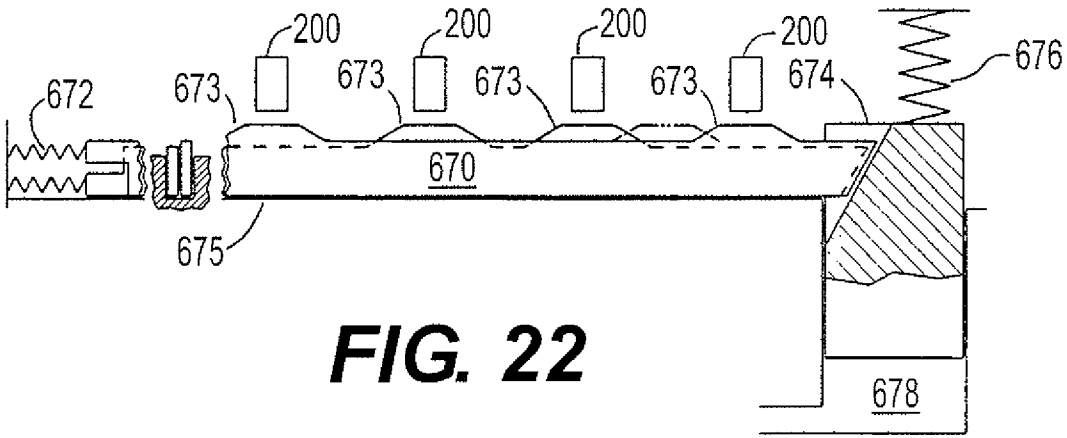
FIGS. 22 and 24 are cross-sections of a third embodiment of the ISM portion of the present invention.

With reference to FIG. 22, the ISM 600 is capable of providing a fixed stop for a plurality of levers 200. The ISM 600 includes sliding bars 670 that are biased by the bar springs 672 into a position that the raised portions 673 are directly underneath the levers 200. When in this position, the sliding bars 670 provide fixed stops for the levers 200 such that the main exhaust and main intake valve events are transmitted from the cams to the engine valves even when the VVA system is devoid of hydraulic fluid.

Application of hydraulic fluid to the VVA system results in the flow of fluid into the bore 678. The hydraulic fluid in the bore 678 pushes the inclined piston 674 upward against the bias of the spring 676 and into contact with the sliding bars 670. The inclined end faces of the sliding bars 670 and the inclined face of the piston 674 slide against one another, causing the sliding bars to be laterally displaced toward the bar springs 672. As the sliding bars 670 are displaced, the levers 200 ride down from the raised portions 673 on the bars until the levers are free to pivot on the pistons 320 (not shown).

With continued reference to FIG. 22, the sliding bars 670 may be aligned using a guide rail or grooves 675 running the length of the cylinder head. The guide rail or grooves 675 may mate with an inverse feature provided along the bottom surface of the sliding bars 670.

Figure 24:
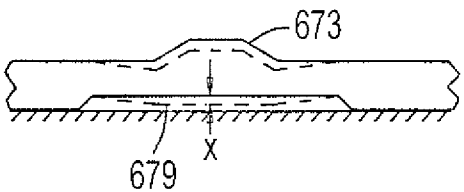

With reference to FIG. 24, the sliding bars may be provided with a small amount of clearance 679 beneath the raised portions 673. The clearance 679 may permit deflection x of the sliding bar as the lever 200 is pressed down on the bar during a valve event. It is anticipated that the desired deflection x of the bar 670 is on the order of a few hundredths of a millimeter. Such deflection may provide a cushioning effect as the lever 200 impacts the bar 670 during a valve event.

Figure 23:
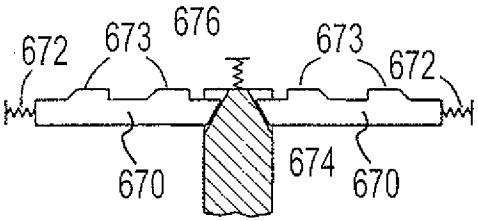
FIG. 23 is a cross-section of a fourth embodiment of the ISM portion of the present invention.

With reference to FIG. 23, an alternative embodiment of the ISM 600 is shown. The operation of the ISM 600 shown in FIG. 23 is the same as that shown in FIG. 22, with the exception of the use of two sliding bars 670 and a centrally located inclined piston 674.

With reference to the embodiments shown in both FIGS. 22 and 24, it is anticipated that the height of the fixed stop required for an intake valve arrangement and that for an exhaust valve arrangement will be different. The same sliding bar 670 may be used for both intake and exhaust valve arrangements, however, provided that the height of the surfaces on which the bars slide are different. An intake lever could be positioned over a slot having a lesser depth for receipt of a first sliding bar 670. An exhaust lever could be positioned over a slot having a greater depth for receipt of a second sliding bar 670. The same size sliding bar 670 may be used for both the intake and the exhaust levers because the individualized depth of the slots in which the bars ride controls the height of the fixed stop provided by the sliding bars. This feature eliminates the possibility that the wrong sliding bar will be used with the intake or exhaust valve arrangement.

Figure 25:
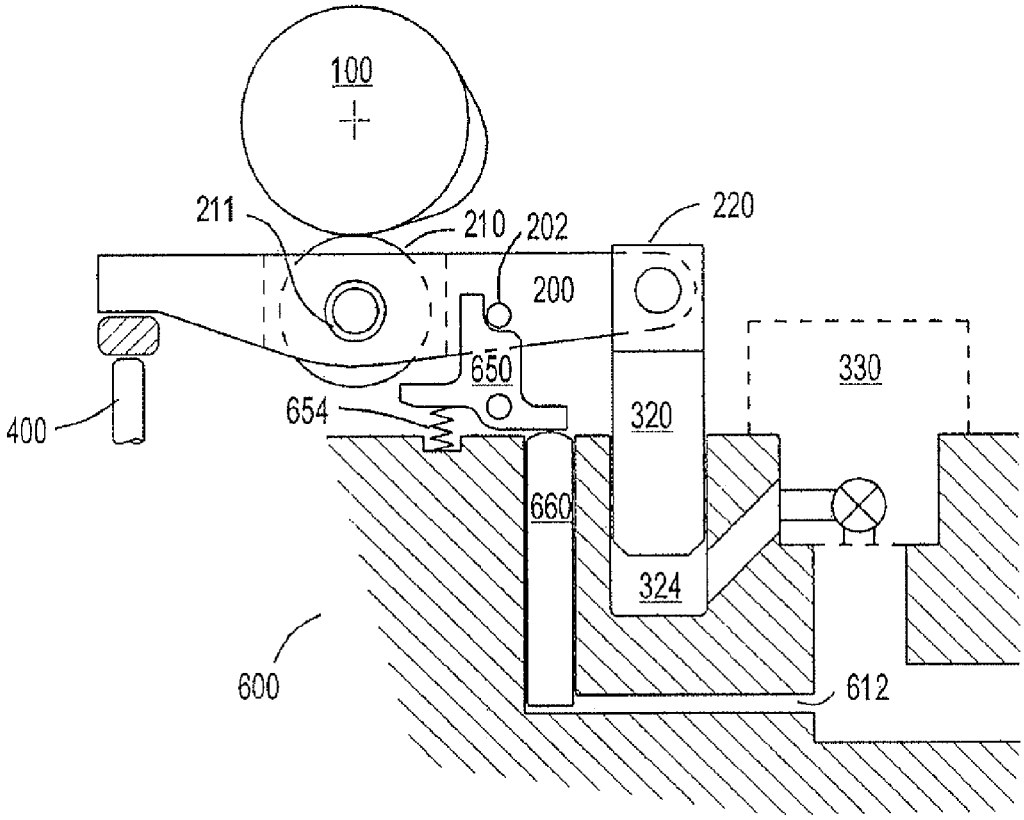
FIG. 25 is a cross-section of a fifth embodiment of the ISM portion of the present invention.

With reference to FIG. 25, in which like reference numerals refer to like elements shown in other figures, a fixed stop is provided for the lever 200 in the form of a hinged toggle 650. The toggle 650 is pivotally mounted and biased into an upright position by the toggle spring 654. An upright shaft 660 is biased upward into the toggle 650 by fluid pressure underneath the shaft. The toggle 650 and the upright shaft 660 may have mating inclined faces that are adapted to slide against each other.

In its upright position, the toggle 650 abuts a boss 202 extending from the lever 200. In this position the toggle 650 provides a support for the pinned end 220 of the lever 200. It is appreciated that a second boss could extend from the other side lever 200 and the toggle could be design to engage the bosses on both sides of the lever when the toggle is in an upright position.

The toggle 650 may be pivoted out of its upright position when the VVA system is charged with hydraulic fluid. Application of hydraulic fluid to the system results in the flow of fluid into the bore 612. The hydraulic fluid in the bore 612 may force the upright shaft 660 upwards so that the inclined faces of the toggle 650 and the shaft meet. As the shaft continues to move upward, it causes the toggle 650 to pivot counter-clockwise against the bias of the toggle spring 654. Eventually the toggle 650 is sufficiently pivoted that it no longer provides a support for the boss 202, at which point the vertical position of the pinned end 220 of the lever 200 is determined by the position of the piston 320.

Figure 27:
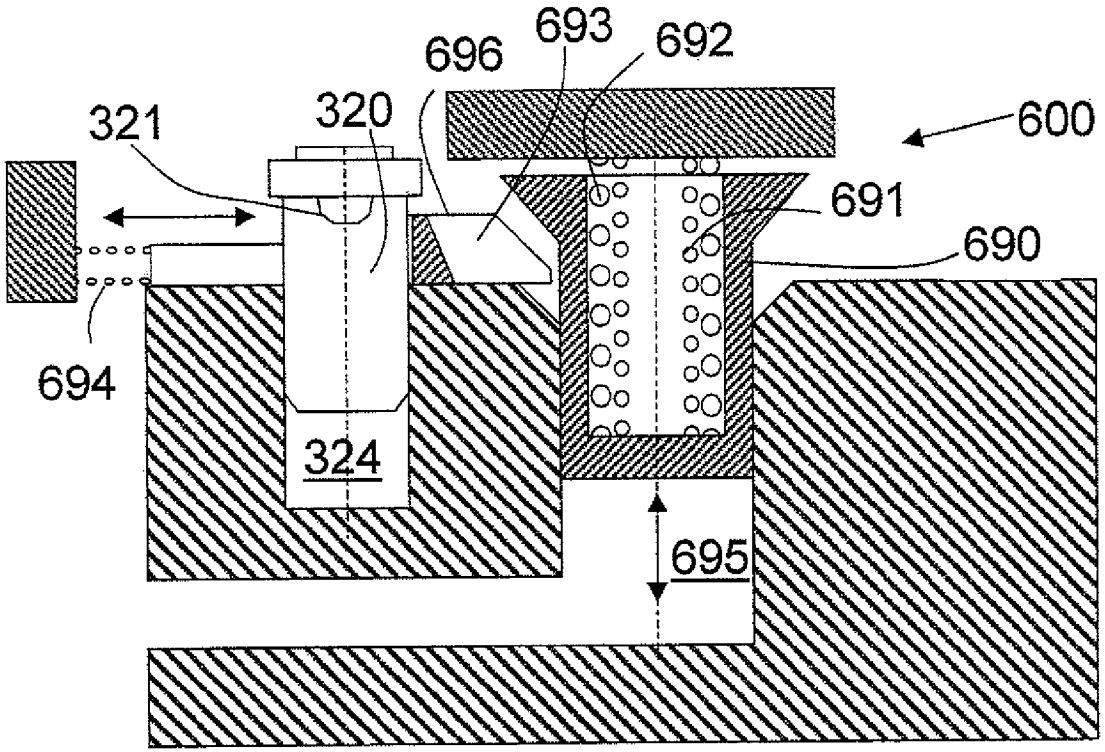
FIG. 27 is a cross-section of a seventh embodiment of the ISM portion of the present invention.
Figure 28:
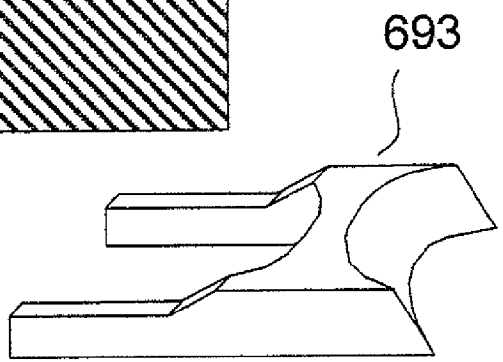
FIG. 28 is a pictorial view of a sliding member used in the seventh embodiment of the ISM portion of the present invention shown in FIG. 27.

With reference to FIGS. 27 and 28, another embodiment of an ISM 600 that is adapted to lock the piston 320 into a fixed position is disclosed. The ISM 600 includes an upright piston 690 (which may be the system accumulator elsewhere labeled as 340) disposed in an upright bore 695, piston bias springs 691 and 692, sliding member 693, and sliding member bias spring 694.

When the engine is off, hydraulic fluid may drain from the upright bore 695, permitting the bias springs 691 and 692 to push the upright piston 690 downward into its seat. Positioning of the upright piston 690 in its seat forces the sliding member 693 to move against the bias of the spring 694 such that the raised portion 696 of the sliding member is underneath a boss 321 provided on the piston 320 (or alternatively on the lever 200). While in this position, the sliding member 693 provides a fixed stop for the piston 320 to ride against. The height of the fixed stop provided by the sliding member 693 may be preselected to provide some level of valve actuation when the VVA system is devoid of hydraulic fluid.

As the engine is started, hydraulic fluid flows into the upright bore 695, which in turn forces the upright piston 690 to move upward against the bias springs 691 and 692. As the upright piston 690 moves upward, the sliding member 693 is permitted to slide towards the upright piston under the influence of the bias spring 694. The ISM 600 is designed such that once the upright piston attains its uppermost position, the raised portion 696 of the sliding member 693 will no longer be underneath the boss 321. This permits the piston 320 to be raised and lowered freely for VVA actuation upon the charging of the system with hydraulic fluid.

Figure 29:
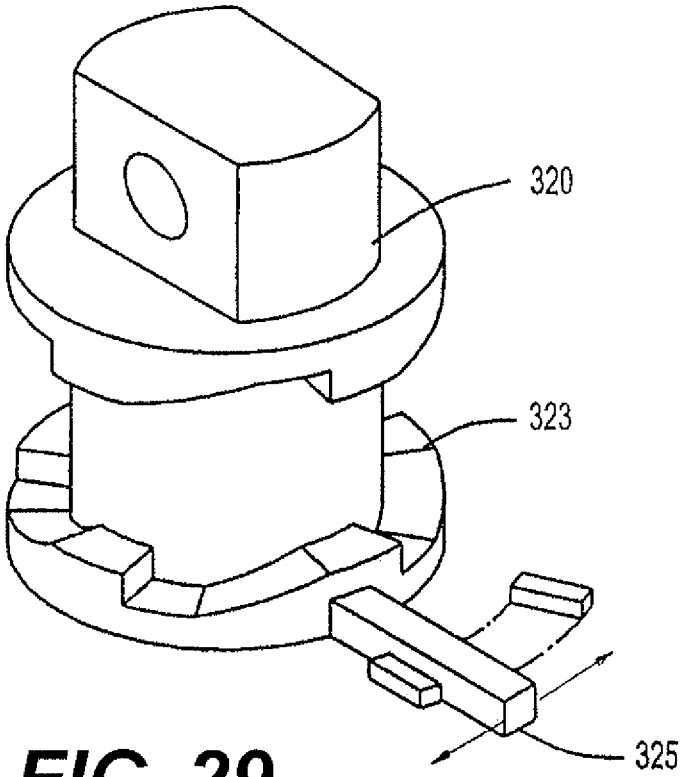
FIG. 29 is a pictorial view of an eighth embodiment of the ISM portion of the present invention.

Another embodiment of the ISM portion of the present invention is shown in FIG. 29. With reference to FIG. 29, a control piston 320 is shown with a castellated collar disposed around it. Mating castellations may be provided on the piston 320 and the collar 323. When the collar 323 is positioned such the castellations thereon mate with those of the piston 320, the piston is provided with a full range of vertical movement. Alternatively, if rotated by a rotation means 325, the collar 323 may provide a fixed stop for the piston 320 (to be used during initial starting or limp-home operation).

Figure 30:
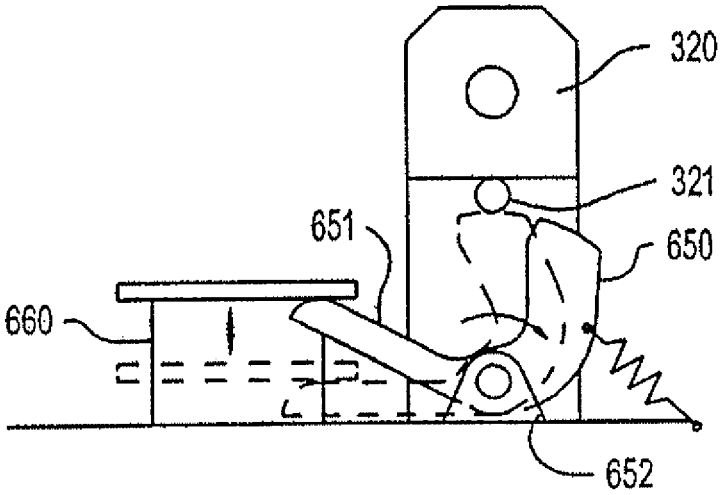
FIG. 30 is an elevational view of a ninth embodiment of the ISM portion of the present invention.

The embodiment of the ISM portion of the present invention that is shown in FIG. 30 is similar to that shown in FIG. 25. With reference to FIG. 30, a fixed stop is provided for the control piston 320 in the form of a hinged toggle 650 that may support a piston boss 321. The toggle 650 is pivotally mounted on a toggle base 652 and weighted (or spring biased) to rotate clockwise when the end 651 is not held down by the upright shaft 660.

When the VVA system is devoid of hydraulic fluid, the upright shaft 660 (which may be provided by an upper extension of the accumulator 340) is in the position shown by the phantom lines in FIG. 30. As the system is provided with hydraulic fluid, the upright shaft 660 is pushed upwards, permitting the toggle 650 to rotate clockwise and freeing the piston 320 to operate with its full range of motion.

Figure 31:
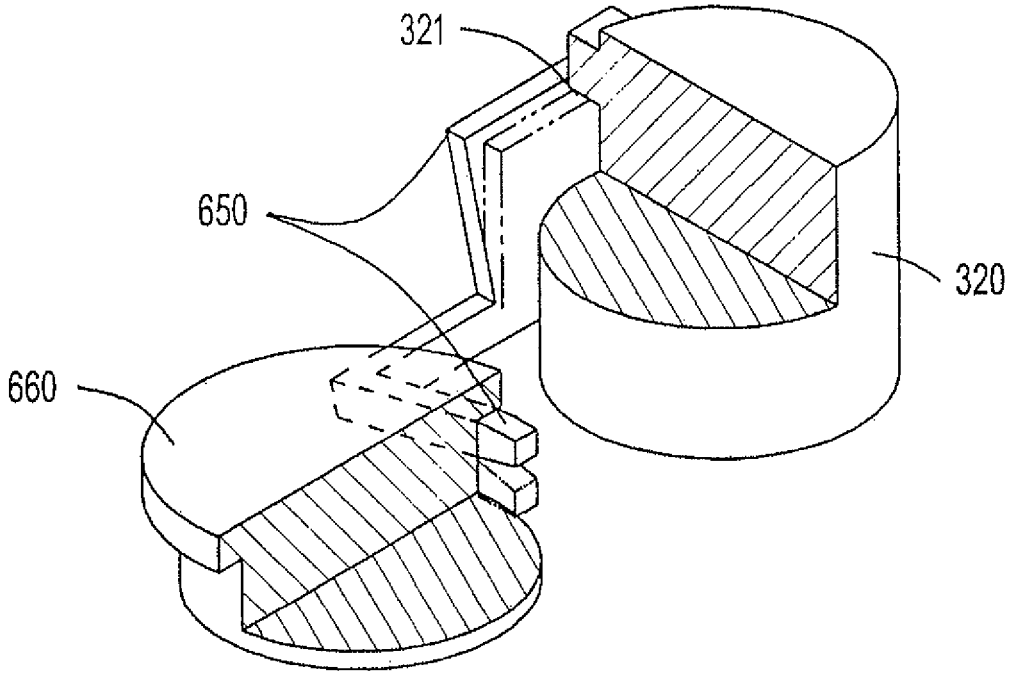
FIG. 31 is a cut-away pictorial view of a tenth embodiment of the ISM portion of the present invention.

Yet another embodiment of the ISM portion of the present invention is shown in FIG. 31. With reference to FIG. 31, a fixed stop is provided for the control piston 320 in the form of a toggle 650 that may support a piston boss 321. The toggle 650 is designed, weighted and/or spring biased to move out of position from underneath the piston boss 321 when the end 651 is not held down by the upright shaft 660. In an alternative embodiment, the boss 321 may be provided on the rocker lever 200 instead of the piston 320.

When the VVA system is devoid of hydraulic fluid, the end 651 is held down in the position shown by the upright shaft 660 (which may be provided by an upper extension of the accumulator 340). As the system is provided with hydraulic fluid, the upright shaft 660 is pushed upwards, permitting the end 651 to rise and rotate the toggle 650 out of position from underneath the piston boss 321 so that the piston 320 can operate with its full range of motion.

Figure 26:
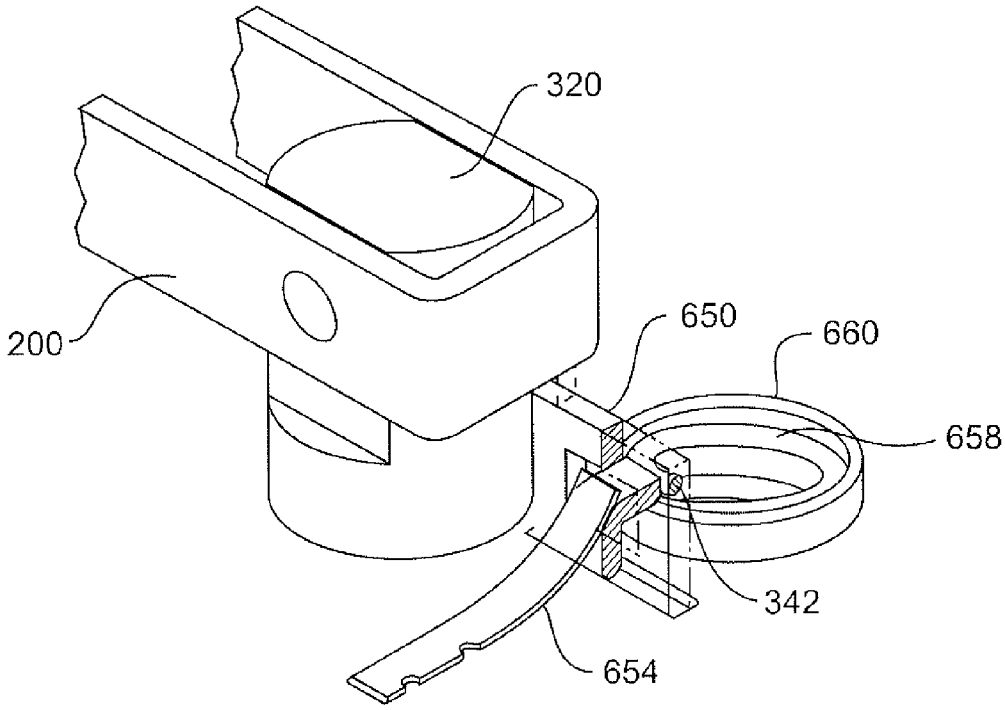
FIG. 26 is a pictorial view of a sixth embodiment of the ISM portion of the present invention.

FIG. 26 shows an embodiment of the ISM portion of the present invention similar to that shown in FIG. 31. With reference to FIG. 26, the toggle 650 is biased into the "on" position (shown) by the flat spring 654. In the on position, the toggle 650 limits the motion of the control piston 320 when the end of the lever 200 contacts the toggle. In an alternative embodiment, this could also be accomplished by a projection on the control piston 320 contacting the toggle 650. When the system 10 hydraulic pressure increases, the piston 660 (which may be provided by the accumulator piston 341) moves upward, overcoming the bias of the flat spring 654 and tipping the toggle 650 out of engagement with the lever 200. When the system pressure drops, the piston return spring 658 forces the piston 660 back down into its bore, allowing the flat spring 654 to move the toggle 650 back into the engaged position.

Should the engine stop with the lever 200 in a depressed position, the flat spring 654 will press the toggle 650 into the side of the lever. As soon as the lever 200 moves as the result of cranking the engine, the toggle 650 will snap into the engaged position. Should the lever 200 move back down before the toggle 650 reaches its most upright position, the toggle will be pushed back down without damage, and will be able to reset the next time the lever rises.

Figure 32:
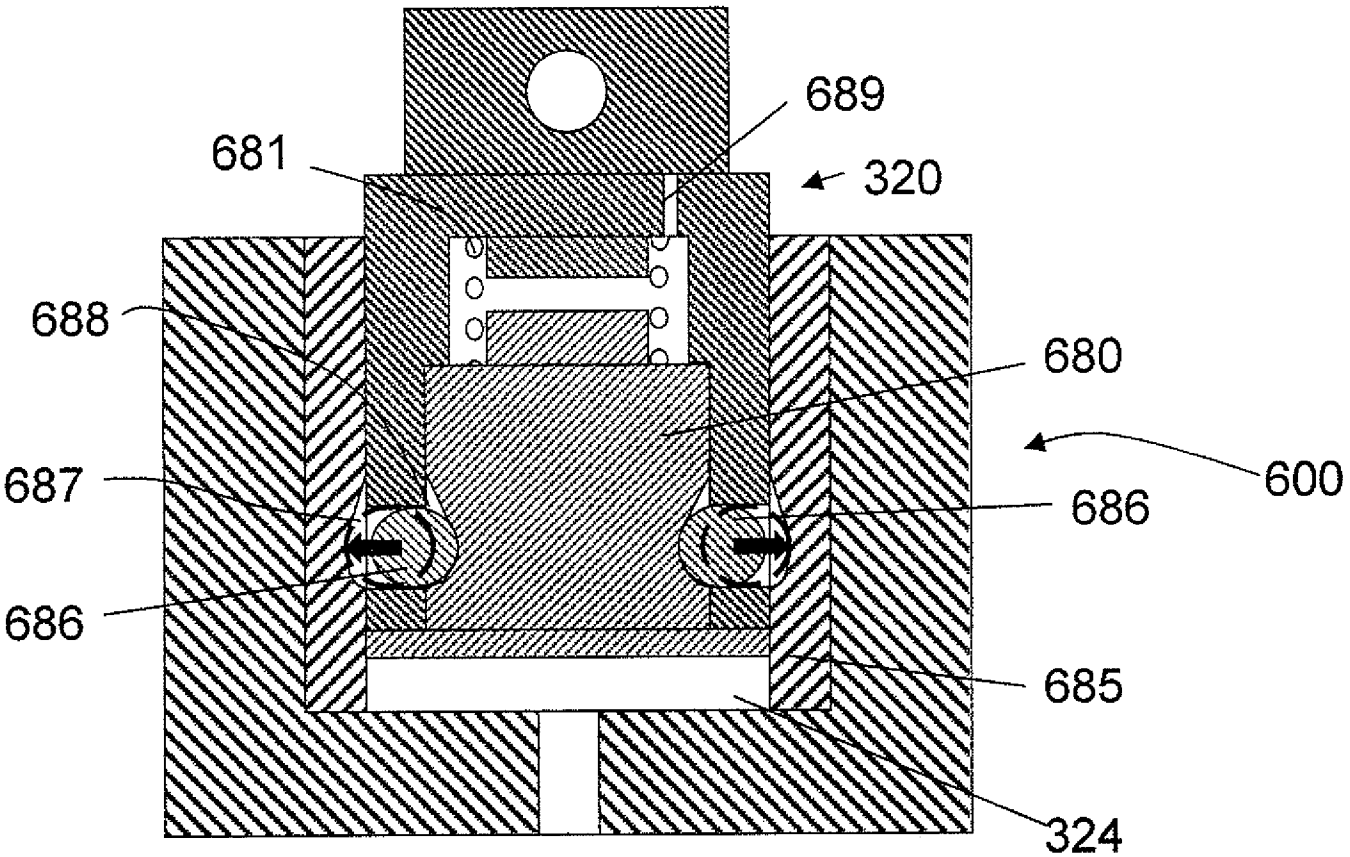
FIG. 32 is a cross-section of an eleventh embodiment of the ISM portion of the present invention.

With reference to FIG. 32, a second general type of ISM 600 is shown. The ISM 600 shown in FIG. 32 operates by locking the control piston 320 into a fixed position until such time as the overall VVA system is charged with hydraulic fluid. The ISM 600 includes an inner locking piston 680 slidably disposed inside of a control piston 320 and biased downward by a spring 681. The control piston 320 is slidably disposed in a control piston bore 324 defined by a sleeve 685. Locking balls 686 are moveable in a space defined by a through-hole in the wall of the control piston 320, a sleeve recess 687, and a locking piston recess 688.

When the piston bore 324 is devoid of hydraulic fluid (as it is during start up) the spring 681 extends and forces the inner locking piston 680 to slide downward relative to the control piston 320. The downward movement of the locking piston 680 forces the locking balls 686 outward into the space defined by the sleeve recess 687 and the through-hole in the wall of the control piston 320. This positioning of the locking balls 686 mechanically locks the control piston 320 in a fixed position relative to the sleeve 685. Thus, when there is no hydraulic fluid in the piston bore 324, the piston 320 may be automatically locked into a fixed position.

As hydraulic fluid flows into the piston bore 324, the inner locking piston 680 is forced upwards into the control piston 320. A bleed passage 689 may be provided in the control piston 320 to avoid hydraulic lock of the inner locking piston 680 in the control piston. As the inner locking piston 680 moves upward, it comes to rest against a shoulder provided in the control piston 320. Any further upward movement of the locking piston 680 causes the control piston 320 to move upward as well. As the control piston 320 moves upward, the curved wall of the control piston recess 687 urges the locking balls 686 into the space defined by the control piston through-hole and the locking piston recess 688. In this manner, the control piston 320 is unlocked from the sleeve 685 and the piston 320 is free to slide vertically in the piston bore 324, and it should be noted that the unlocking action of the recess 687 can achieve the same function of unlocking when the control piston 320 and the inner piston 680 move as one unit in the downward direction.

Figure 33:
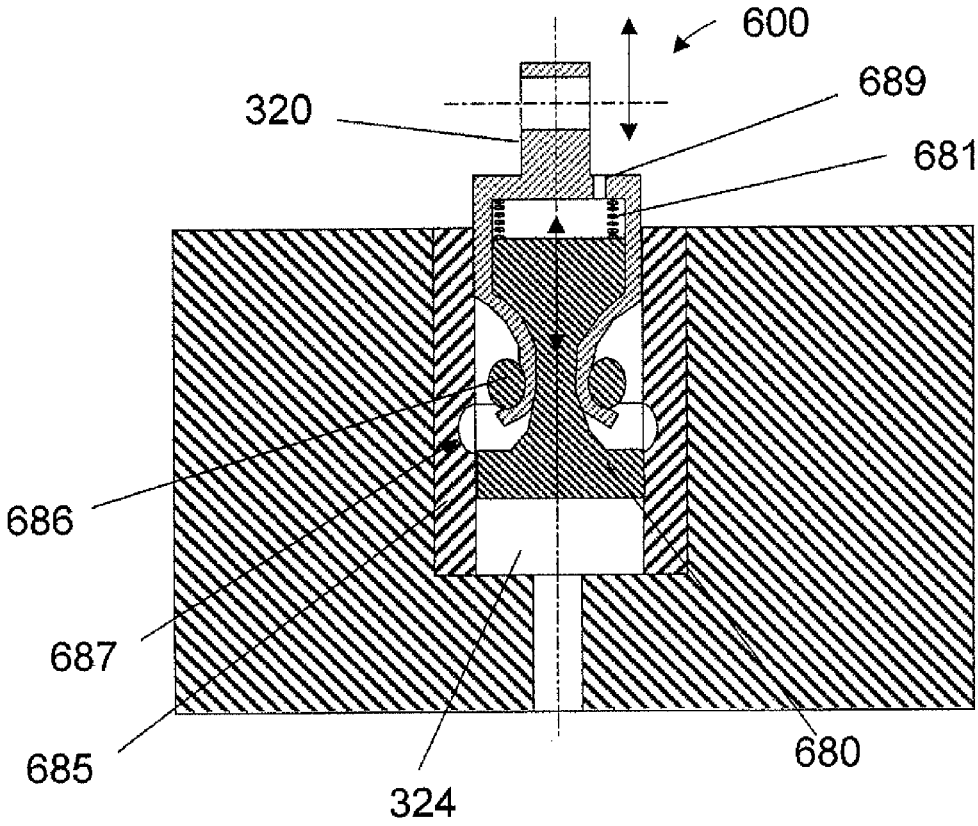
FIG. 33 is a cross-section of a twelfth embodiment of the ISM portion of the present invention.
Figure 35:
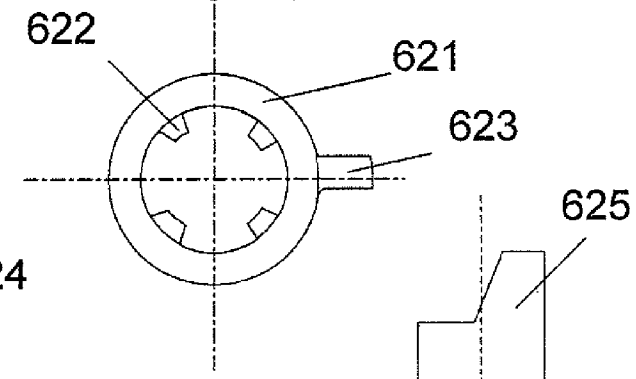
FIGS. 34-37 are top plan and side views of a thirteenth embodiment of the ISM portion of the present invention.
Figure 36:
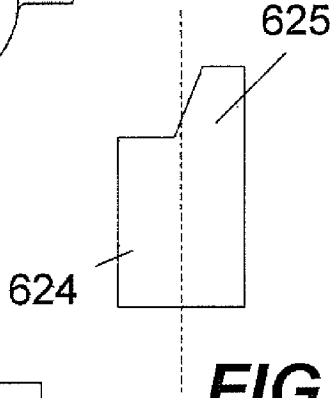
Figure 37:
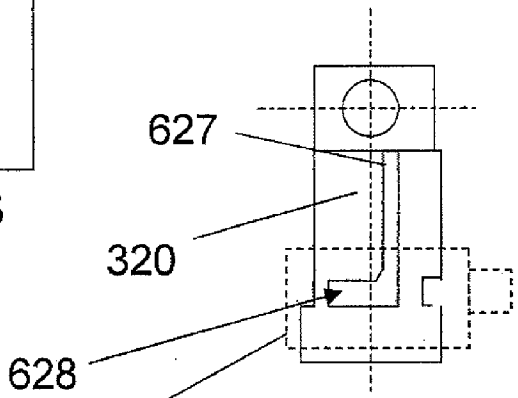
Figure 34:
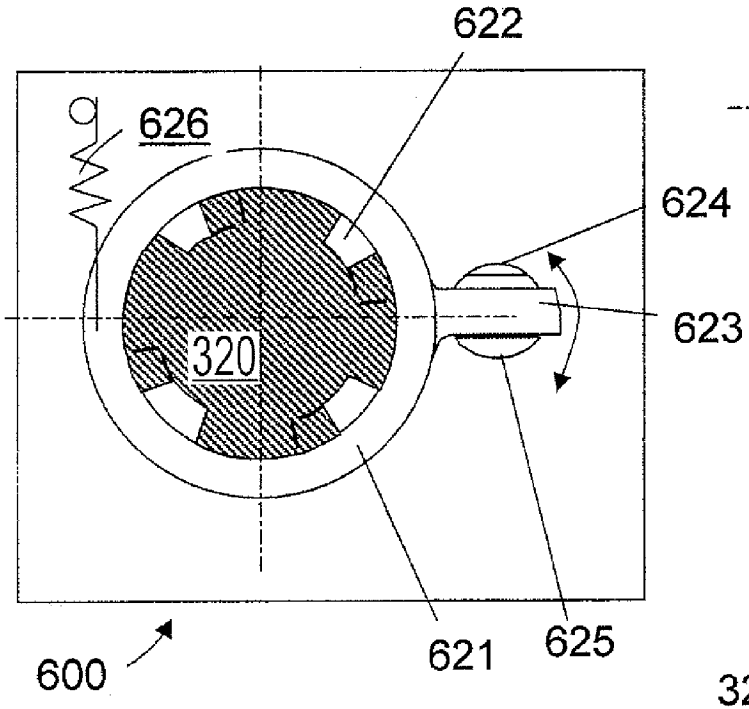

With reference to FIG. 33, an alternative embodiment of the locking mechanism for the control piston 320 is shown.

Like that shown in FIG. 32, the ISM 600 shown in FIG. 33 operates by locking the control piston 320 into a fixed position until such time as the overall VVA system is charged with hydraulic fluid. The ISM 600 includes an inner piston 680 slidably disposed inside of a control piston 320 and biased downward by a spring 681. The control piston 320 is slidably disposed in a piston bore 324 defined by a sleeve 685. A locking ring or balls 686 are laterally moveable in the bore 324. The control piston 320 may include lower walls that are predisposed to deflect inward, but which may be deflected outward by a downward movement of the inner piston 680.

When the piston bore 324 is devoid of hydraulic fluid (as it is during start up) the spring 681 extends and forces the inner piston 680 to slide downward relative to the control piston 320. The downward movement of the inner piston 680 forces the locking ring or balls 686 outward into the sleeve recess 687. This positioning of the locking ring 686 mechanically locks the control piston 320) in a fixed position relative to the sleeve 685. Thus, when there is no hydraulic fluid in the piston bore 324, the piston 320 may be automatically locked into a fixed position.

As hydraulic fluid flows into the piston bore 324, the inner locking piston 680 is forced upwards into the control piston 320. A bleed passage 689 may be provided in the control piston 320 to avoid hydraulic lock of the inner locking piston 680 in the control piston. As the inner locking piston 680 moves upward, the lower walls of the control piston 320 are once again free to deflect inward. The inward deflection of the control piston walls permits the locking ring 686 to contract and unlock the control piston 320 from the sleeve 685.

Another ISM embodiment of the invention that may be used to lock the control piston 320 into place during initial starting is shown in FIGS. 34-37. With reference to FIGS. 34-37, the control piston 320 may be provided with one or more side wall recesses 627. The recesses 627 may be defined by each set of neighboring protrusions 628. A splined locking ring 621 may surround the control piston 320. The ring 621 may include a number of splines 622 that are adapted to slide through the recesses 627 provided on the control piston 320. The ring 621 may also include an arm 623 extending out from the ring and into selective contact with a deactivation piston 624. The ring 621 may be biased to rotate either clockwise or counter-clockwise under the influence of a spring 626.

When there is little or no hydraulic fluid in the system, the deactivation piston 624 is recessed into the system housing, leaving the arm 623 and the connected locking ring 621 free to rotate under the influence of the spring 626. During this time, the locking ring 621 is rotated into a position such that the splines 622 on the ring do not mate with the recesses 627 on the control piston 320. Accordingly, the control piston 320 is locked into an extended position when there is little or no hydraulic fluid in the system.

As the system charges with hydraulic fluid, the deactivation piston 624 is pushed upward and into contact with the arm 623. The upper ramped portion 625 of the deactivation piston engages the arm 623 and rotates the ring 621 back into the position shown in FIG. 34. When the ring 621 is in this position, the splines 622 thereon mate with the recesses 627 on the control piston 320 and the control piston is free to slide up and down to effect variable valve actuation.

Figure 39:
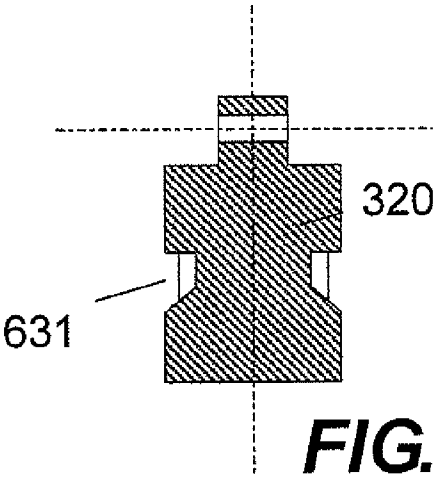
FIGS. 38-40 are a top plan and cross-section views of a fourteenth embodiment of the ISM portion of the present invention.
Figure 40:
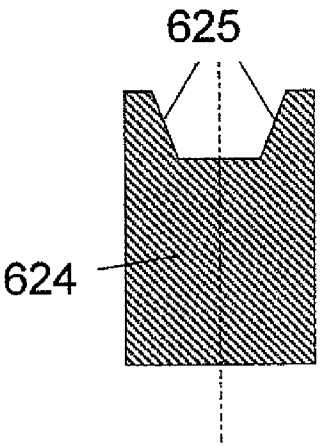
Figure 38:
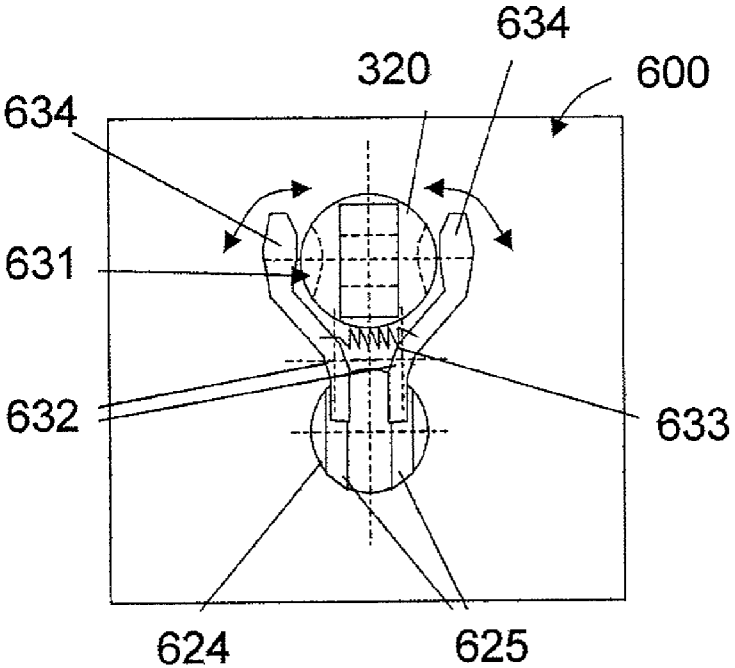

FIGS. 38-40 show yet another ISM 600 that may be used to lock the control piston 320 into an extended position during initial starting. The ISM 600 includes a control piston 320 with side indents 631. A deactivation piston 624 is located next to the control piston 320. The deactivation piston 624 may include a dual ramped upper portion 625. Twin pincer arms 632 may extend from the deactivation piston 624 to the control piston 320. A spring 633 may bias the locking ends 634 of the pincer arms 631 to close inward and engage the indents 631 on the control piston.

With continued reference to FIGS. 38-40, when there is little or no hydraulic fluid in the system, the deactivation piston 624 is recessed into the system housing, allowing the pincer arms 632 to engage the control piston 320 and lock it into an extended position. As the system charges with hydraulic fluid during start up, the deactivation piston 624 is pushed upward and into contact with the ends of the pincer arms 632. The upper ramped portion 625 of the deactivation piston engages the ends of the pincer arms 632 and forces them inward against the bias of the spring 633. As a result, the locking ends 634 of the pincer arms 632 move outward and disengage the control piston 320 leaving the control piston free to slide up and down to effect variable valve actuation.

Figure 41:
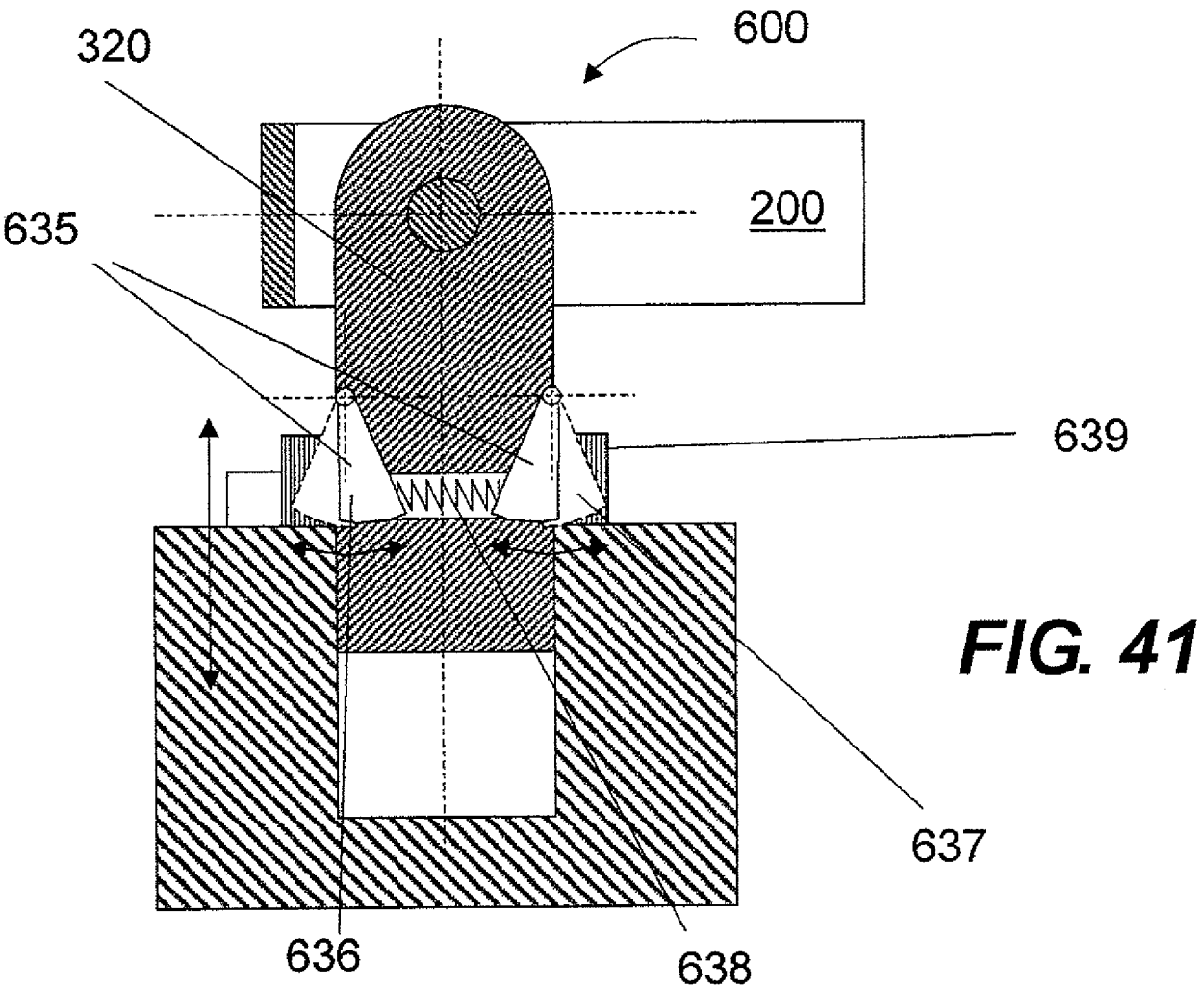
FIG. 41 is a cross-section of a fifteenth embodiment of the ISM portion of the present invention.

With reference to FIG. 41, another ISM 600 is shown. This ISM includes a control piston 320 with two radially mounted flaps 635 that can move from a retracted position 636 out to an extended position 637. When the flaps 635 are in the retracted position 636, the control piston 320 is free to slide vertically for variable valve actuation. When the flaps 635 are in the extended position 637, the control piston 320 is locked into an extended position for initial start-up actuation. The position of the flaps 635 may be controlled with a rotating ring 639. The ring 639 is shown in section behind the flaps 635. The ring 639 may be provided with a non-uniform inner surface that allows the flaps 635 to be extended when the ring is in a first position and retracted when the ring is in a second position. Rotation of the ring 639 between the first and second positions may be controlled using the principles and apparatus described in connection with FIGS. 34-37 for the rotation of the locking ring shown therein.

Figure 81:
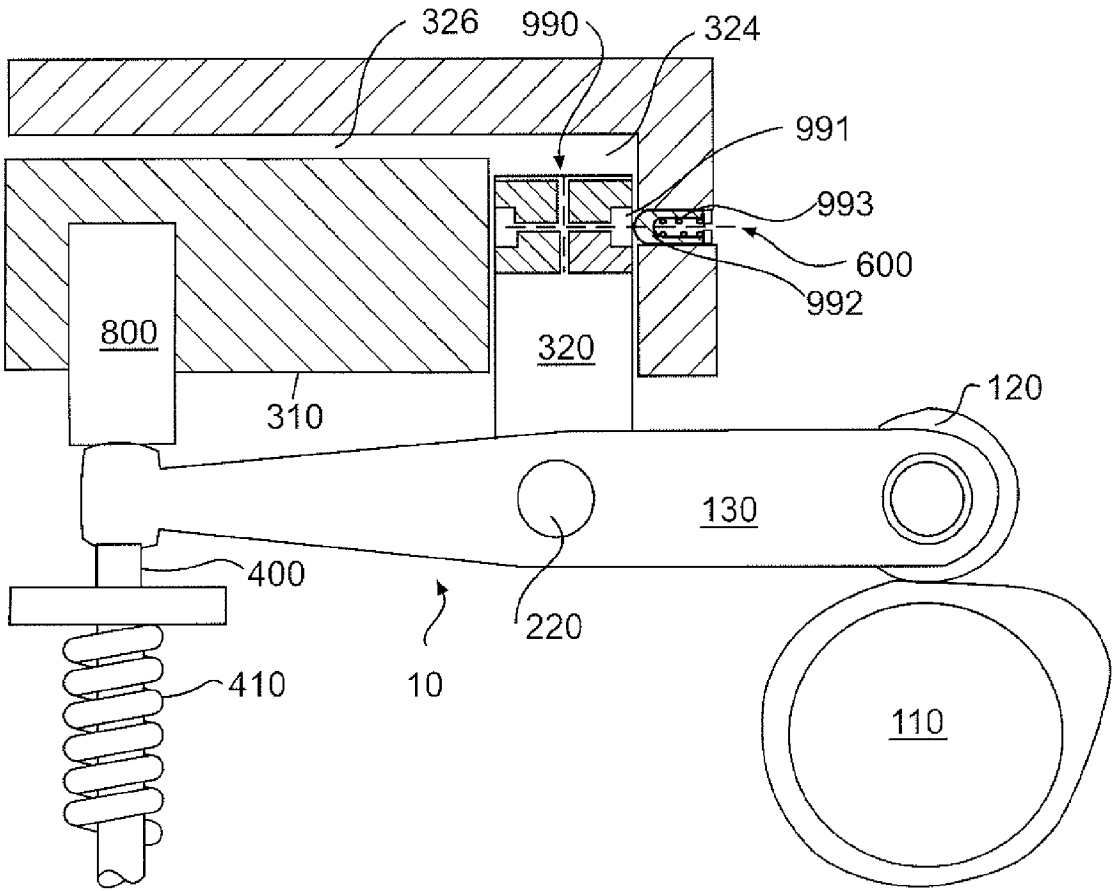
FIGS. 81-83 are partial cross-sections of valve actuation systems including alternative hydraulic piston locking devices, preferably for ISM.

With reference to FIG. 81, in which like reference characters refer to like elements in the other drawings, another embodiment of an ISM 600 that is adapted to lock the piston 320 into a fixed position is disclosed. The piston 320 is provided with one or more internal passages 990 which provide hydraulic communication between the piston bore 324 and an annular indentation 991 provided in the side wall of the piston 320. A lock piston 992 may be slidably disposed in a lock piston bore provided in the housing 310. The lock piston bore may intersect the piston bore 324 at a right angle. The lock piston 992 may be biased towards the piston 320 by a lock piston spring 993. The lock piston 992 may have an outer end adapted to slide into and engage the annular indentation 991.

During engine operation, hydraulic fluid pressure in the piston bore 324 is sufficient to overcome the bias of the lock piston spring 993 and keep the lock piston 992 from engaging the annular indentation 991. As a result, the piston 320 may move freely in the piston bore 324 under the control of a trigger valve (not shown). At the conclusion of engine operation, hydraulic fluid pressure in the piston bore 324 may decrease as fluid "leaks down". The decreased hydraulic fluid pressure in the piston bore 324 may cause the piston 320 to retract in the piston bore. At the same time, the decreasing pressure in the piston bore 324 may cause the lock piston spring 993 to push the lock piston 992 towards the piston 320 and into the annular indentation 991. By engaging the annular indentation 991, the lock piston 992 locks the piston 320 into a fixed position. The fixed position of the piston 320 may be selected to provide a predetermined level of engine valve actuation. At engine start up, the fixed position of the piston 320 may enable engine valve actuation when there is otherwise insufficient hydraulic pressure in the piston bore 324 for engine valve actuation. After engine start up, increased hydraulic pressure in the piston bore 324 may push the lock piston 992 back out of the annular indentation 991, thereby unlocking the piston 320, and enabling the piston 320 to move freely again to provide variable valve actuation. The ISM system 600 shown in FIG. 81, as well as in other figures, may also provide a fixed level of engine valve actuation when hydraulic fluid pressure is lost for any reason, regardless of whether or not the engine is in start up mode.

Figure 82:
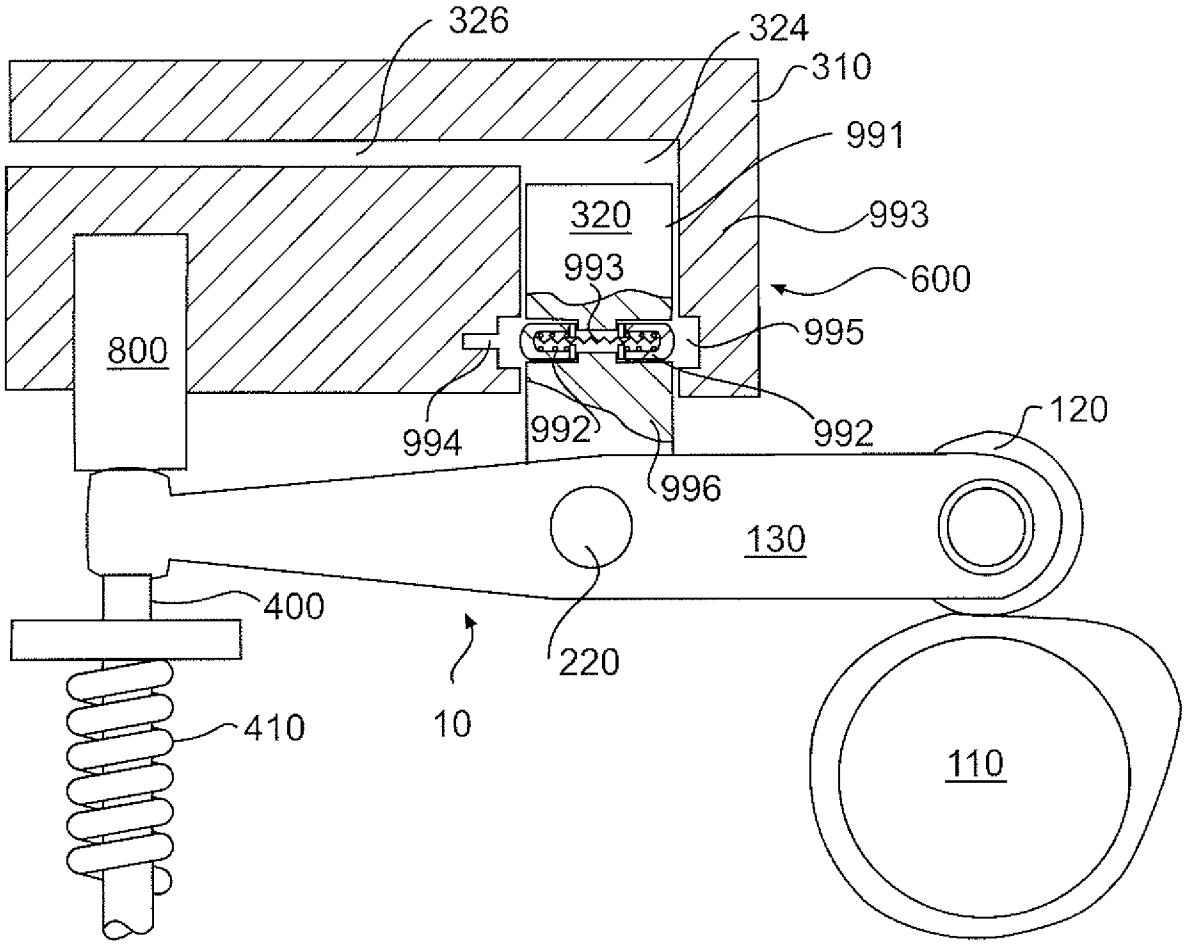

FIG. 82 illustrates an alternative embodiment of the ISM system 600. The system shown in FIG. 82 is the same as that shown in FIG. 81 with the following exceptions. In FIG. 82, the piston 320 is provided with a diametrical passage in which one or more lock pistons 992 are slidably disposed. The one or more lock pistons 992 may be biased away from the center of the piston 320 by a lock piston spring 993. An annular indentation 995 may be provided in the side wall of the piston bore 324. The annular indentation 995 may communicate with a hydraulic fluid supply (not shown) through a lock piston supply passage 994. The hydraulic fluid supply may be common for the piston bore 324 and the lock piston supply passage 994. A lock piston drain passage 996 may extend from the diametrical passage housing the lock pistons 992 to a lower portion of the piston 320 outer wall. When hydraulic fluid pressure is low in the piston bore 324, it may also be low in the lock piston supply passage 994. During low hydraulic fluid pressure conditions, such as during engine start up, the lock piston spring 993 pushes the lock pistons 992 into the annular indentation 995, thereby locking the piston 320 into a fixed position. When hydraulic fluid pressure is higher, the lock pistons 992 may be pushed back into the diametrical passage, thereby allowing the piston 320 to move freely for variable valve actuation. Hydraulic fluid which leaks into the space between the lock pistons 992 may drain through the lock piston drain passage 996.

Figure 83:
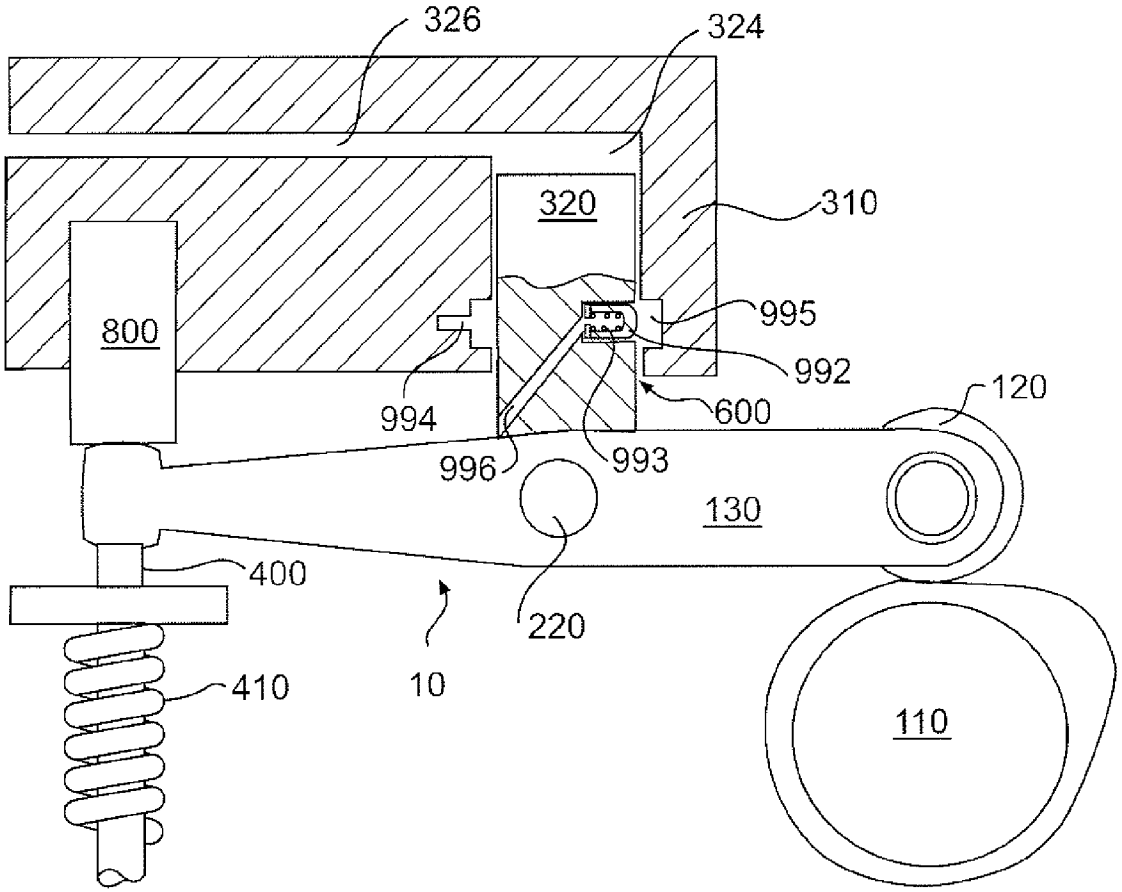

FIG. 83 illustrates a slight modification of the ISM 600 shown in FIG. 82. The ISM 600 in FIG. 83 utilizes a single lock piston 992 as opposed to the multiple lock pistons shown in FIG. 82. In all other respects, the system shown in FIG. 83 is the same as, and operates similarly to, the system shown in FIG. 82.

Figure 42:
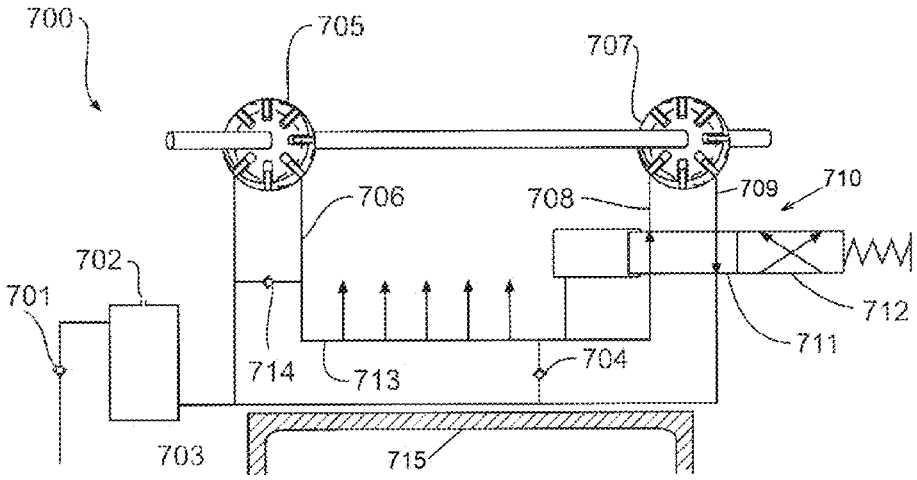
FIG. 42 is a schematic diagram of an hydraulic fluid supply system embodiment for use in the present invention.

A first embodiment of an hydraulic fluid charging system 700 portion of the present invention is shown in FIG. 42. The system 700 includes a inlet check valve 701 that may receive hydraulic fluid (oil) from the main engine supply. Oil passing through the inlet check valve 701 passes through an air vent unit 702 to an hydraulic circuit 703. The hydraulic circuit 703 may pass close to an engine water cooling jacket 715 to remove heat from the oil in the hydraulic circuit 703. The hydraulic circuit connects to the VVA gallery 713 through the check valve 704 and the inlet pump 705. The hydraulic circuit 703 may also connect to a bore housing a solenoid or pressure driven valve 710. A relief valve 714 permits oil to flow from the VVA gallery 713 to the hydraulic circuit 703 as needed.

The inlet pump 705 may be mechanically driven and connected to the VVA gallery 713 by a pump outlet 706. The VVA gallery 713 may be connected to plural passages 348 associated with each VVA system. The last two outlets of the VVA gallery 713 may lead to a bore housing the valve 710. The valve 710 may include a first internal passage arrangement 711 and a second internal passage arrangement 712. The bore housing the solenoid driven valve 710 may also include two openings connecting the spool valve 710 to a mechanically driven outlet pump 707. The outlet pump 707 may include an inlet port 708 and an outlet port 709.

The system 700 may be operated as follows to provide a high oil pumping rate to the VVA gallery 713 during engine start-up and a relatively low oil pumping rate during steady-state engine operation. As an initial matter, the inlet pump 705 may be provided with a pump rate of ten (10) units per revolution and the outlet pump 707 may be provided with a pump rate of nine (9) units per revolution. The volume of a "unit" and the pump differential of the inlet and outlet pumps may be adjusted as needed to meet the needs of a particular VVA system. It is only important for this portion of the invention that the pump rate of the inlet pump 705 be greater than the pump rate of the outlet pump 707.

During engine start-up the valve 710 is positioned in its bore such that the second spool valve passage arrangement 712 connects the hydraulic circuit 703 to the inlet 708 of the outlet pump 707 and the outlet 709 of the outlet pump to the VVA gallery 713. When the valve 710 is so positioned, the VVA gallery 713 receives nineteen (19) units of oil per revolution from the hydraulic circuit 703. Ten (10) units of oil are provided by the inlet pump 705 and nine (9) units of oil are provided by the outlet pump 707.

After engine start-up, the valve 710 may be activated (or de-activated depending upon the normal position of the valve) so that the first valve passage arrangement 711 connects the VVA gallery 713 to the inlet of the outlet pump 707 and connects the outlet 709 of the outlet pump to the hydraulic circuit 703. When in this position, the VVA gallery is provided with only one unit of oil per revolution of the pumps 705 and 707.

The system 700 selectively provides a high pumping rate to quickly pressurize the VVA gallery on start-up and a low pumping rate to maintain VVA gallery pressure during steady-state engine operation without excessive parasitic loss (as a result of a high flow rate through the relief valve 714). The system 700 also provides a high circulation rate of oil through the heat exchanging portion of the system to control system temperature, and de-aeration of make-up oil to improve bulk modulus of the oil in the system.

Figure 43:
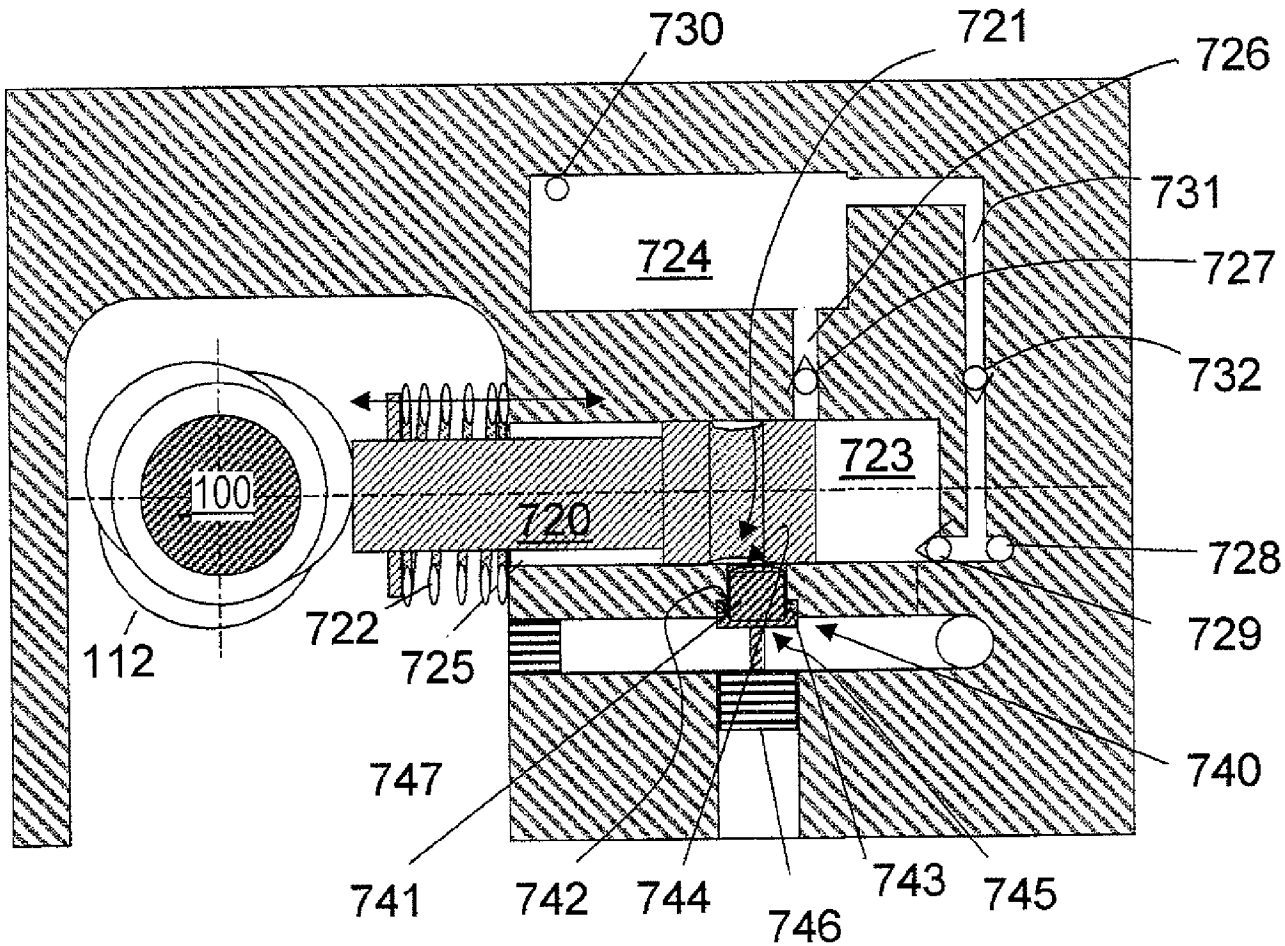
FIG. 43 is a cross-section of a second hydraulic fluid supply system embodiment for use in the present invention.

A second embodiment of a hydraulic fluid charging system 700 is shown in FIG. 43. With reference to FIG. 43, the system 700 includes a cam 100 with one or more lobes 112. The cam 100 contacts a piston 720 which is biased into contact with the cam 100 by a spring 722. The piston 720 is disposed in a bore 725. The space between the end of the bore 725 and the end of the piston 720 defines a pumping chamber 723. The pumping chamber 723 communicates with a hydraulic reservoir 724 via a passage 726 that may be provided with a check valve 727. The pumping chamber 723 may also communicate with a VVA gallery (not shown) through a passage 728 that may be provided with a check valve 729. The reservoir 724 may receive low pressure hydraulic fluid from the engine oil sump via a passage 730. A return bypass passage 731 including a check valve 732 may connect the passage 728 with the reservoir 724.

Upon engine starting, cranking of the engine causes the cam 100 to rotate. The rotation of the cam 100 causes the piston 720 to slide back and forth in the bore 725. The piston 720 may be dimensioned such that its back stroke permits it to draw hydraulic fluid from the reservoir 724 through the passage 726. The forward stroke of the piston 720 pumps hydraulic fluid past the check valve 729 and through the passage 728 to the VVA gallery.

A piston locking sub-system 740 may be provided to maintain the piston 720 in a non-pumping position after the VVA gallery is charged with hydraulic fluid. The locking sub-system includes a pin 741 slidably disposed in a pin bore 742. The pin bore 742 may include a proximal wide portion and a distal narrow portion. The pin 741 may include portions that mate with the wide and narrow portions of the pin bore 742. The pin 741 may be biased by a spring 743 toward a bore plug 746. The pin 741 may include a shaped head 744 adapted to engage a recess 721 provided in the piston 720 and a shoulder 745 against which hydraulic pressure may act. The pin bore 742 communicates with a passage 747 connected to the engine's main oil line or the VVA gallery (not shown).

At the conclusion of engine start-up, the engine's oil pump forces oil into the locking sub-system 740 via the passage 747. This oil may be used to refill the reservoir 724 and to activate the locking sub-system 740. The oil in passage 747 acts on the shoulder 745 driving the pin 741 against the bias of the spring 743 toward the pin 720. As the pin 741 moves, the shaped head 744 engages the recess 721 in the piston 720, thereby locking the piston 720 into a position removed from the cam 100. Upon engine shut-off, oil drains from the passage 747 allowing the pin 741 to disengage the recess 721 and unlock the piston 720.

The pin bore 742 intersects the piston bore 725 such that neither end of the piston 720 is capable of stroking past the pin bore 742. This may prevent the piston 720 from being trapped in a locked position within the piston bore 725, or in an extended position against the cam 100.

Figure 44:
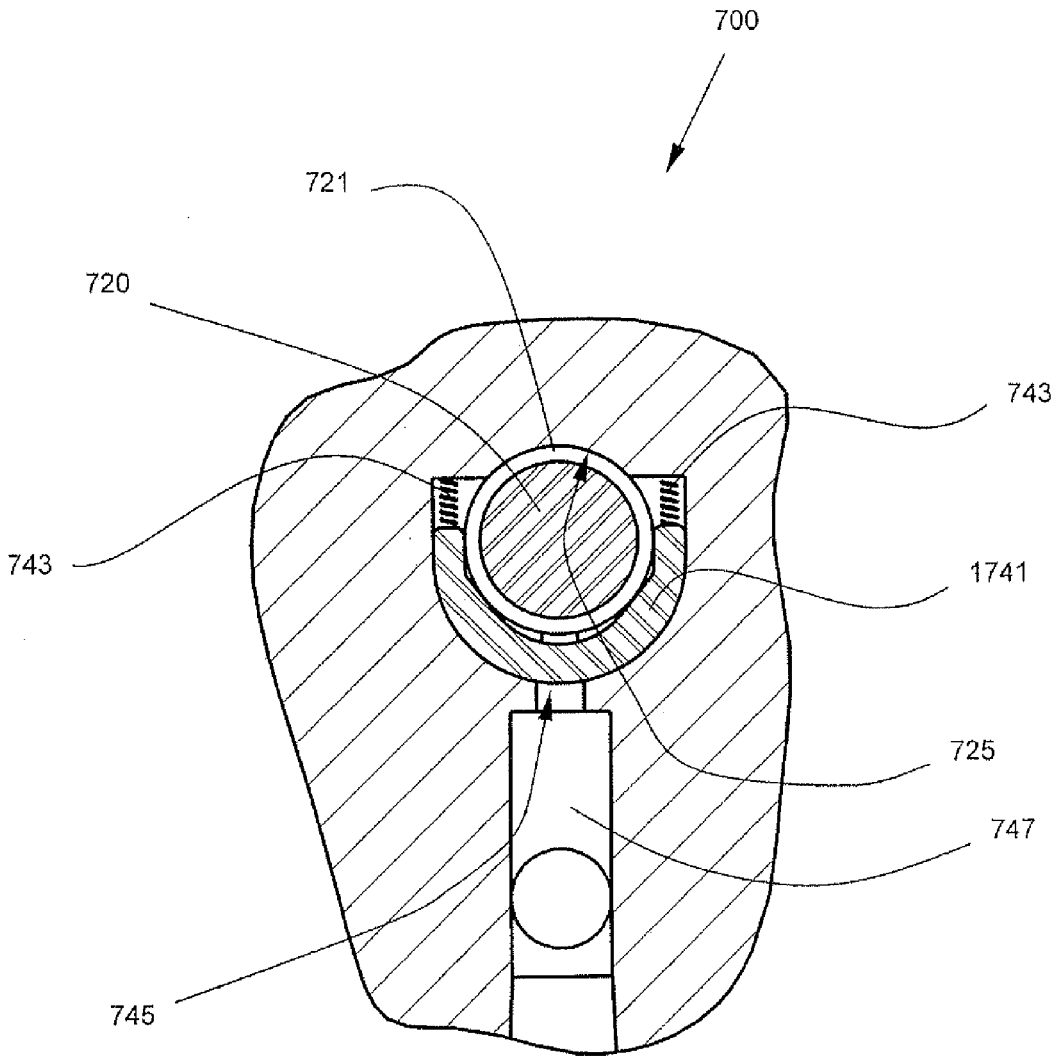
FIG. 44 is a cross-section of an alternative plunger locking device for use in the hydraulic fluid supply system shown in FIG. 43.

It is appreciated that in alternative embodiments, the piston locking sub-system 740 may be provided with a pin 741 that is either stepped (as shown) or uniform (not shown). It is also appreciated that the pin 741 could be replaced by an approximately semicircular ring (shown in FIG. 44) residing in an annulus cut into the piston bore 725.

Figure 46:
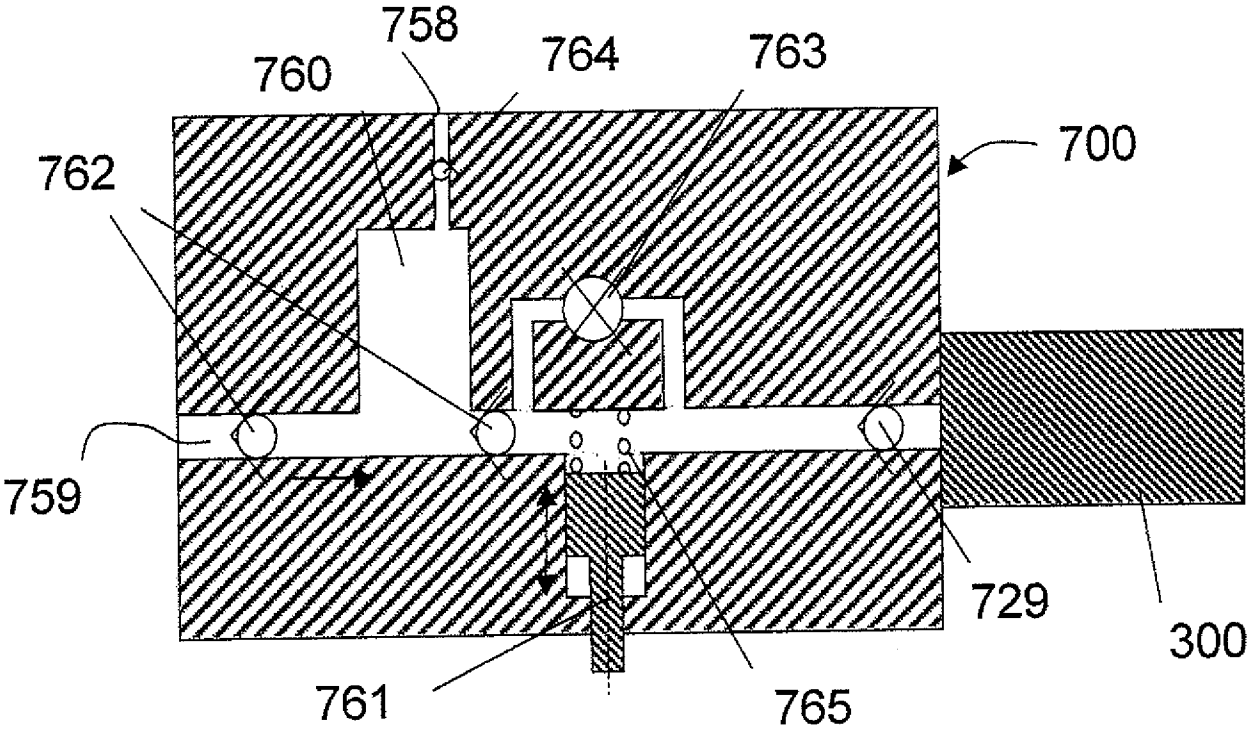
FIG. 46 is a cross-section of a third hydraulic fluid supply system embodiment for use in the present invention.

A third embodiment of the hydraulic fluid charging system 700 portion of the present invention is shown in FIG. 46. With reference to FIG. 46, the system 700 includes an inlet hydraulic fluid port 759, check valves 762, an exit check valve 729, a pumping piston 761, a piston bias spring 765, a fluid reservoir 760, a solenoid controlled valve 763, an air bleed tube 758, and a bleed tube check valve 764.

In the system 700 shown in FIG. 46, the pumping piston 761 may be driven by a cam (not shown) so that it moves upward and back repeatedly within the bore housing it. The piston bias spring 765 is included to ensure that the piston 761 follows the contour of the cam (not shown) used to drive it. The solenoid controlled valve 763 is placed in a hydraulic bypass circuit bracketing the pumping piston 761. The solenoid controlled valve 763 is maintained in an open position during normal engine operation to negate parasitics, and a closed position during engine start up. During normal running, the system 700 is filled with hydraulic fluid ready for the next start.

With continued reference to FIG. 46, after engine shut down the check valves 762 prevent the hydraulic fluid in the reservoir 760 from leaking out. Upon engine start up, the reciprocal motion of the pumping piston 761 is resumed. Because the reservoir 760 is full of hydraulic fluid and in close proximity to the pumping piston 761, the piston can immediately draw fluid to charge the VVA system 300. The bleed tube check valve 764 permits equalization of the pressure in the reservoir 760 when fluid is drawn from it on start up.

Figure 47:
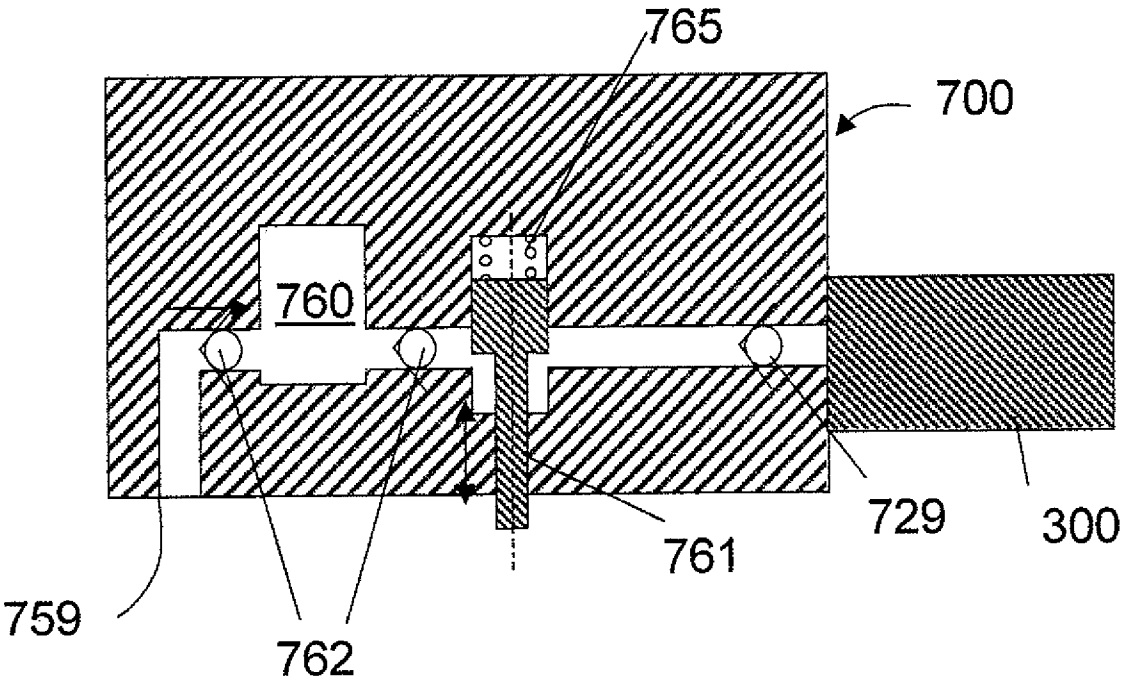
FIG. 47 is a cross-section of a fourth hydraulic fluid supply system embodiment for use in the present invention.

A fourth embodiment of the hydraulic fluid charging system 700 portion of the present invention is shown in FIG. 47. With reference to FIG. 47, the system 700 includes an inlet hydraulic fluid port 759 from the engine's oil sump, check valves 762, an exit check valve 729, a pumping piston 761, a piston bias spring 765, and a fluid reservoir 760.

In the system 700 shown in FIG. 47, the pumping piston 761 may be driven by a cam (not shown) so that it moves upward and back repeatedly within the bore housing it. The operation of the system 700 shown in FIG. 47 is similar to that shown in FIG. 46. The reservoir 760 is filled with fluid during normal operation and is maintained full by the check valves 762 when the engine is shut down. Upon engine start up, the displacement of the pumping piston 761 draws hydraulic fluid from the reservoir 760 and pumps it to the VVA system 300. The system 700 is disabled automatically as a result of selecting a piston bias spring 765 with a particular biasing strength. The bias spring 765 provides enough force to keep the pumping piston 761 in contact with the cam initially. Once the pressure in the hydraulic circuit underneath the pumping piston 761 reaches normal operating levels, however, the bias of the spring 765 is insufficient to force the pumping piston 761 down. Thus, once normal operating pressure is achieved in the VVA system 300, the pumping piston 761 will be maintained up out of contact with the cam used to drive it.

Figure 48:
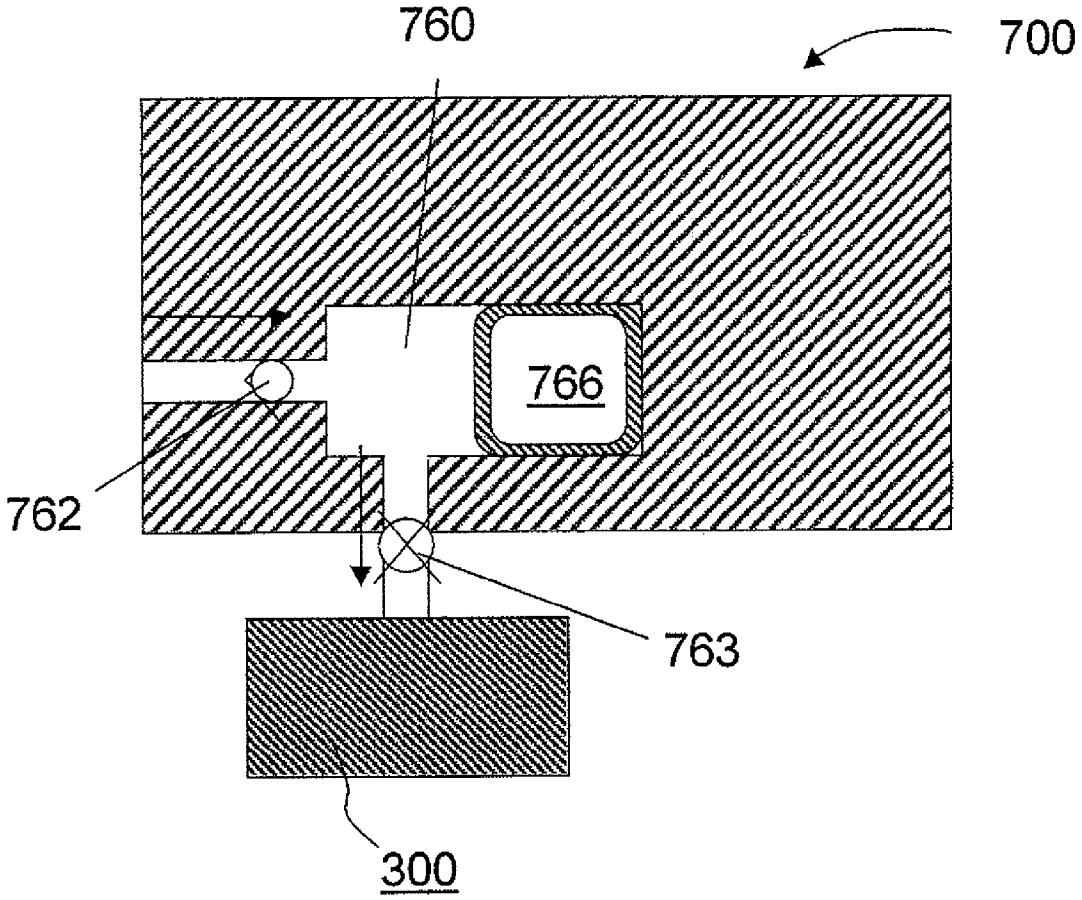
FIG. 48 is a cross-section of a fifth hydraulic fluid supply system embodiment for use in the present invention.

A fifth embodiment of the hydraulic fluid charging system 700 portion of the present invention is shown in FIG. 48. With reference to FIG. 48, the system 700 includes an inlet hydraulic fluid port 759, a check valve 762, a fluid reservoir 760, a solenoid controlled valve 763, and a compressed gas bladder 766. This embodiment uses the combination of the compressed gas bladder 766 and the solenoid controlled valve 763 to selectively force hydraulic fluid in the reservoir 760 into the VVA system 300 upon engine start up.

Figure 49:
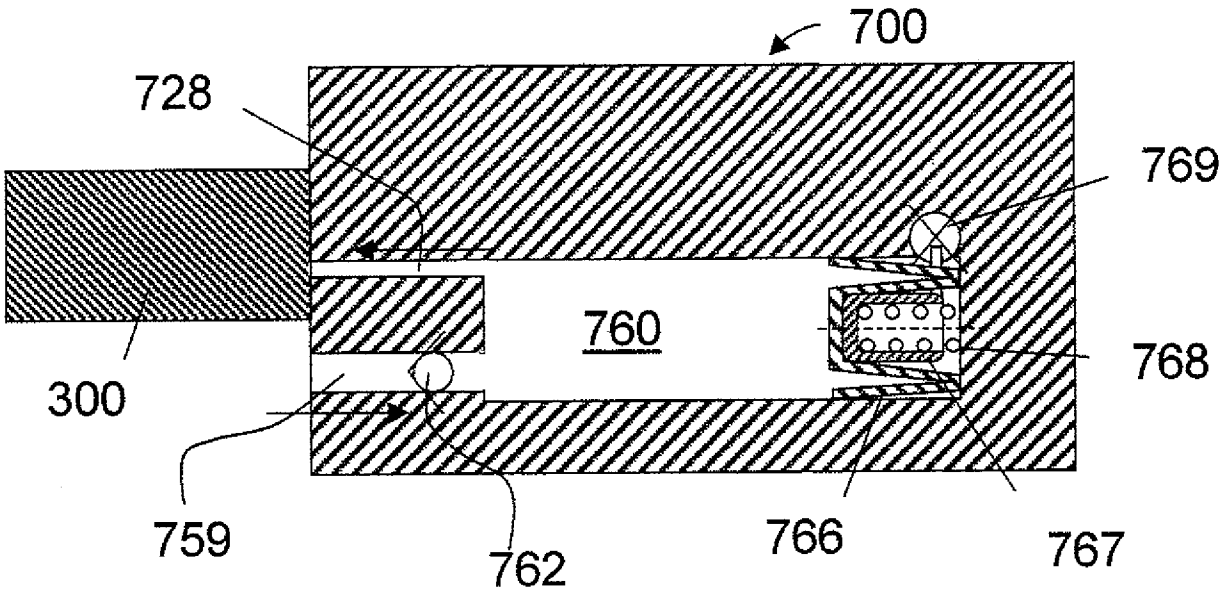
FIG. 49 is a cross-section of an sixth hydraulic fluid supply system embodiment for use in the present invention.

A sixth embodiment of the hydraulic fluid charging system 700 portion of the present invention is shown in FIG. 49. With reference to FIG. 49, the system 700 includes an inlet hydraulic fluid port 759, a check valve 762, a fluid reservoir 760, a solenoid controlled catch 769, a diaphragm 766, piston 767, and a spring 768. The spring 768 biases the diaphragm 766 into a position that forces hydraulic fluid out of the reservoir 760 and into the VVA system 300 via the passage 728. This embodiment uses the combination of the spring biased diaphragm 766 and the solenoid controlled catch 769 to force hydraulic fluid in the reservoir 760 into the VVA system 300 upon engine start up.

Figure 50:
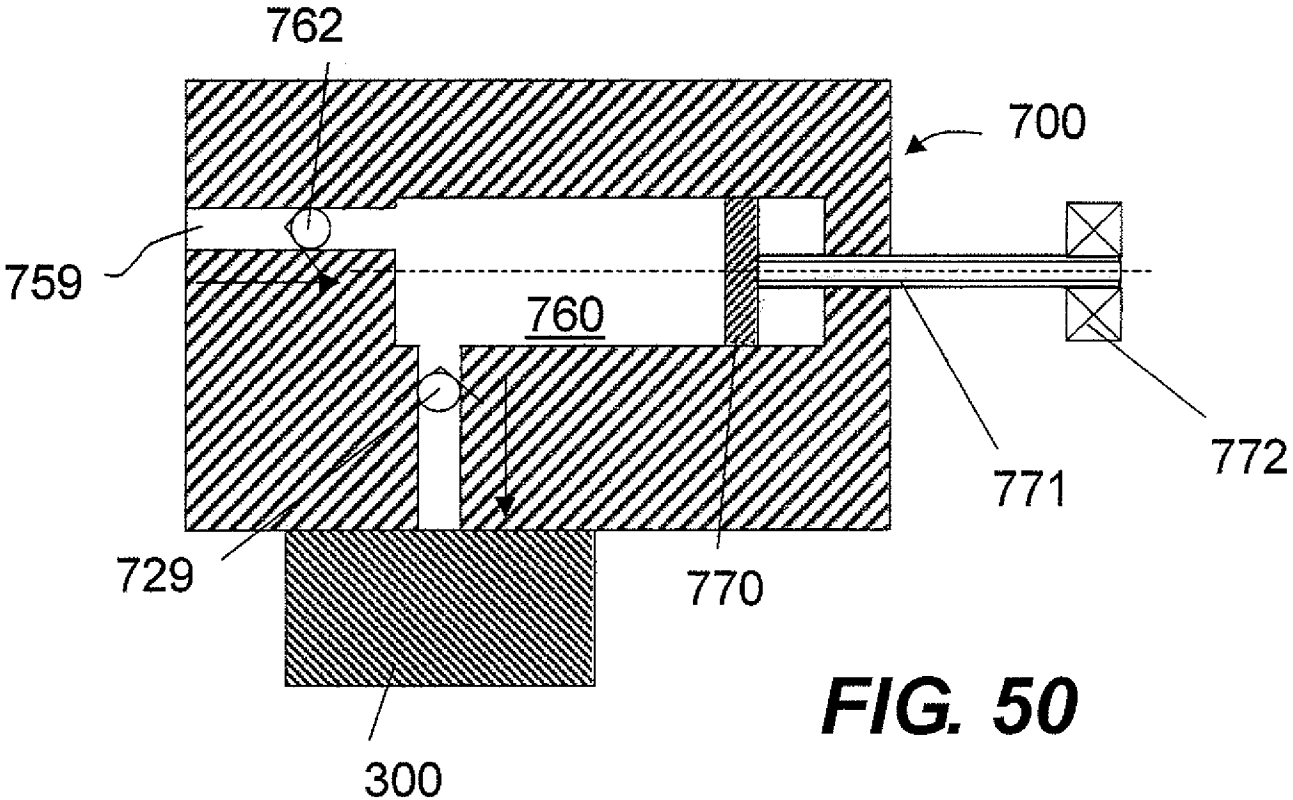
FIG. 50 is a cross-section of a seventh hydraulic fluid supply system embodiment for use in the present invention.

A seventh embodiment of the hydraulic fluid charging system 700 portion of the present invention is shown in FIG. 50. With reference to FIG. 50, the system 700 includes an inlet hydraulic fluid port 759, check valves 762, an exit check valve 729, a cylindrical fluid reservoir 760, an electric motor 772, a screw shaft 771, and a piston 770. In this embodiment, upon engine start up the electric motor 772 drives the screw shaft 771 to force the piston 770 through the reservoir 760 which results in the hydraulic fluid in the reservoir 760 being forced into the VVA system 300 via the passage 728.

Figure 51:
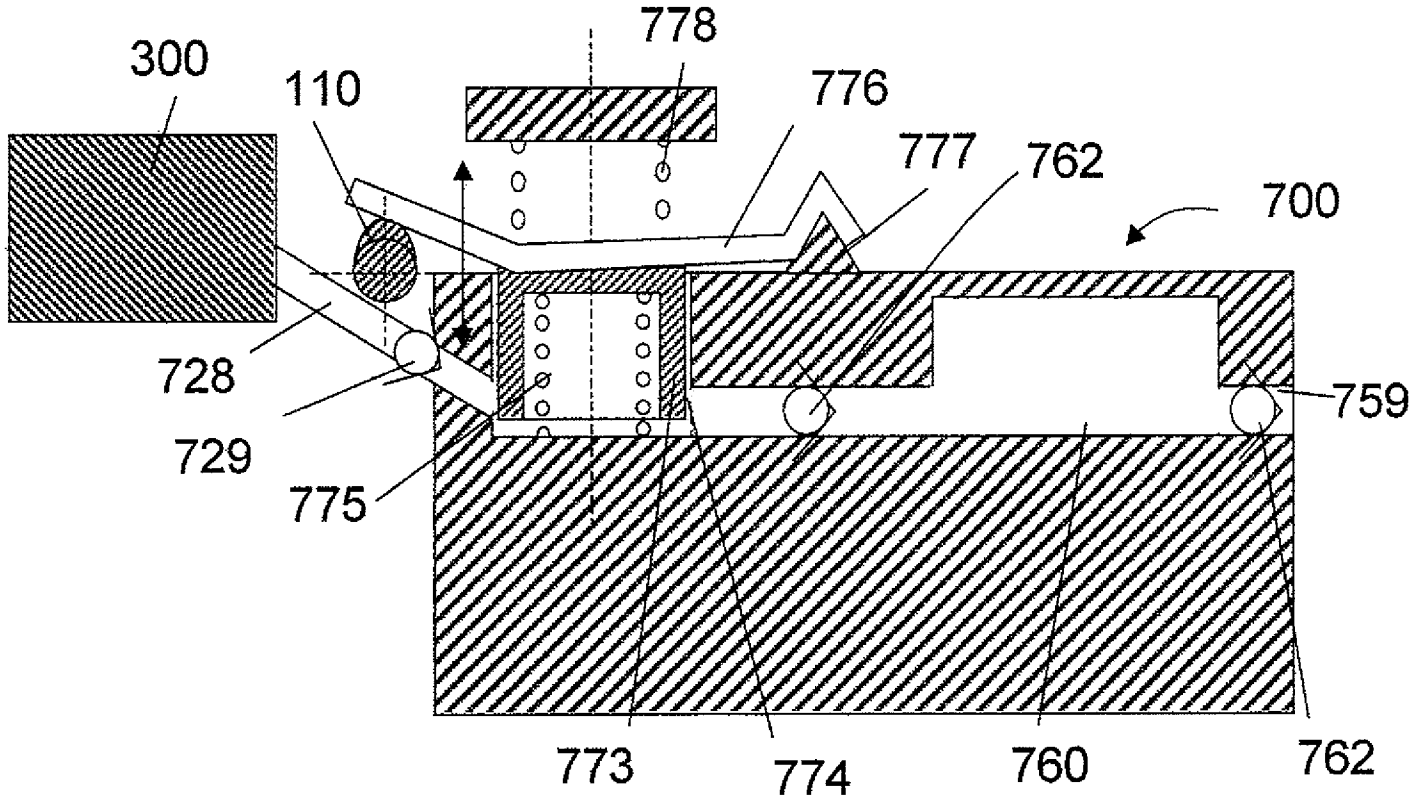
FIG. 51 is a cross-section of an eighth hydraulic fluid supply system embodiment for use in the present invention.

An eighth embodiment of the hydraulic fluid charging system 700 portion of the present invention is shown in FIG. 51. With reference to FIG. 51, the system 700 includes a housing with an inlet hydraulic fluid port 759 connected through a check valve 762 to a fluid reservoir 760. The fluid reservoir 760 is connected through a second check valve 762 to a pumping cylinder 774 in which a pumping piston 773 is disposed. The pumping piston 773 is biased upward by a first spring 775 into a lever 776. The lever 776 pivots on a fulcrum 777 in response to the rotation of a cam 110. The lever 776 is biased into contact with the cam 110 by a second spring 778. The pumping cylinder 774 is also connected through an exit check valve 729 with an outlet passage 728.

With continued reference to FIG. 51, the motion of the cam 110 is used to supply hydraulic fluid to the VVA system 300. The motion of the cam 110 causes the lever 776 to pivot on the fulcrum 777 and pump the pumping piston 773 up and down in the pumping cylinder 774. This pumping action draws oil from the reservoir 760 and pumps it into the VVA system 300 via the outlet passage 728. The fluid charging system 700 recharges using engine oil pressure from the inlet passage 759. The reservoir 760 retains this charge of fluid as a result of placement of the first check valve 762 located in the inlet passage 759. During normal engine operation, the combined force of the first spring 775 and the oil pressure in the pumping cylinder 774 are sufficient to overcome the bias of the second spring 778 and keep the lever 776 up out of contact with the cam 110, thus reducing parasitic losses during normal engine operation.

Figure 52:
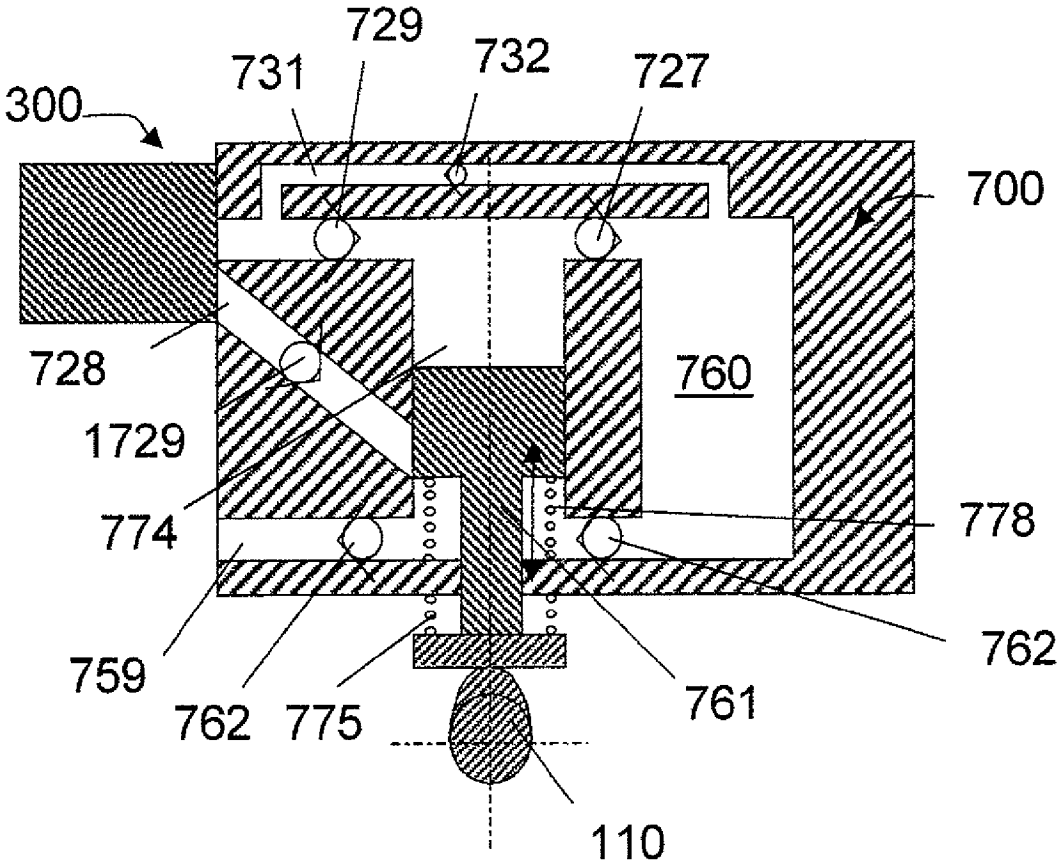
FIG. 52 is a cross-section of a ninth hydraulic fluid supply system embodiment for use in the present invention.

A ninth embodiment of the hydraulic fluid charging system 700 portion of the present invention is shown in FIG. 52. With reference to FIG. 52, the system 700 includes a housing with an inlet hydraulic fluid port 759 connected through a check valve 762 to a pumping cylinder 774. A pumping piston 761 is slidably disposed in the pumping cylinder 774. The pumping piston 761 includes a lower end that extends out of the pumping cylinder 774 and contacts a cam 110. A first spring 775 located outside of the housing biases the pumping piston 761 into the cam 110. A second spring 778 located within the pumping cylinder 774 biases the pumping piston 761 away from the cam 110. The force of the first spring 775 is slightly greater than the force of the second spring 778, and thus, when there is little or no oil pressure in the pumping cylinder 774, the pumping piston 761 remains in contact with the cam 110.

Fluid pumped by the pumping piston 761 flows to the VVA system 300 via two different paths. The first path to the VVA system 300 is provided through a reservoir 760 and past the check valves 762, 727, and 729. The second path to the VVA system 300 is provided past the check valve 729 and through the inclined passage 728.

With continued reference to FIG. 52, the motion of the cam 110 is used to supply hydraulic fluid to the VVA system 300. The motion of the cam 110 causes the pumping piston 773 to move up and down in the pumping cylinder 774. This pumping action draws oil from the reservoir 760 past the check valve 727 and is forced into the VVA system 300. When oil from the engine's pump arrives at the inlet port 759, that oil pressure and the force of the second spring 778 combine to overcome the force of the first spring biasing the pumping piston 761 into contact with the cam 110. Thus, once normal engine operation and oil flow is established, the pumping piston 761 moves out of contact with the cam 110, thereby reducing parasitic losses. Once the pumping piston 761 moves upward out of contact with the cam 110, the inclined passage 728 becomes unblocked and fluid may flow directly from the inlet port 759 to the VVA system 300 via the inclined passage.

The charging system 700 recharges the reservoir 760 with fluid during normal operation. Fluid is maintained in the reservoir as a result of the check valves 762 and 727. In order to prevent the VVA system 300 from being overpressurized, a top fluid return line 731 with a calibrated check valve 732 is provided. The return line 731 allows excess fluid to be returned to the reservoir 760.

The Accumulator System

In the present system, the accumulator fulfills two primary roles: it receives fluid from the piston bore when it is desired that the piston move into its bore, and it provides fluid to the piston bore when it is desired that the piston should move upward in its bore. Ideally, the accumulator would be capable of both rapidly receiving fluid from and rapidly providing fluid to the piston bore. Fluid flow rate between the accumulator and the piston bore is typically dictated by the accumulator spring force, the cross-sectional area of the passage(s) connecting the accumulator to the piston bore, the cross-sectional area of the accumulator piston itself, the restriction of components between the accumulator and the piston bore (such as trigger valves and check valves), the length of fluid passages, accumulator piston travel, and accumulator piston mass. Accumulator spring force is a predominant factor affecting accumulator refill speed. A high rate spring may be used to create high pressures when the accumulator is full, and thus, to increase the rate at which an accumulator can refill the piston bore. The extra back force associated with a high rate spring, however, may also decrease the rate at which the accumulator can receive fluid from the piston bore.

Due to size limitations, a general purpose accumulator is typically designed with a high rate spring (for rapid refill) and reduced passage and accumulator piston cross-sections. Reduced passage and accumulator piston cross-sections save space, however, they also tend to decrease both, the rate at which an accumulator can refill, and the rate at which the accumulator can receive fluid from the piston bore. Use of a high rate spring may make up for the degradation of refill speed attributable to the reduced passage and accumulator piston cross-sections, however, the high rate spring may only further degrade the rate at which the accumulator piston can receive fluid.

The use of a high rate accumulator spring may also necessitate the use of check valves in the fluid passages to prevent high pressure spikes produced by the high springs from being transmitted to neighboring piston bores in the system. These check valves may further degrade the fluid refill and receipt speed of an accumulator.

A high pressure accumulator with a high rate spring that utilizes smaller passages and cross-sections may be suitable for some applications and operation modes, but not all. For example, during early valve closing (i.e. closing part way through the valve event dictated by the event lobe on the cam) the trigger valve opens and the high pressure piston collapses into its bore, dumping a large amount of fluid into the accumulator. Early valve closing requires that the valve closing velocity be close to the free fall velocity of the engine valve. Such rapid closing velocities require correspondingly rapid accumulator fluid reception speeds. The rapid reception of fluid in the accumulator is in turn dependent on there being very little back pressure from the accumulator. High pressure accumulators, however, produce high back pressures, and thus may not be able to receive fluid fast enough to provide early valve closing.

Accordingly, Applicants have developed a low pressure accumulator system for use in some applications that cannot operate with a high pressure accumulator. The presently described low pressure accumulator system takes employs a gallery of accumulators in common hydraulic communication with a plurality of piston bores. Each accumulator includes a thin, low mass (low inertia) accumulator piston and a relatively low rate accumulator spring. Relatively short fluid passages with large cross-sections are used to reduce flow restriction. A low restriction trigger valve is also used to further reduce flow restriction. Furthermore, the use of check valves between neighboring accumulators is reduced or eliminated to still further reduce flow restriction in the system. The result is a low pressure accumulator system that is capable of fluid receipt rapid enough to provide early intake valve closing, but still provides rapid refill (due to the low flow restriction of the system components) to the piston bore when called for.

Figure 53:
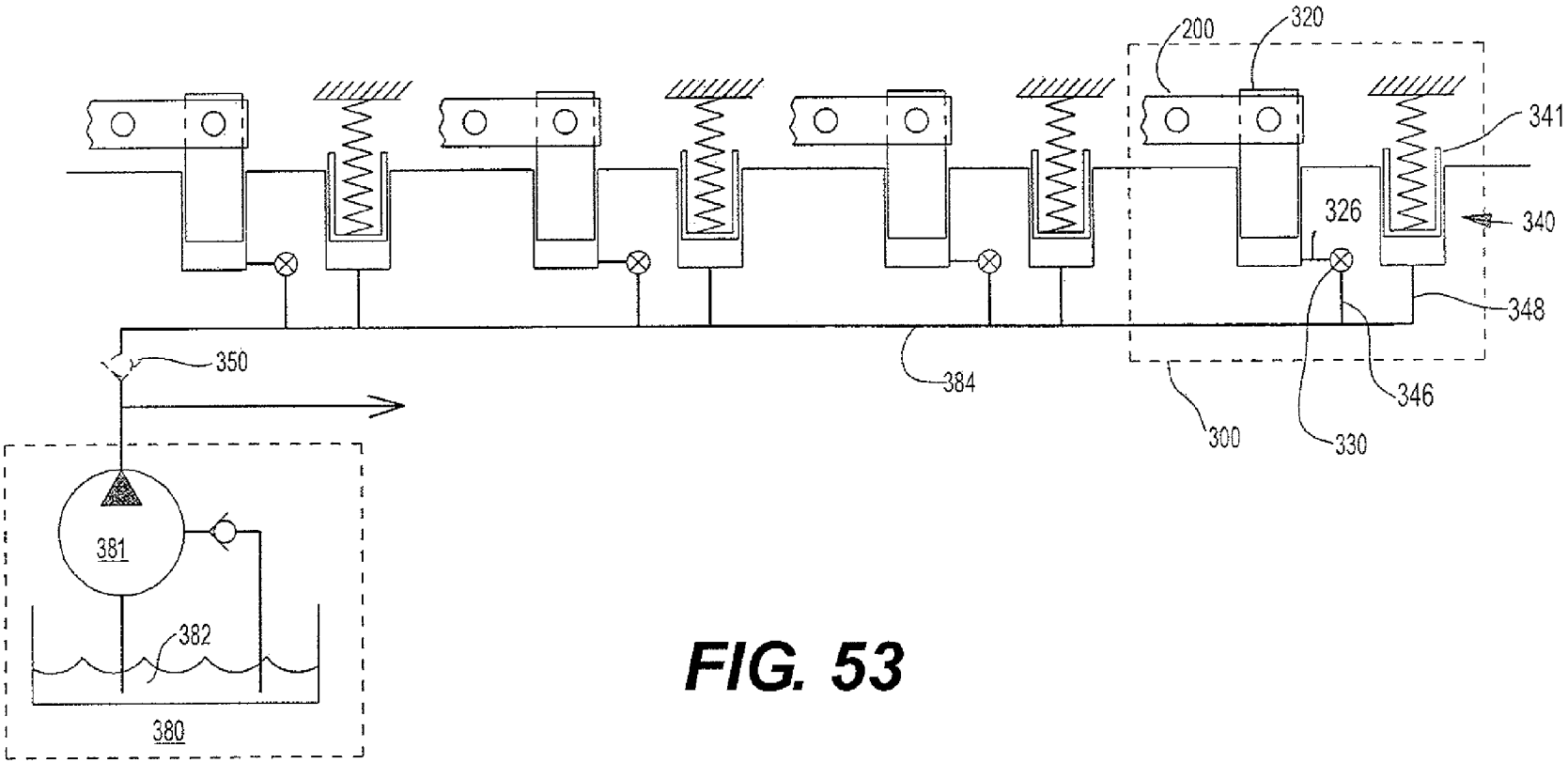
FIG. 53 is a schematic diagram of an embodiment of an accumulator system for use in the present invention.

An embodiment of a multiple accumulator piston low pressure accumulator system which provides acceptable fluid receipt and refill is shown in FIG. 53. With reference to FIG. 53, the accumulator system includes a low pressure hydraulic fluid (oil) supply 380, which itself includes a pump 381, a fluid reservoir 382, and an optional check valve 350. The output from the pump 381 is connected to a shared accumulator system supply gallery 384. The supply gallery 384 is connected to the passage 348 associated with each individual accumulator piston 341 in the system. The trigger valve 330 controls the flow of fluid in the accumulator 340 to and from the control piston bore 324.

For each VVA circuit 300 to function properly during an early valve closing event, there should not be any high pressure or high pressure spikes in the low pressure accumulator passage 346. So long as all of the low pressure passages 346 are maintained at low pressure (without significant pressure spikes), they may be connected together by the common supply gallery 384. This is possible because the overall system may be designed such that no two adjacent VVA circuits 300 fill or spill hydraulic fluid at the same time. By distributing the accumulator pistons 341 along the length of the gallery 384, the high pressure flow from an individual control piston 320 event can spill into several nearby accumulators 340. Similarly, when it is time to fill a high pressure circuit such as a control piston bore 324, hydraulic fluid pressure can be applied from several nearby accumulators 340. Inherent fluid inertia of the fluid in the gallery 384 prevents the accumulators located far from the active VVA circuit 300 from having much of an effect on filling or receiving fluid. Using the foregoing fill and spill protocol, each individual accumulator piston 341 may be slightly smaller than would be required for isolated VVA circuits.

Preferably, the embodiment shown in FIG. 53 may utilize normal engine oil supply pressure in the gallery 384. This pressure varies somewhat with engine speed, however, the increased pressure associated with increased engine speeds should not adversely effect the system operation. If the engine oil supply pressure and the gallery pressure are approximately the same there should not be a need for a check valve between the two.

Figure 45:
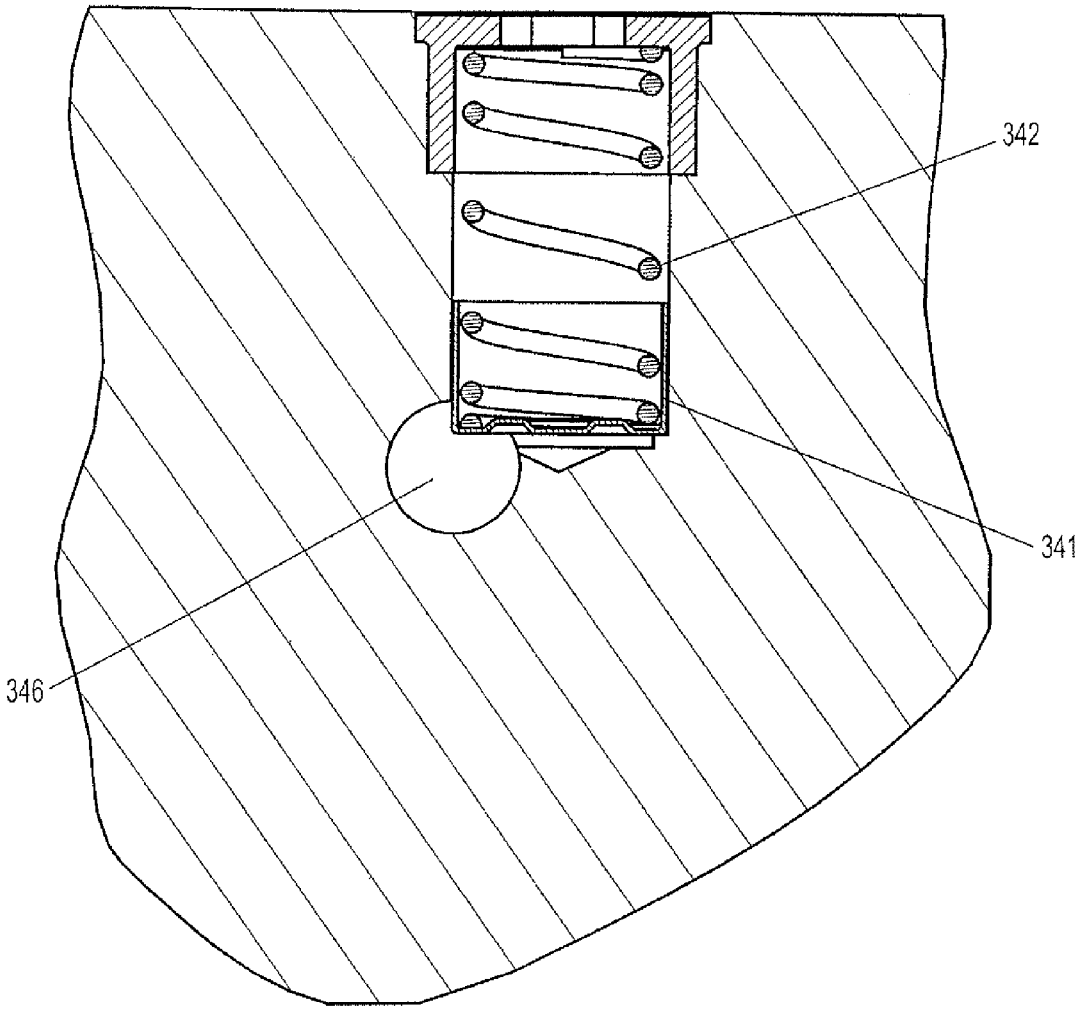
FIG. 45 is a cross-section of an embodiment of a low pressure accumulator for use in the present invention.

A detailed view of an accumulator 340 is shown in FIG. 45, in which like reference numerals refer to like elements. The accumulator 340 includes a thin, low mass, low inertia accumulator piston 341 so as to provide for the rapid receipt of fluid from the passage 346.

Figure 54:
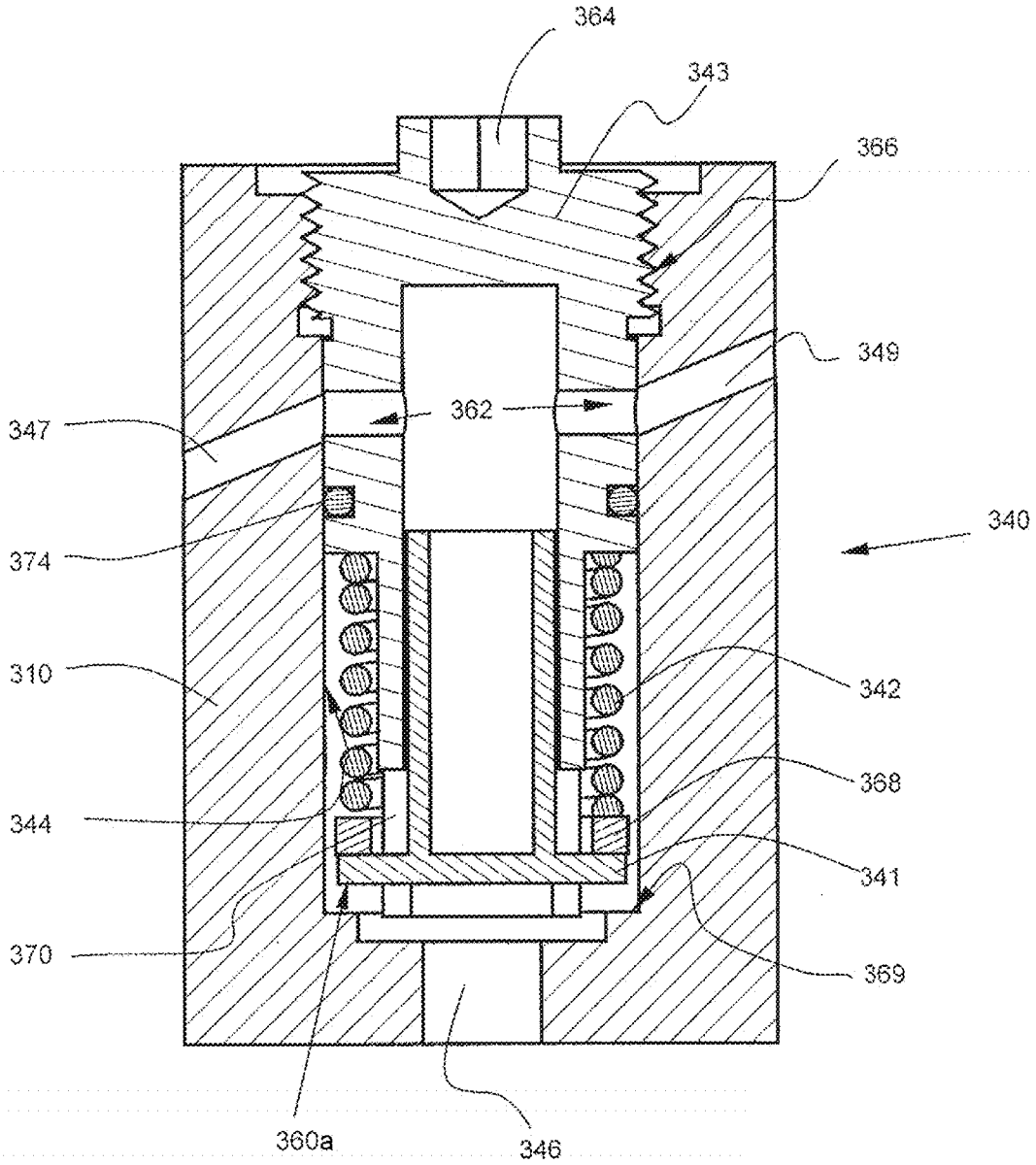
FIG. 54 is a cross-section of an embodiment of a high pressure accumulator for use in an alternative embodiment of the present invention.

Despite the aforenoted advantages of a low pressure accumulator system, for some applications a high pressure accumulator may be preferred for increased refill speeds. Accordingly, Applicants have also developed a high pressure accumulator system in a compact package with a decreased diameter accumulator piston. An embodiment of the high pressure accumulator system according to the present invention is shown as 340 in FIG. 54. With reference to FIG. 54, the overall length of the accumulator system 340 is decreased by positioning the accumulator spring 342 around and concentric to the accumulator piston 341 instead of behind the piston. As a result, a larger, stiffer accumulator spring 342 can be fit in a given overall accumulator envelope. A variable rate accumulator spring 342 is desirable, because it is preferable to have a low k to prevent bottoming out the accumulator piston 341 and a high k to provide a fast response.

Figure 55:
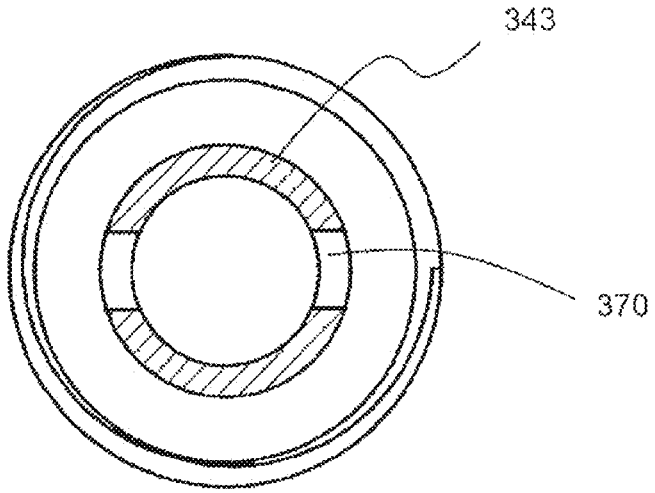
FIG. 55 is a bottom plan view of the accumulator piston shown in FIG. 54.
Figure 56:
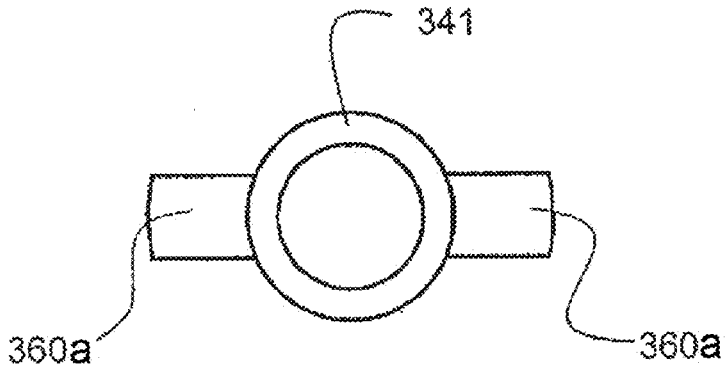
FIG. 56 is a top plan view of the accumulator piston shown in FIG. 54.

With reference to FIGS. 54-56, the embodiment of accumulator 340 shown therein comprises an accumulator piston bore 344 in a hydraulic system housing 310. The housing 310 includes a connecting hydraulic passage 346, a drain 347 to the engine overhead, an air vent 349, and a piston seat 369. The accumulator 340 further comprises an accumulator piston 341 with a flange 360*a* which contacts accumulator spring 342 through a washer 368, and a combination cap and sleeve 343. The combination cap and sleeve 343 comprises a drain hole or holes 362, a socket head or other securing means 364, and a threaded portion 366. The combination cap and sleeve 343 retains the spring 342 in the housing 310, provides a clearance seal with the piston 341 to retain oil in the accumulator 340, and drains leakage and bleed oil to maintain the back of the accumulator piston open to ambient pressure. The combination cap and sleeve 343 further includes grooves or slots 370 that mate with the piston flanges 360*a* and whose depth determines the maximum stroke of the accumulator piston 341. The accumulator piston 341 further comprises a piston sealing surface 372 and an O-ring seal 374.

As noted above, the high pressure accumulator embodiment of the present invention shown in FIG. 54 is designed to provide a very rapid increase in accumulator pressure with increase in lift (high spring rate k) to increase response time of the accumulator. With reference to FIG. 6, the accumulator piston 341 pressure and fluid line 348 $\Delta P$ must always be lower than the control piston 320 pressure. At the same time, the accumulator piston 341 pressure must be sufficient to refill the control piston bore 324 quickly. The accumulator piston pressure required for adequate refill response decreases with increasing accumulator piston diameter. Because the inertia of the accumulator fluid line (i.e. passages 326 and 346) may have a greater effect than the inertia of the accumulator piston plus its spring mass, it may be desirable to have the lowest possible accumulator piston 341 diameter. The effective additional mass at the accumulator piston due to the fluid inertia is proportional to $(D_a/D_1)^4$, where $D_1$=line diameter and $D_a$=accumulator piston diameter. Thus, the effective additional mass at the accumulator piston due to fluid inertia scales upwards to the fourth power as the accumulator piston diameter is increased.

Figure 57:
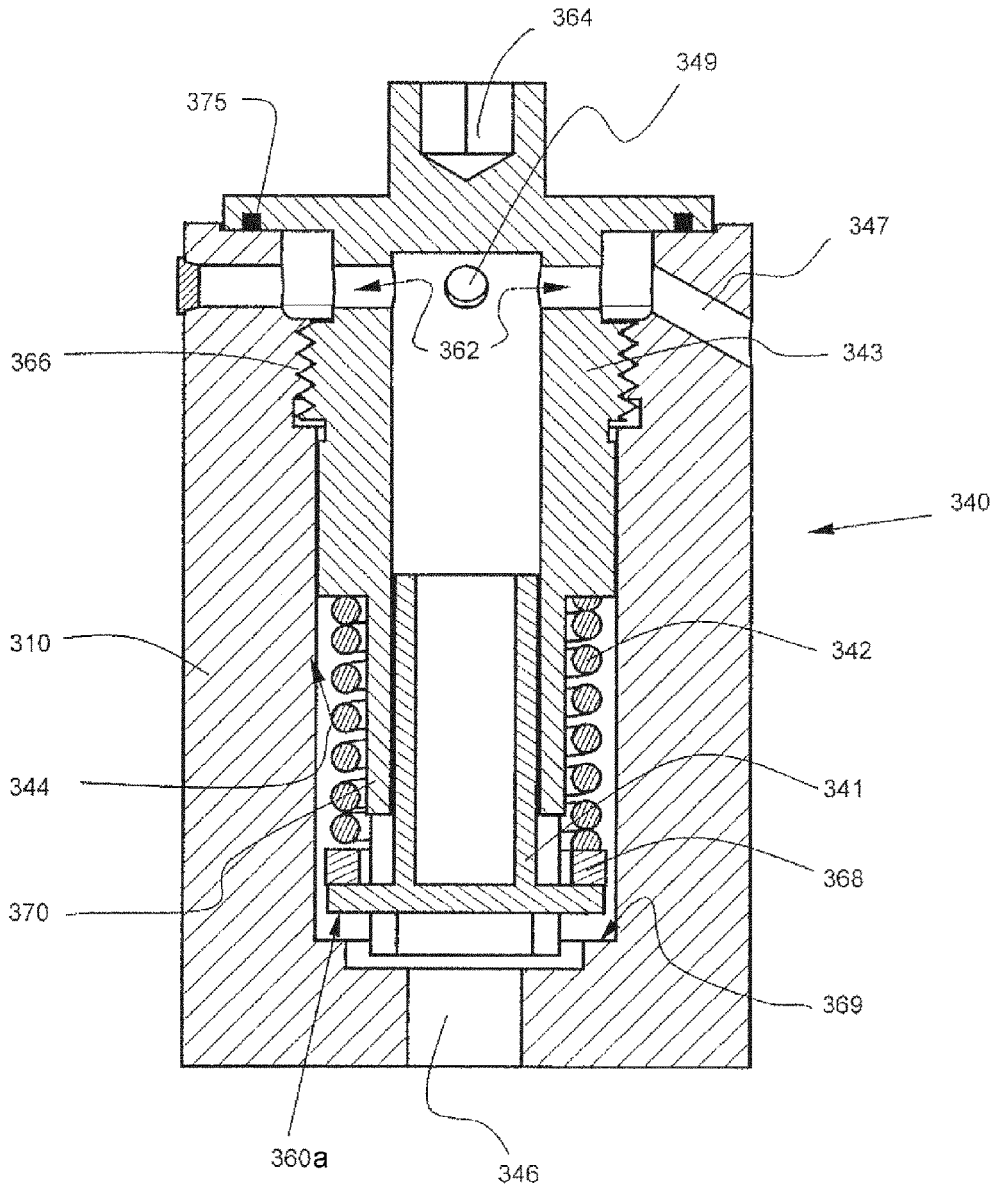
FIG. 57 is a cross-section of an alternative embodiment of a high pressure accumulator that may be used in the present invention.
Figure 58:
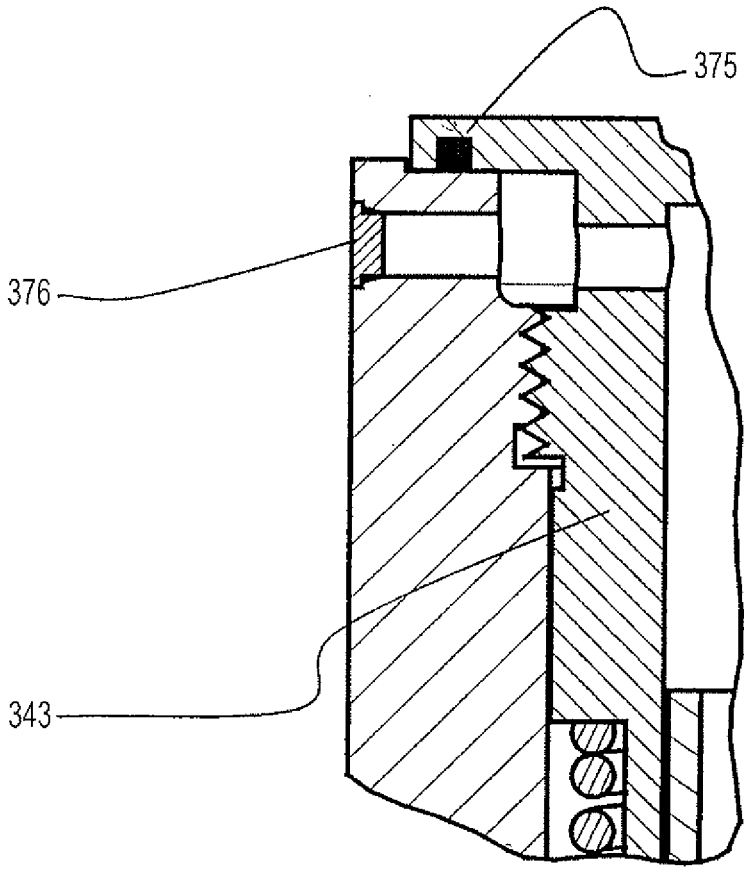
FIG. 58 is a detailed cross-section of the sealing arrangement shown in FIG. 57, showing a de-aeration element and a housing boss.

An alternative embodiment of the high pressure accumulator system 340 shown in FIG. 54 is shown in FIGS. 57 and 58, in which like reference numerals refer to like elements. With reference to FIGS. 57 and 58, the combination cap and sleeve 343 may be sealed differently than in the embodiment shown in FIG. 54. A detailed illustration of the alternative sealing arrangement is shown in FIG. 58, where the seal 375 is included in place of the seal 374 shown in FIG. 54. The alternative embodiment also includes a plug 376 which may contain a de-aeration member intended to relieve the system of trapped air without loss of hydraulic fluid. Furthermore, in the alternative embodiment, the seal 374 of the accumulator piston 341 to the combination cap and sleeve is eliminated. As a result, in the alternative embodiment of the accumulator system 340, the back side of the accumulator piston 341 is not hydraulically isolated from the pressures applied through the passage 346. This may provide increased accumulator spring preload via the engine oil pressure, which allows higher accumulator pressures when deleting cam events.

Electronic Control Features

With renewed reference to FIGS. 6 and 11-14, the electronic valve controller 500 may utilize timing maps prestored in its nonvolatile memory to provide the timing information needed to control the opening and closing of the trigger valve 330. The opening and closing of the trigger valve 330, in turn may be used to control the actuation of intake and exhaust valves in an internal combustion engine.

Figure 59:
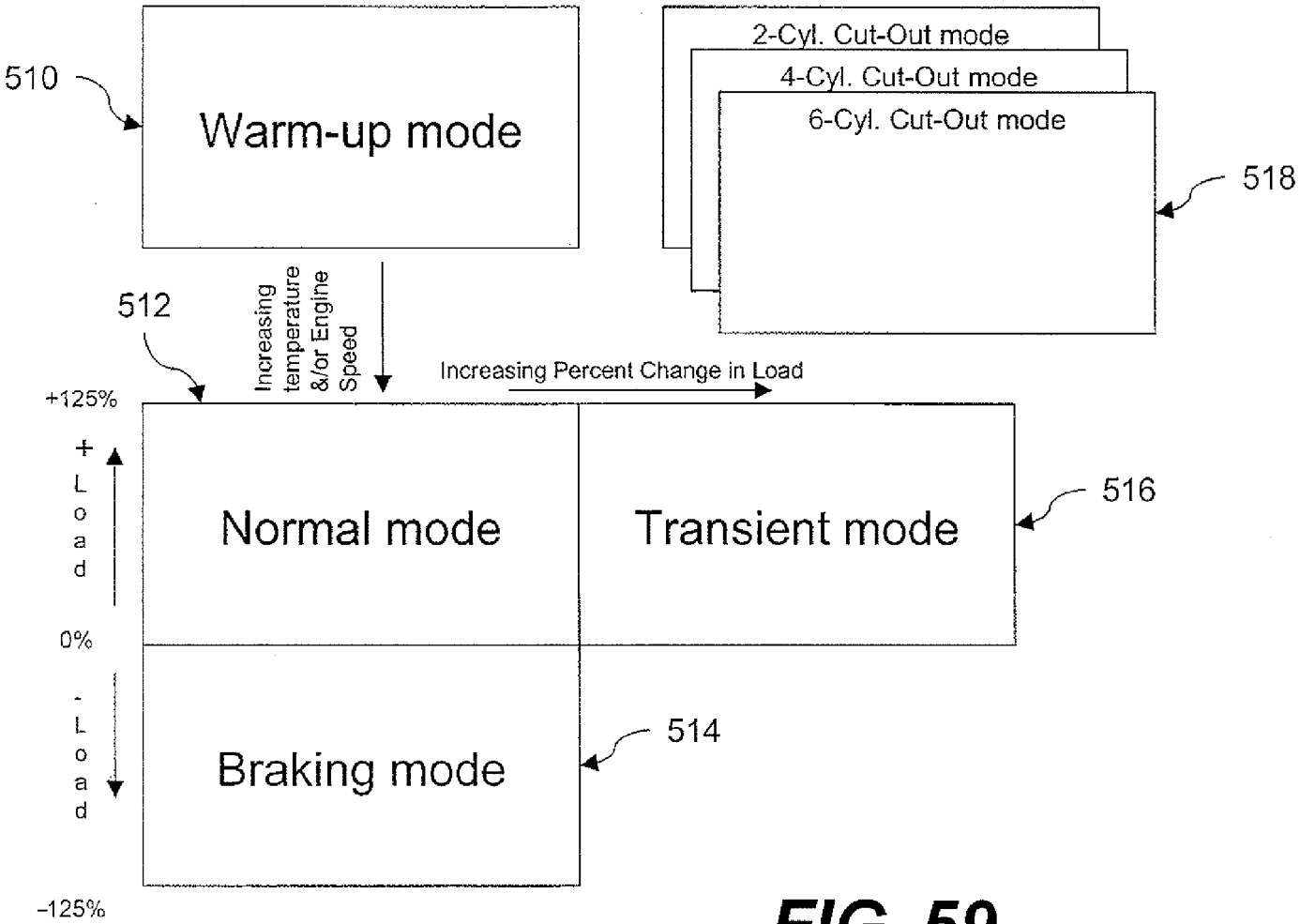
FIG. 59 is a block diagram of the various engine modes used by the electronic valve controller, and the relationship of the modes to each other.

Each engine operation mode utilizes its own set of maps to provide the trigger or engine valve opening and closing times. A block diagram of various engine mode map sets is shown in FIG. 59, and may include a warm-up mode 510, a normal mode 512, a transient mode 516, a braking mode 514, and one or more cylinder cut-out modes 518.

Figure 60:
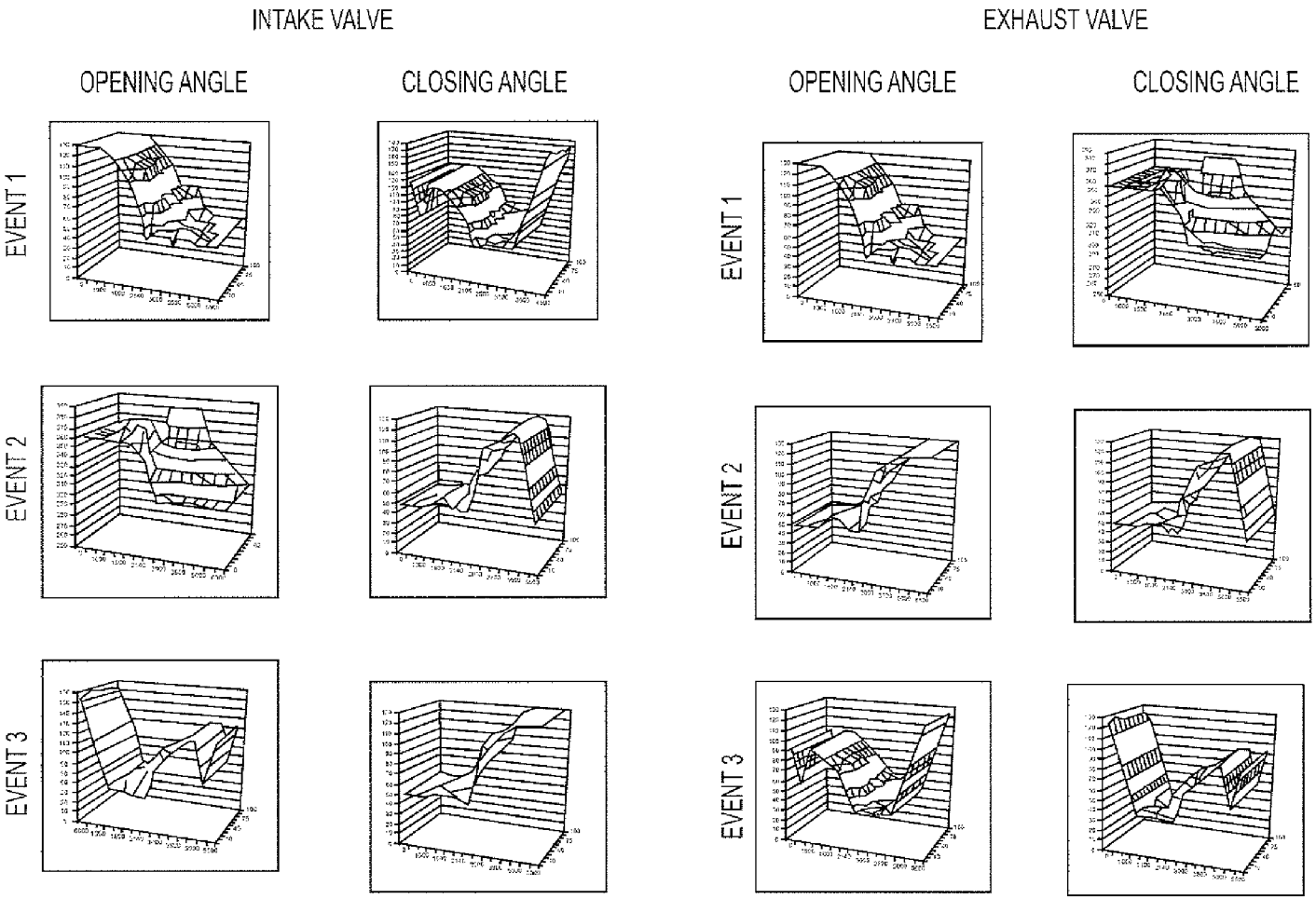
FIG. 60 is a pictorial representation of a valve timing map set used to control valve actuation during particular engine operating modes.

An example timing map set is shown in FIG. 60. The set contains opening and closing maps for each of a number of events for each valve controlled. Represented theoretically in a spreadsheet arrangement, the trigger valve or engine valve opening and closing information arranged in maps is indexed by engine speed (x-axis of the map in units of RPM) and engine load (y-axis of the map). The trigger valve opening and closing times may be provided in terms of engine crank angle position (i.e. 0-720 crank angle degrees). The trigger valve opening and closing times contained in these maps may be used to optimize the actuation timing of the intake and exhaust valves. The trigger valve opening and closing information stored in each map may be selected (and recalibrated based on engine operation data) to optimize positive power generation, braking power generation, fuel efficiency, emissions production, etc. or any combination of the foregoing for particular combinations of engine speed, engine load, and engine operation mode.

Each map may include trigger or engine valve timing information at selected uniform or non-uniform intervals of engine speed and engine load. For example, trigger valve timing information may be provided for 500, 800, 1100, 1300, 1400, 1450, 1500, etc. RPMs. Thus the RPM intervals for successive timing information are 300, 300, 200, 100, 50, and 50. In this fashion, each map may provide heightened resolution for engine operating conditions that call for a finer adjustment of timing information. The engine load intervals for which trigger valve timing information is provided by a map may also be non-uniform so as to provide heightened resolution in the map as it may be needed. In this manner the required map resolution may be provided without using more memory than is absolutely necessary.

Each of the thousands of engine speed and engine load combinations found in a map correspond to an individual piece of timing information. Engine speed and engine load may be used to determine timing information for up to three intake valve opening events, three intake valve closing events, three exhaust valve opening events, and three exhaust valve closing events per engine cycle (720 crank degrees). The individual pieces of timing information comprise three paired trigger valve opening and closing times for three intake valve events and three paired trigger valve opening and closing times for three exhaust valve events. Thus, up to the twelve maps shown in FIG. 60 may be needed to control the valve actuation of one intake and one exhaust valve. Exemplary 3-dimensional graphs of engine speed v. engine load v. crank angle for the trigger valve openings and closings for each of the intake and exhaust valve events are shown in FIG. 60.

Upon cold start up of an engine, warm-up mode 510 may be the first accessed by the electronic valve controller. The map sets associated with the warm-up mode 510 may be used during starting at low temperatures to improve starting performance and to reduce emissions, which tend to be high during starting. The warm-up mode 510 may be entered based on engine oil temperature (or an alternative gauge of engine temperature), engine speed, and/or some other sensed engine parameter such as boost temperature, boost pressure, etc. If the oil temperature is below a preset cold-start minimum and engine speed is zero, the warm-up mode 510 will be entered. In the preferred embodiment of the invention, it is anticipated that the RPM values for which trigger valve timing information will be provided for the warm-up mode will be: 0-6000. It is also anticipated that the engine load values for which trigger valve timing information will be provided will be: 0-125%. It is further anticipated that the warm-up mode minimum temperature may be in the range of −40 degrees Celsius depending upon specific engine operating requirements.

The map sets associated with the normal mode 512 are used to provide the trigger valve timing information for steady state positive power operation of the engine above the warm-up mode oil temperature threshold and/or engine speed threshold. The engine parameters that may be used to determine whether the normal mode 512 operation will begin are percent change in load, engine braking request information, oil temperature, and engine speed. If the oil temperature is above the warm-up mode threshold and the percent change in load is below the delta load lower threshold and braking mode is not being requested, then the normal mode 512 is used. In the preferred embodiment of the invention, it is anticipated that the RPM values for which trigger valve timing information will be provided for the normal mode map will be: 0-6000. It is also anticipated that the engine load values for which trigger valve timing information will be provided will be: 0-125%.

The map sets associated with the transient mode 516 are used to provide the trigger valve timing information during positive power accelerations to increase the speed at which the engine moves from one steady state operating point to another steady state operating point. The engine parameters that may be used to determine whether or not use of the transient mode 516 is appropriate are percent change in load and engine brake request information. If the percentage change in load is equal to or above the delta load upper threshold and engine braking is not being requested, then the transient mode 516 is used.

In the preferred embodiment of the invention, it is anticipated that the RPM values for which trigger valve timing information will be provided for the transient mode will be: 0-6000. It is also anticipated that the engine load values for which trigger valve timing information will be provided will be: 0-125%. It is also anticipated that the transient mode delta load lower limit may be in the range of 25-50%, depending upon specific engine operation characteristics.

The braking mode map set 514 is used to provide the trigger valve timing information during engine braking operation above a preset minimum engine oil temperature and above a preset minimum braking engine speed. The inputs used to determine whether or not use of the braking mode 514 is appropriate are oil temperature, engine speed, and an engine brake request. If the oil temperature and engine speed are above the preset minimums and the appropriate engine brake request is detected, then the braking mode 514 is used. In the preferred embodiment of the invention, it is anticipated that trigger valve timing information will be provided for the braking mode for 0-6000 RPMs. It is also anticipated that trigger valve timing information will be provided for engine load values of 0-125%. It is further anticipated that the preset minimum braking temperature may be in the range of less than 50 degrees Celsius, and the preset minimum braking engine speed may be in the range of 600-1100 RPM, depending upon specific engine operating characteristics.

Cylinder cut-out mode refers to one or more modes of operation in which selected engine cylinders are deprived of fuel. In addition to being deprived of fuel, actuation of the intake valve(s) and exhaust valve(s) in the cut-out cylinders may be altered to allow the piston in these cylinders to slide more freely or to cease the use of engine power to actuate the valves in the cut-out cylinder. Selective cylinder cut-out may provide improved fuel economy (particularly at low to medium loads), decreased component wear, reduced carbon build-up in the cylinders, easier starting, and reduced emissions.

There may be multiple map sets 518 provided for the corresponding multiple levels of cylinder cut-out (e.g. 2-cylinder cut-out, 4-cylinder cut-out, 6-cylinder cut-out, etc.). At any given engine load and speed, all of the (properly) firing cylinders handle an equal share of the total load. For example, when four cylinders are firing, each handles one fourth of the load. If the number of cylinders firing is reduced, as is the case during cylinder cut-out, then the remaining firing cylinders must handle the extra load on a pro rata basis. Because the remaining firing cylinders need to increase their load share, they will need more fuel and thus more air, and thus it is likely that intake and/or exhaust valve timing adjustments will be required. It is anticipated that there may need to be a different map for each particular cylinder cut-out combination. The input for selecting a cylinder cut-out map is detection of a cut-out algorithm request signal.

Figure 61:
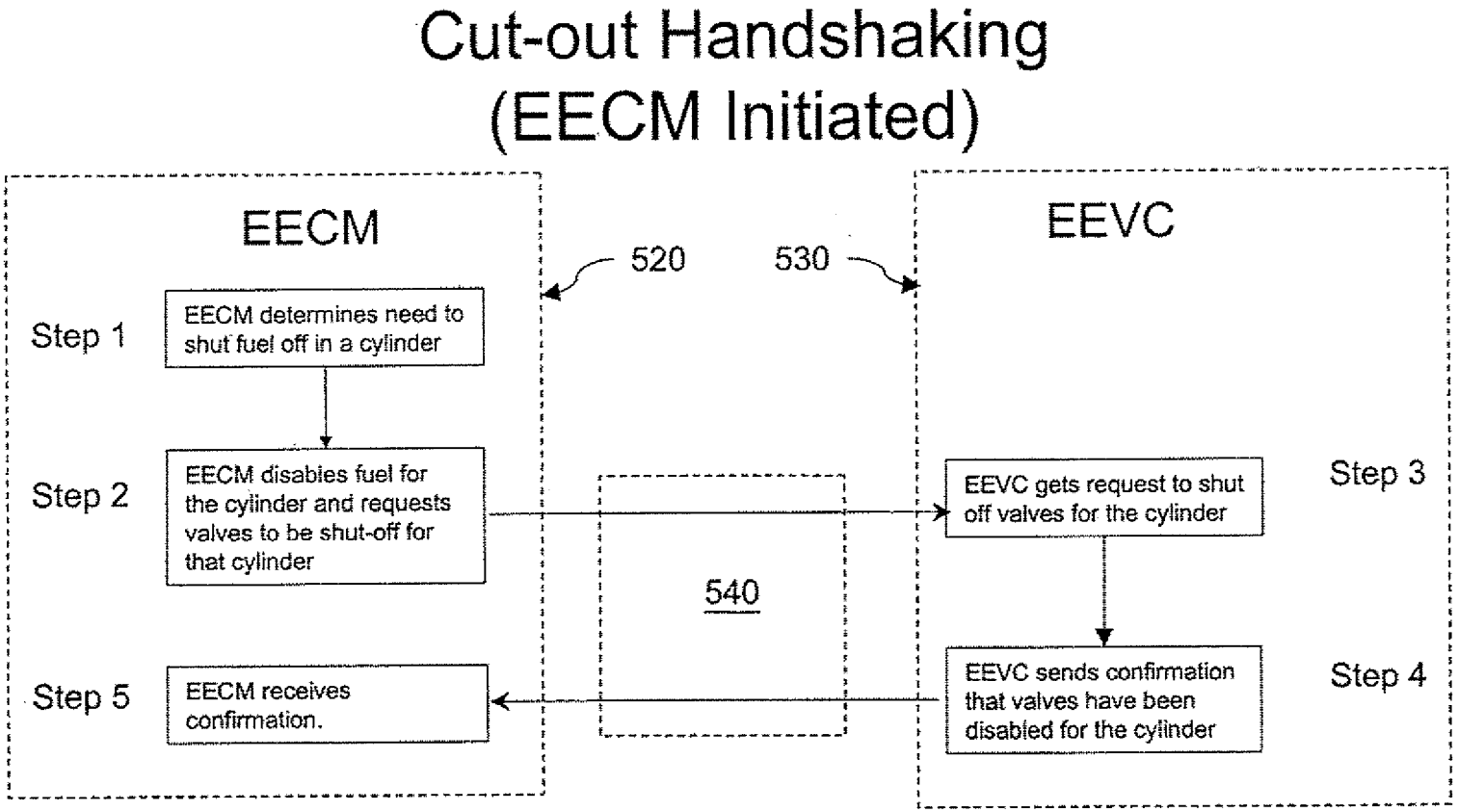
FIGS. 61-69 are flow charts illustrating various engine control algorithms used for cylinder cut-out and cylinder re-start.

A first algorithm for implementing cylinder cut-out to allow an internal combustion engine to operate with lower fuel consumption when in a low to medium load condition is shown in FIG. 61. The equipment used to carry out the algorithm may include an electronic engine control module (EECM) 520 and an electronic engine valve controller (EEVC) 530. The EECM 520 may communicate with the EEVC 530 over a communications link 540. The EECM 520 functions may include selective fueling of cylinders on a cylinder by cylinder basis, and the ability to determine when engine loads are sufficiently low to allow engine operation without all cylinders being active. The EEVC 530 functions may include selective control over engine valve operation on a cylinder by cylinder basis, and the generation of a signal confirming the disabling of an engine valve(s).

With respect to the first cylinder cut-out handshaking algorithm that may be carried out by the EECM 520 and the EEVC 530, in step 1, the EECM determines the need to shut fuel off in a cylinder. This determination may be made on the basis of a low to medium engine load for a predetermined sustained time and/or a number of engine cycles. In step 2, the EECM disables fuel for the selected cylinder(s) and requests that the engine valves for that cylinder(s) be shut off. Using the communications link 540 in step 3, the EEVC receives the request from the EECM to shut off the valves in the selected cylinder(s). In step 4, the EEVC sends a confirmation signal to the EECM, confirming that the valves in the selected cylinder(s) have been shut off. In step 5, the EECM receives the confirmation signal.

Figure 62:
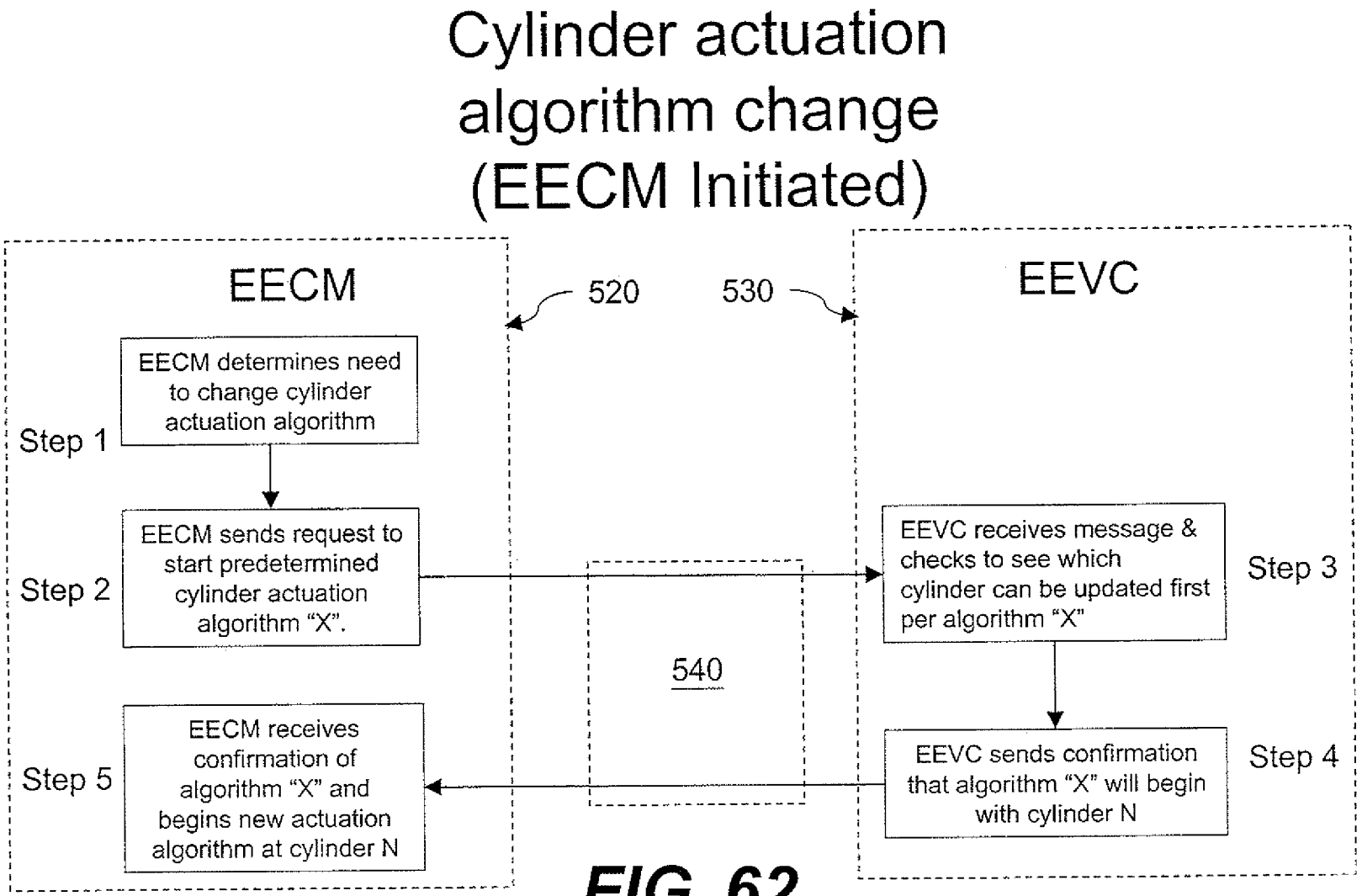

A second algorithm for implementing cylinder cut-out is shown in FIG. 62. The algorithm shown in FIG. 62 assumes that the last thing to occur in a cylinder to be cut-out is an exhaust valve event to lower the remaining air pressure in the cylinder. It is also assumed that the speed with which the engine enters cylinder cut-out mode is not critical. It is still further assumed that the EECM 520 and the EEVC 530 may have several predetermined cylinder cut-out algorithms ("X") stored in memory corresponding to the number, identity, and rotation of the cylinders to be cut-out. For example a first algorithm could call for the cut-out of one cylinder, a second algorithm could call for the cut-out of two cylinders, and a third algorithm could call for the cut-out of two cylinders with alternation of the identity of the cut-out cylinders every N engine cycles.

With continued reference to FIG. 62, the EECM 520 may initiate the algorithm with determination of a need for cylinder cut-out, followed by sending a request to the EEVC to start a predetermined cylinder cut-out algorithm "X" (e.g. cut-out of two cylinders). It is also possible that the need for cylinder cut-out could be made by the EEVC in an alternative embodiment. In the next step, the EEVC may determine which cylinder can be cut-out first in accordance with algorithm X based on engine speed and position. Thereafter the EEVC may send confirmation to the EECM that algorithm X will begin with cylinder "A." The last valve event enabled by the EEVC in cylinder A is an exhaust event. In the final step, the EECM receives confirmation that the algorithm X will begin in cylinder A and initiates cutting off fuel to cylinder A.

Figure 63:
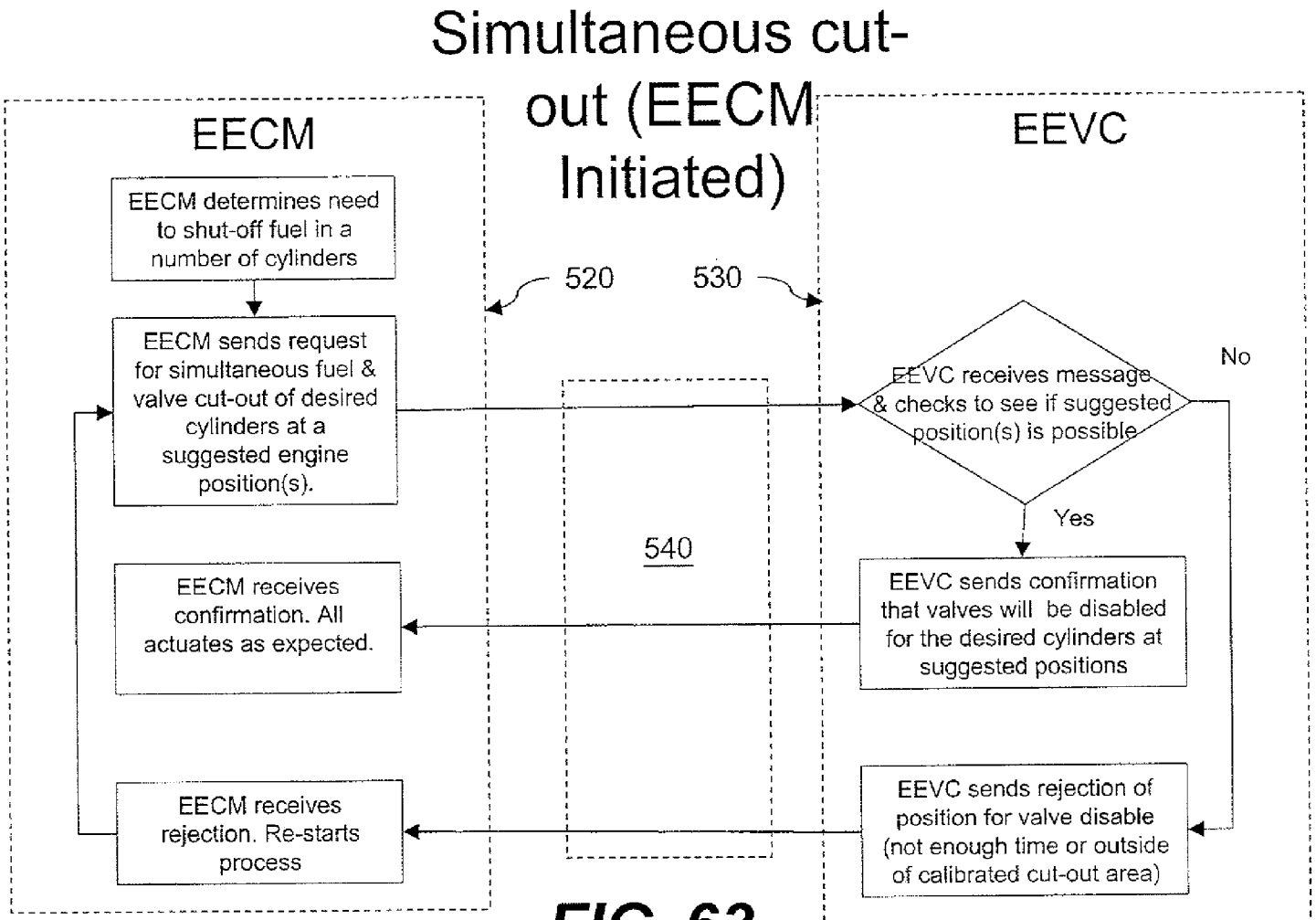

With reference to FIG. 63, a third algorithm is shown for initiating simultaneous cut-out in plural cylinders. The algorithm shown in FIG. 63 may be used to cut-out any number of cylinders. Generally, some number of cylinders should be cut-out simultaneously so as to keep the engine balanced. Accordingly, the simultaneously cut-out cylinders should be physically opposed to each other for optimum balance.

With continued reference to the algorithm shown in FIG. 63, a four cylinder engine may have a cylinder firing order of 1-4-3-2. By shutting off cylinders 1 and 3 simultaneously, the 4 and 2 cylinders could conceivably continue operating the engine for low to medium loads. After N engine cycles, cylinders 1 and 3 could be enabled and cylinders 4 and 2 cut-out so that cylinder wear is kept more even, and more importantly, so that cylinder temperatures are kept high enough in all cylinders to sustain firing in all cylinders when required. The number of engine cycles (N) could be dynamically determined based on several environmental conditions including ambient temperature, intake air temperature, etc. to make sure that the temperature of the cut-out cylinders does not decrease below that required for proper combustion. This would minimize delay in re-starting cylinders as required.

It is appreciated that in an alternative embodiment, the algorithm shown in FIG. 63 may be modified so as to effect cut-out of some other multiple of cylinders simultaneously in a pattern to keep the engine balanced.

It is also appreciated that there may be some delay in the re-start (i.e. enable) and cut-out (i.e. disable) of cylinders when two controllers (the EECM 520 and the EEVC 530) with a standard communications link 540 are used to carry out the algorithm. To minimize or eliminate such delay, dedicated "enable/disable" lines may be provided between the EECM 520 and the EEVC 530. This may allow the EECM to immediately disable/enable both the fuel and valves for a particular cylinder. Alternatively, both of these control functions could be put into one controller to minimize the communication delay.

Figure 64:
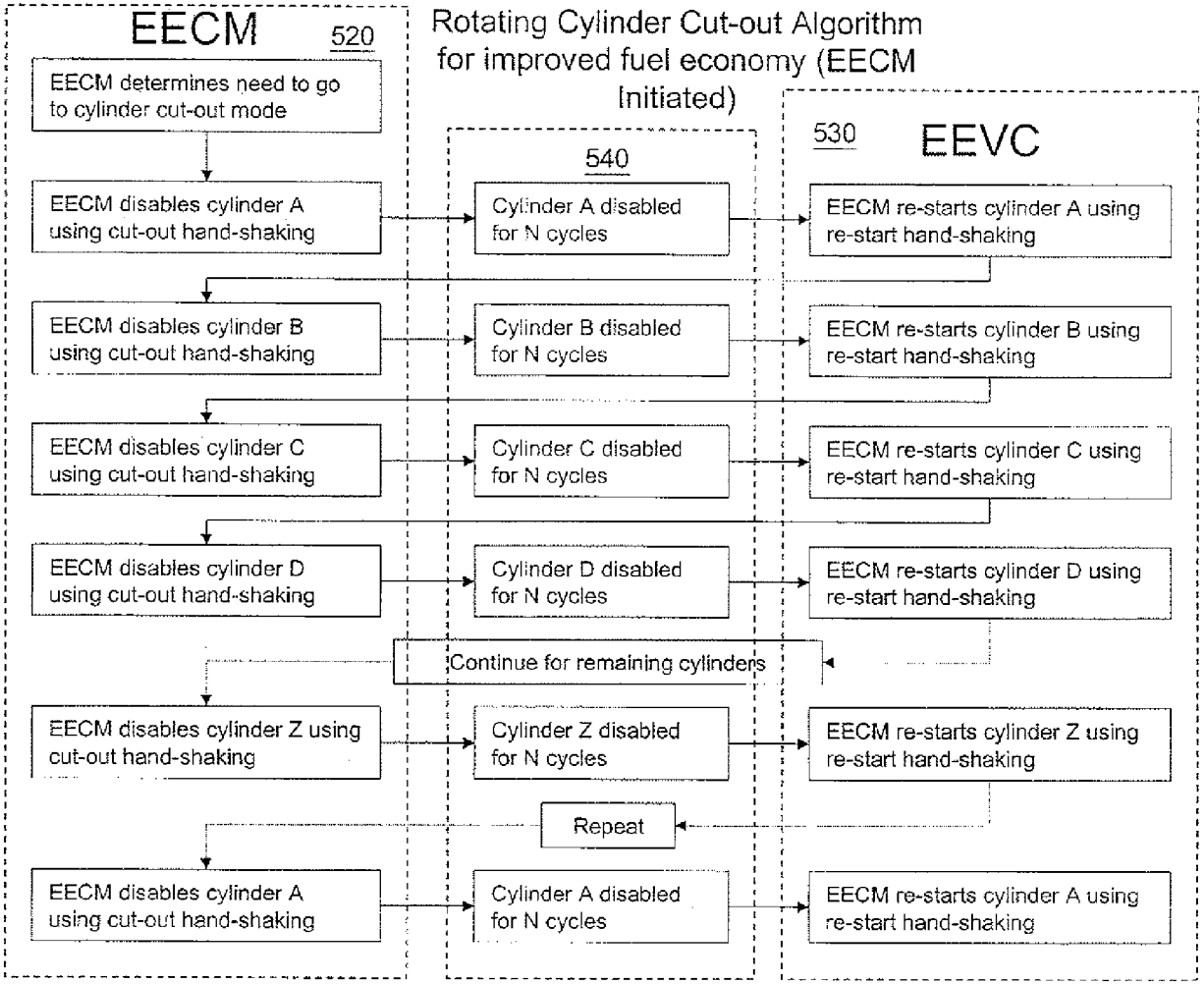
Figure 65:
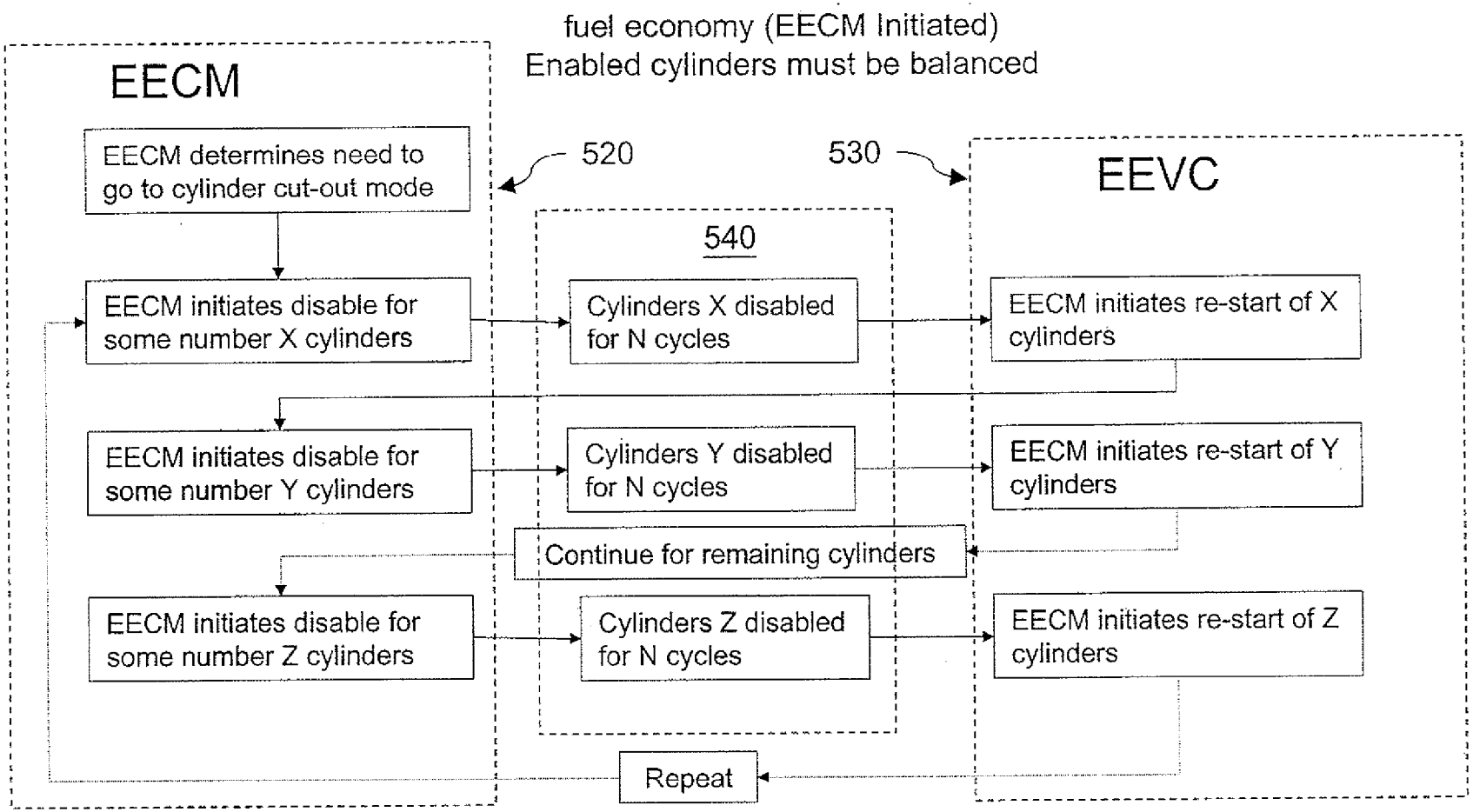
Figure 66:
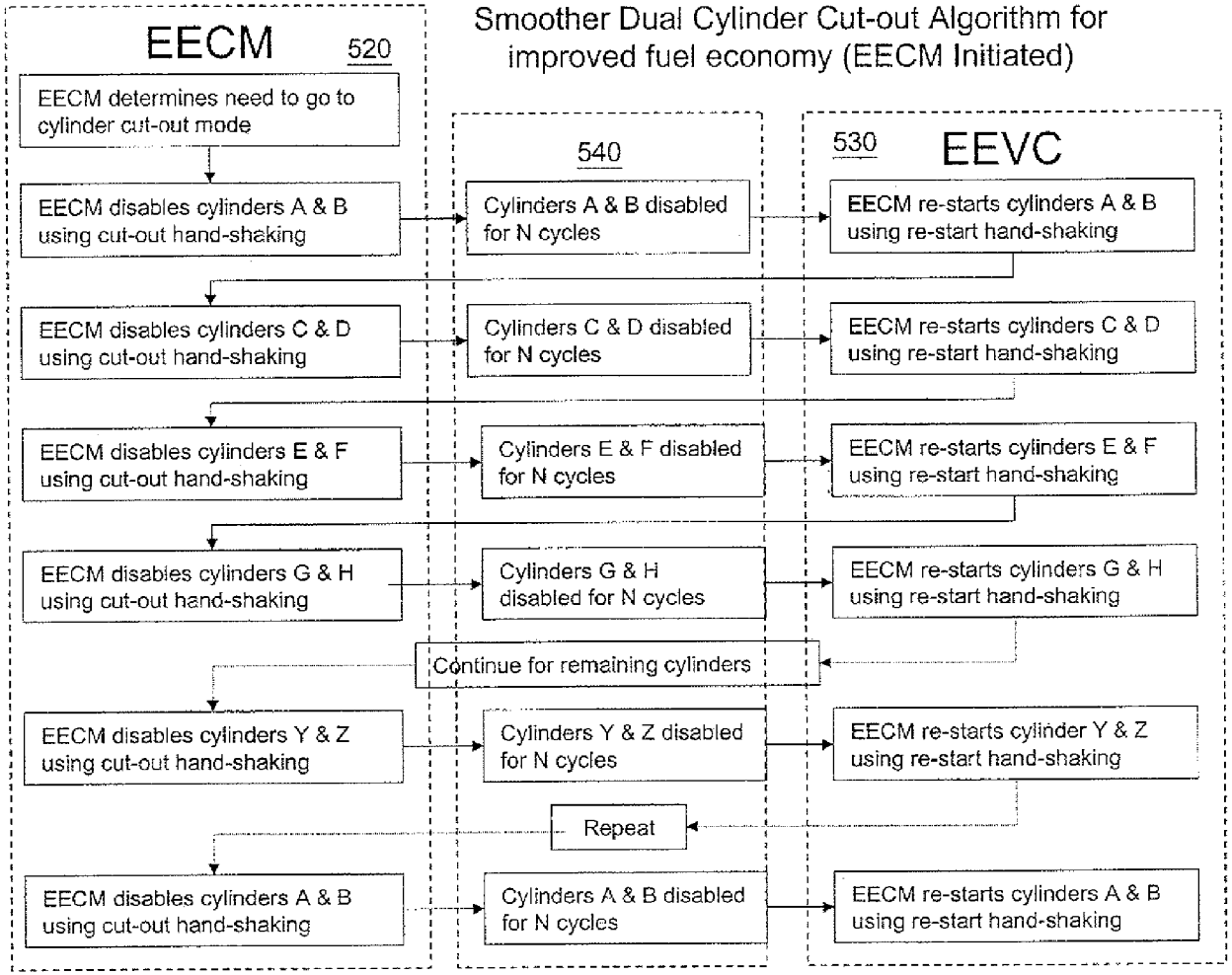

The rotation of cut-out cylinders to keep cylinder wear even may be carried out in accordance with a fourth algorithm shown in FIG. 64. Fifth and sixth algorithms for balanced and rotated cut-out of cylinders are shown in FIGS. 65 and 66. The execution of the algorithms shown in FIGS. 64-66 is evident from the forgoing discussion of the algorithms shown in FIGS. 61-63. Each of these algorithms may take into account variables for number of cylinders to fire, cylinder rotation rate (in engine cycles) for firing and cut-out cylinders, and rotation direction (clockwise or counter-clockwise). For example, based on engine speed and load, the algorithms may select to:

- fire 4 out of 4 cylinders; or
- fire 2 out of 4 cylinders and rotate cut-out cylinders clockwise every 7 engine cycles; or
- fire 6 out of 8 cylinders and rotate cut-out cylinders clockwise every 2 engine cycles; or
- fire 10 out of 12 cylinders and rotate cut-out cylinders counter-clockwise every 33 engine cycles.

Figure 67:
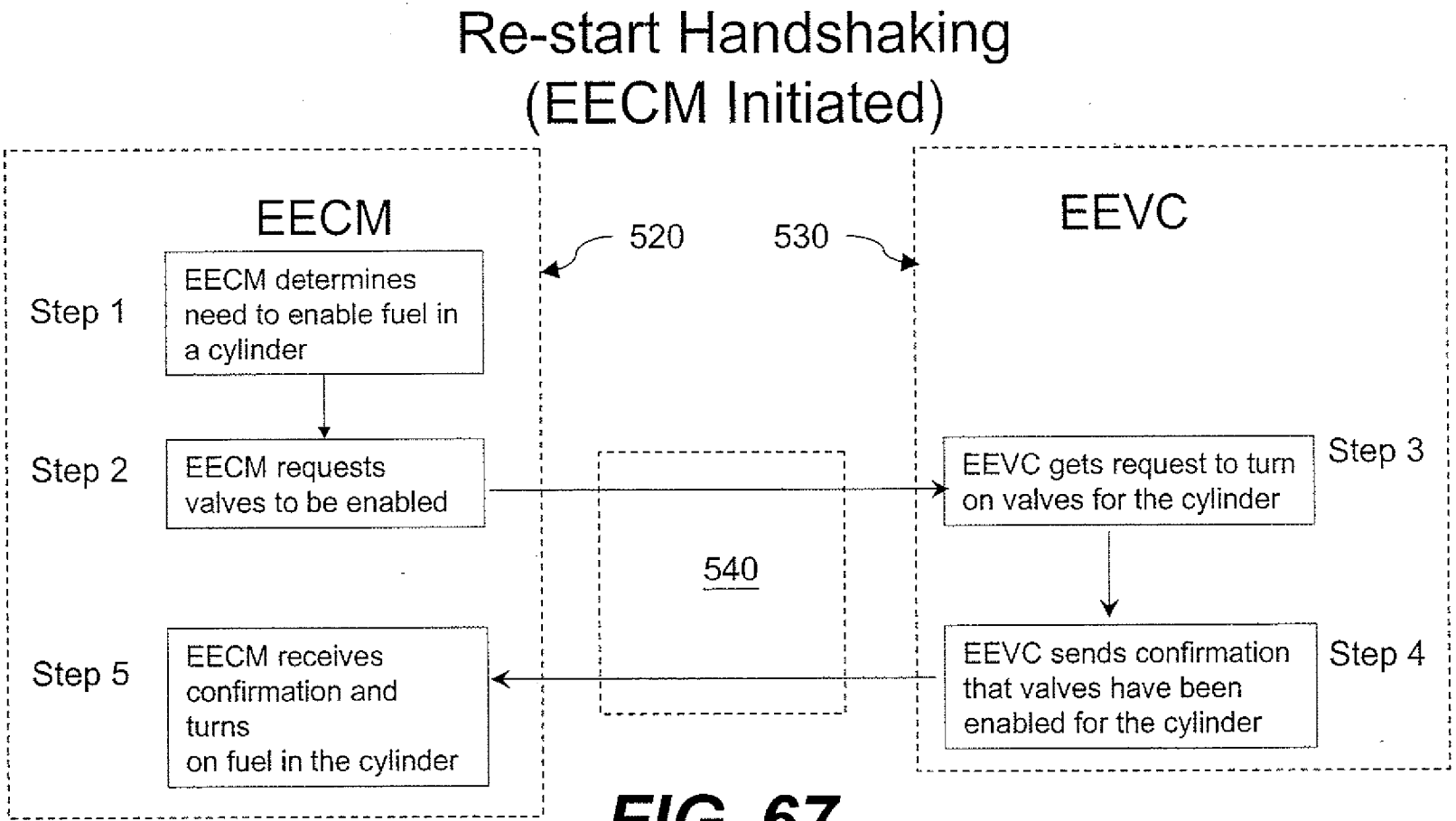

An engine provided with cylinder cut-out capability must also necessarily be provided with cylinder re-start capability. An algorithm for cylinder re-start is shown in FIG. 67. In step 1 of the re-start handshaking algorithm, the EECM determines the need to enable the supply of fuel to a cylinder(s). This determination may be made on the basis of an increase in engine load requested over the available load capacity of the currently firing cylinders. In step 2, the EECM requests that the valves in the selected cylinder(s) be enabled. In step 3, the EEVC receives the request to turn the valves on in the selected cylinder(s). In step 4, the EEVC sends confirmation to the EECM that the valves in the selected cylinder(s) have been enabled. In step 5, the EECM receives the confirmation and reinitiates fuel supply to the selected cylinder(s).

With respect to the algorithm shown in FIG. 67, it should be taken into consideration that a four-cycle engine requires air in the cylinder prior to fueling for proper combustion to occur. This means that cylinder re-start should include the step of actuating the intake valve in the selected cylinder prior to the fueling step. Thus, the EEVC must be able to determine valve timing and actuate the associated hydraulics used to actuate the intake valve prior to the time fuel is injected into the cylinder. Typically, this may require actuation of the associated hydraulic circuit at least a few tens of crank degrees prior to the fuel injection event.

Figure 69:
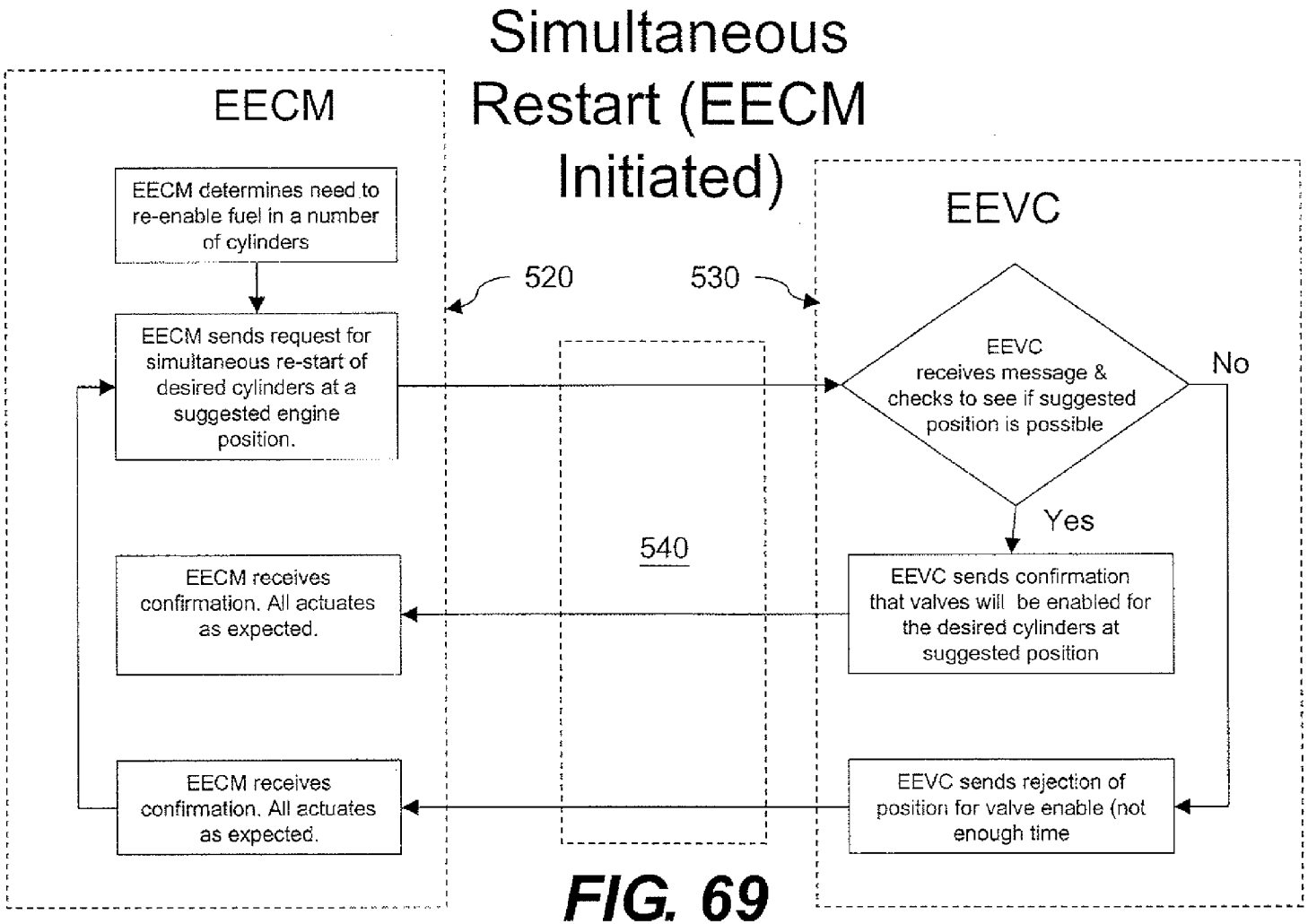

Another re-start algorithm designed to enable simultaneous re-start is shown in FIG. 69. Using the algorithm shown in FIG. 69, upon the request for the simultaneous re-start of any number of cylinders at a specified engine position, the EEVC determines whether or not re-start of the selected cylinders can occur at that engine position. Based on the EEVC's determination, the valves in the selected cylinders and fuel supply thereto is either enabled, or not enabled.

Figure 68:
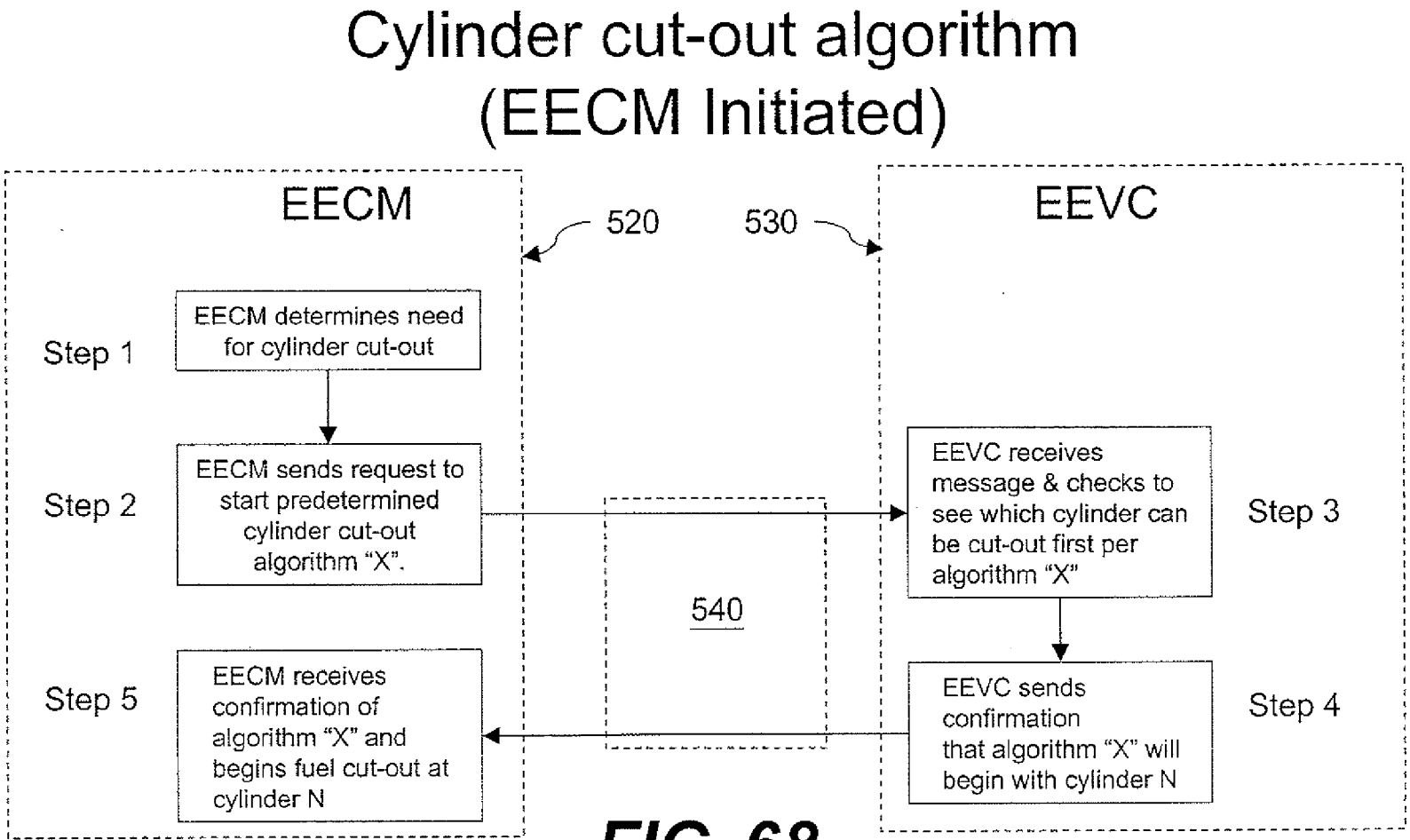

The algorithm shown in FIG. 68 adds the capability of determining which cylinder(s) operation should be enabled or disabled when the EECM requests a new level of cylinder operation. With reference to FIG. 68, the change in the cylinder actuation algorithm "X," may mean that, responsive to an increase in engine load, the EECM determines the need for and requests a change from 4 out of 8 cylinders firing to 6 out of 8 cylinders firing. Upon receipt of the request from the EECM, the EEVC can determine, based on current engine position and speed, which of the four presently cut-out cylinders' intake valves can be opened in time for proper combustion to occur. After this determination, the EEVC may actuate the valve hydraulics to open the intake valves in the selected cylinder N and may send a message to the EECM indicating which cylinder is now ready to receive fuel. Because the valve actuation events must occur far in advance of the fuel injection event (in terms of microprocessor time), the fuel injector controller should have more than sufficient time to inject fuel into the indicated cylinder.

Alternatively, if the EECM requests an algorithm with fewer cylinders firing, the EEVC can determine which exhaust valve will be shut next. Any required timing modification to this valve motion can be added and then the intake valve disabled on cylinder N and the EEVC can send a message to the EECM indicating which cylinder can now be deactivated. This should provide sufficient time for the EECM to disable fueling in the indicated cylinder.

The presently described VVA system 10 shown in FIGS. 1 and 6, as well as in other figures, may provide a distinct advantage over non-variable valve actuation systems in terms of engine brake noise control. It has been determined that the variation of the timing of an engine brake event may affect the noise produced by the event. The noise associated with engine braking is largely a product of the initial "pop" resulting from the initial opening of the exhaust valve at a time when the cylinder pressure is very high (i.e. near or at piston top dead center—the maximum pressure point). By advancing the occurrence of the compression-release "pop" the noise emitted from the engine during braking mode operation may be markedly decreased.

A VVA system provided with proper software will permit selective advancement of the compression-release event by modifying the timing of the opening of the engine exhaust valve. Thus, a VVA system may allow an engine operator to selectively transition an engine into a reduced sound pressure level or "quiet" mode of operation. Even without the variability of a VVA system, a fixed timed engine brake could be designed to carry out the compression-release event at an advanced time in order to permanently limit the noise emitted from the engine during braking.

Advancement of the engine crank angle at which compression-release events are carried out does more than decrease noise emissions, however; it also decreases braking power. Although this side effect is not typically desirable, it may be an acceptable trade off for quiet mode braking carried out selectively with a VVA system, or permanently with a fixed timing brake. In fact, Applicants have determined in the examples provided below that the reduction in noise in terms of percentage far out weighs the reduction in braking power for modest levels of compression-release advancement.

Figure 70:
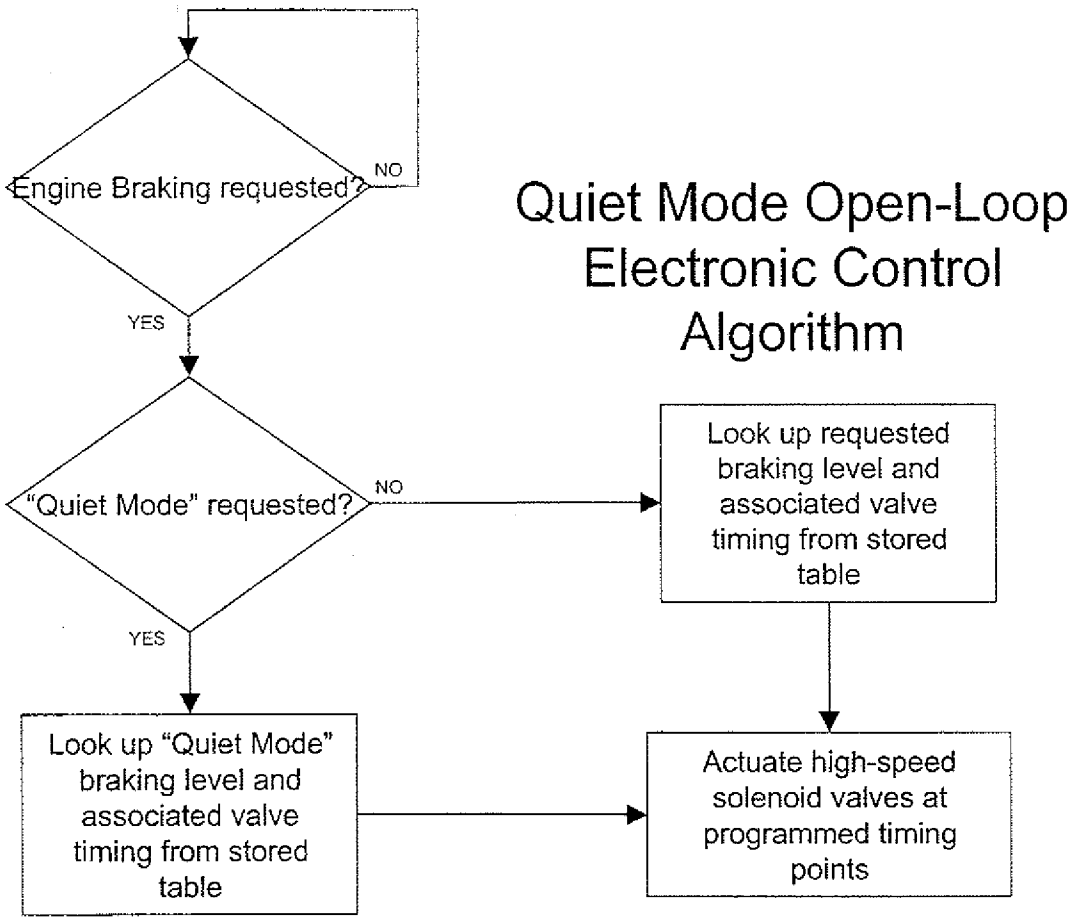
FIGS. 70-72 are flow charts illustrating various engine control algorithms used to effect quiet mode engine braking operation.
Figure 71:
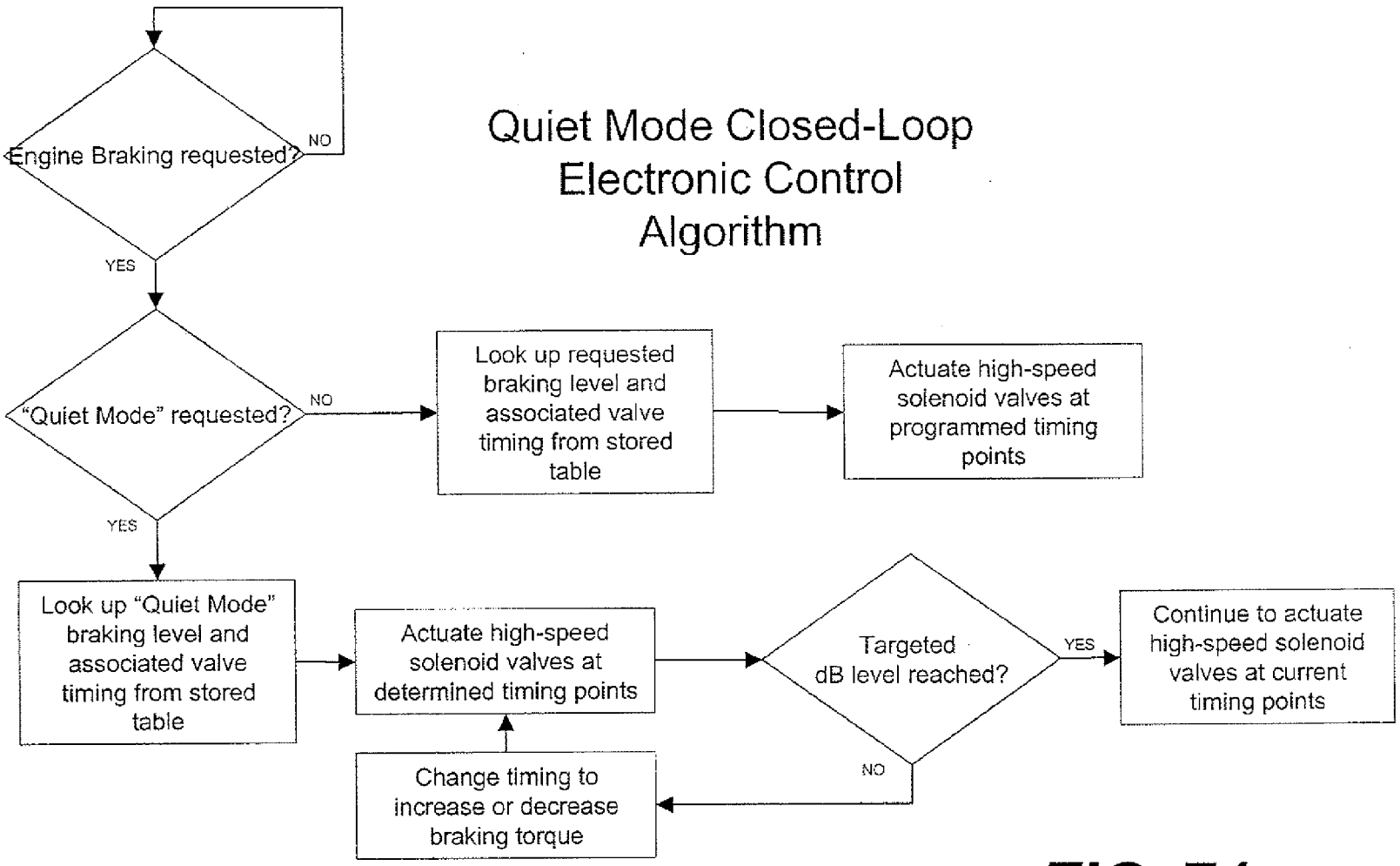
Figure 72:
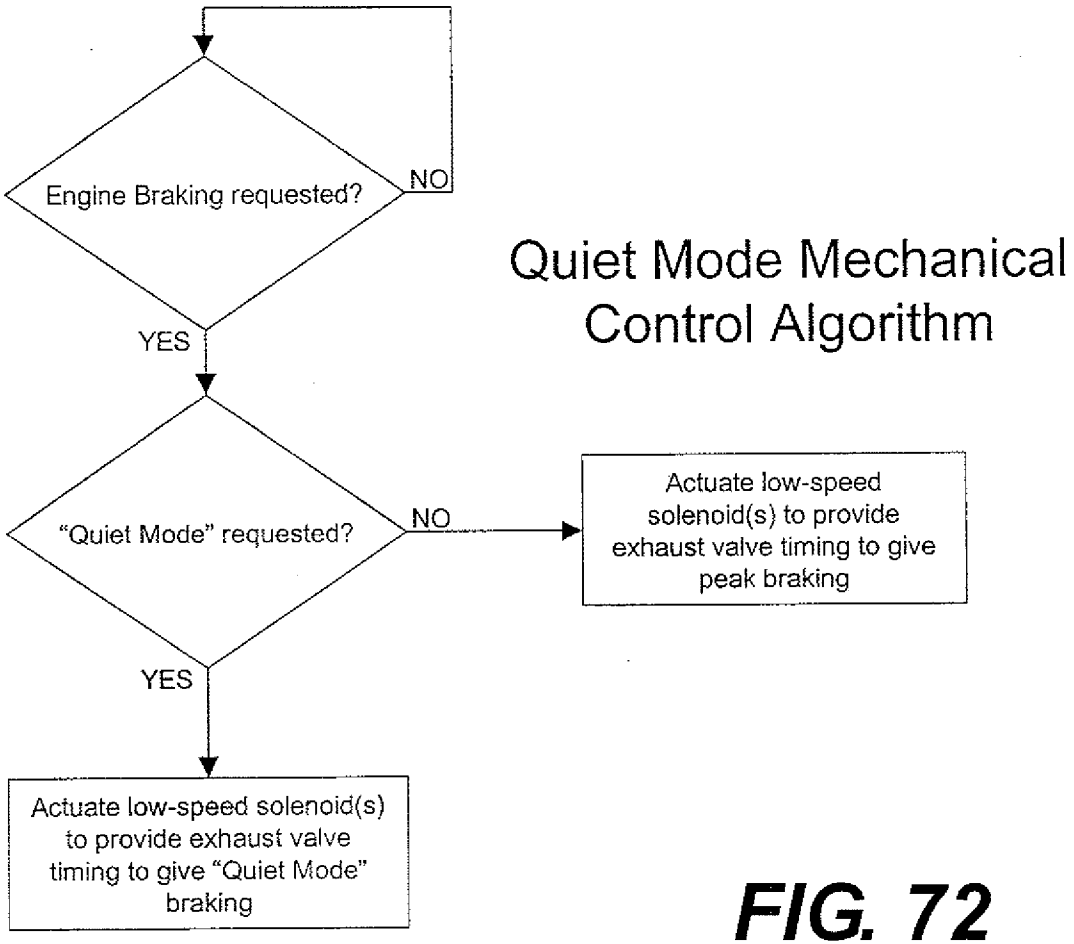

With reference to FIGS. 70-72, control algorithms for carrying out reduced noise (i.e. quiet mode) engine braking are disclosed. The high-speed solenoid valves referenced in these control algorithms may be similar to the trigger valves 330 in the VVA systems 10 of the present invention. The stored tables referenced may be stored in the EECM 500 of the VVA systems 10. The control algorithms also anticipate the incorporation of a noise level (decibel) sensor that could be used to provide sensed noise level feedback to the control system.

In order to determine a basic correlation between compression-release event advancement, noise emission, and engine braking power, two batteries of tests were conducted using the aforedescribed algorithms and a publicly available diesel engine made by Navistar which was equipped with an engine brake manufactured by the assignee of the present application. Using customized software, the timing of the compression-release event was modified to be advanced in steps of five (5) crank angle degrees between the positions 75 degrees before top dead center (TDC) and 10 degrees before TDC. Using this software and an automated program on an engine dynamometer ACAP system, noise and horsepower data was collected in steps of 100 RPM increases between 1000 and 2100 RPMs. Exhaust noise was collected at a range of approximately 50 feet from the engine muffler. Data were collected on two different days during two different test runs. The data are reported in Tables 1, 2 and 3, below.

TABLE 1

NAVISTAR 530E BRAKING HORSEPOWER (HPC) AS A FUNCTION OF VALVE OPENING ANGLE

| RPM | −75 | −70 | −65 | −60 | −55 | −50 | −45 | −40 | −35 | −30 | −25 | −20 | −15 | −10 | OPEN AGL. |
|---|---|---|---|---|---|---|---|---|---|---|---|---|---|---|---|
| 2100 | −189 | −192 | −201 | −208 | −216 | −224 | −235 | −245 | −256 | −260 | −208 | −150 | −130 | −124 | |
| 2000 | −163 | −170 | −177 | −188 | −196 | −205 | −217 | −225 | −239 | −245 | −204 | −156 | −130 | −121 | |
| 1900 | −145 | −150 | −158 | −169 | −178 | −187 | −200 | −210 | −221 | −225 | −193 | −152 | −126 | −117 | |
| 1800 | −124 | −129 | −138 | −146 | −156 | −166 | −178 | −189 | −200 | −212 | −189 | −156 | −127 | −113 | |

TABLE 1-continued

NAVISTAR 530E BRAKING HORSEPOWER (HPC) AS A FUNCTION OF VALVE OPENING ANGLE

| RPM | −75 | −70 | −65 | −60 | −55 | −50 | −45 | −40 | −35 | −30 | −25 | −20 | −15 | −10 | OPEN AGL. |
|---|---|---|---|---|---|---|---|---|---|---|---|---|---|---|---|
| 1700 | −111 | −115 | −123 | −129 | −138 | −149 | −160 | −169 | −183 | −192 | −170 | −142 | −123 | −109 | |
| 1600 | −97 | −102 | −107 | −113 | −121 | −130 | −140 | −151 | −162 | −169 | −156 | −137 | −122 | −104 | |
| 1500 | −83 | −88 | −92 | −98 | −104 | −111 | −120 | −130 | −141 | −154 | −145 | −125 | −111 | −94 | |
| 1400 | −72 | −76 | −80 | −85 | −91 | −97 | −105 | −113 | −122 | −133 | −136 | −119 | −105 | −85 | |
| 1300 | −61 | −64 | −68 | −71 | −76 | −82 | −88 | −96 | −103 | −113 | −120 | −119 | −102 | −85 | |
| 1200 | −51 | −54 | −57 | −60 | −64 | −69 | −75 | −80 | −87 | −95 | −101 | −106 | −102 | −89 | |
| 1100 | −43 | −45 | −48 | −51 | −54 | −58 | −63 | −67 | −73 | −79 | −84 | −89 | −90 | −84 | |
| 1000 | −36 | −38 | −40 | −42 | −45 | −49 | −52 | −56 | −61 | −66 | −70 | −74 | −76 | −74 | |

TABLE 2

NAVISTAR 530E BRAKING NOISE (dBA) AS A FUNCTION OF VALVE OPENING ANGLE

| RPM | −75 | −70 | −65 | −60 | −55 | −50 | −45 | −40 | −35 | −30 | −25 | −20 | −15 | −10 | OPEN AGL. |
|---|---|---|---|---|---|---|---|---|---|---|---|---|---|---|---|
| 2100 | 71.1 | 72.2 | 71.8 | 73.5 | 73.6 | 76.4 | 78.2 | 79.8 | 80.7 | 80.8 | 79.0 | 78.1 | 75.1 | 72.0 | |
| 2000 | 70.4 | 71.3 | 72.0 | 72.5 | 73.3 | 75.3 | 77.7 | 79.3 | 80.9 | 81.5 | 79.7 | 76.8 | 74.5 | 71.8 | |
| 1900 | 69.9 | 71.0 | 71.9 | 72.8 | 73.5 | 75.0 | 78.4 | 81.6 | 81.6 | 80.8 | 79.9 | 77.9 | 77.7 | 74.0 | |
| 1800 | 69.3 | 70.1 | 70.7 | 70.8 | 73.0 | 75.2 | 77.9 | 78.8 | 79.4 | 79.3 | 79.4 | 78.0 | 76.4 | 75.1 | |
| 1700 | 68.0 | 68.3 | 69.1 | 69.9 | 71.5 | 74.2 | 76.8 | 76.4 | 79.3 | 79.4 | 79.5 | 77.4 | 78.1 | 77.3 | |
| 1600 | 68.9 | 68.8 | 69.3 | 68.8 | 70.5 | 72.9 | 74.3 | 76.3 | 77.7 | 77.6 | 80.2 | 79.3 | 79.4 | 77.4 | |
| 1500 | 67.3 | 67.0 | 68.3 | 69.1 | 70.6 | 71.1 | 72.5 | 74.4 | 76.1 | 77.0 | 77.3 | 79.4 | 77.6 | 76.3 | |
| 1400 | 66.9 | 68.3 | 70.1 | 69.9 | 70.6 | 70.6 | 71.1 | 73.4 | 75.2 | 76.0 | 75.0 | 78.1 | 78.9 | 75.3 | |
| 1300 | 74.1 | 65.6 | 67.8 | 66.6 | 68.7 | 70.1 | 71.3 | 74.4 | 75.3 | 77.6 | 76.2 | 75.0 | 74.3 | 74.3 | |
| 1200 | 68.4 | 67.5 | 68.8 | 69.3 | 70.5 | 71.1 | 73.0 | 73.3 | 76.0 | 77.7 | 79.2 | 79.1 | 77.2 | 74.5 | |
| 1100 | 66.2 | 66.3 | 67.5 | 67.7 | 70.2 | 70.7 | 70.8 | 72.8 | 74.9 | 77.5 | 77.7 | 78.4 | 78.0 | 77.1 | |
| 1000 | 65.6 | 65.8 | 67.1 | 67.2 | 69.0 | 71.0 | 70.0 | 71.3 | 73.2 | 74.4 | 78.5 | 78.5 | 77.9 | 78.6 | |

TABLE 3

NOISE COMPARISON AT DIFFERENT HORSE POWER LEVELS

| RPM | ACCEL | 69% | 80% | 88% | 100% |
|---|---|---|---|---|---|
| 2100 | 73.1 | 72.2 | 73.6 | 78.2 | 80.8 |
| 2000 | 71.4 | 71.3 | 73.3 | 77.7 | 81.5 |
| 1900 | 70.6 | 71.0 | 73.5 | 78.4 | 80.8 |
| 1800 | 69.8 | 70.1 | 73.0 | 77.9 | 79.3 |
| 1700 | 69.4 | 68.3 | 71.5 | 76.8 | 79.4 |
| 1600 | 68.5 | 68.8 | 70.5 | 74.3 | 77.6 |
| 1500 | 67.0 | 67.0 | 70.6 | 72.5 | 77.0 |
| 1400 | 67.8 | 68.3 | 70.6 | 71.1 | 76.0 |
| 1300 | 69.8 | 65.6 | 68.7 | 71.3 | 77.6 |
| 1200 | 69.7 | 67.5 | 70.5 | 73.0 | 77.7 |
| 1100 | 67.1 | 66.3 | 70.2 | 70.8 | 77.5 |
| 1000 | 69.3 | 65.8 | 69.0 | 70.0 | 74.4 |

Table 1 reports engine braking power as a function of the crank angle position at which the exhaust valve is opened. Table 2 reports engine braking noise level as a function of the crank angle position at which the exhaust valve is opened. Table 3 shows engine braking noise level as a function of engine braking power over a range of engine RPMs. The data reported in Table 3 is plotted in the graph provided in FIG. 73.

Figure 73:
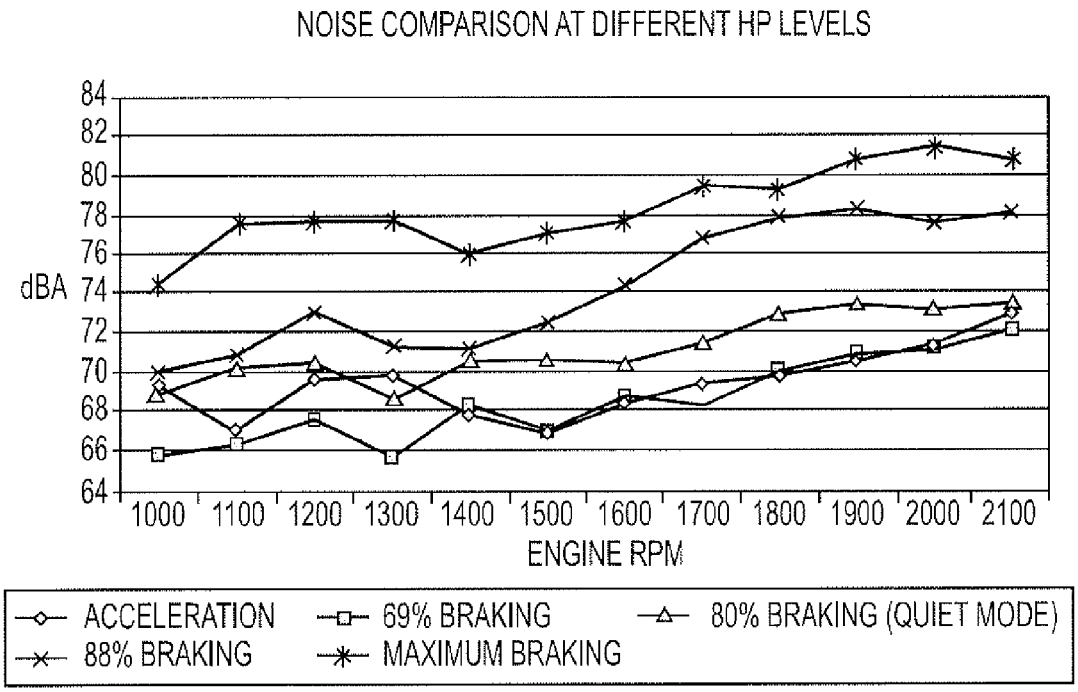
FIGS. 73-75 are graphs used to illustrate the effect of exhaust valve braking event timing on engine braking noise level.

A decibel level of 73 dB was assumed to define the line between quiet mode braking and normal mode braking for these test runs. This noise limit is based on the maximum exhaust noise levels measured during acceleration, which are assumed to be acceptable since there are no acceleration noise restrictions that the assignee is aware of FIG. 73 shows that 69% engine braking power was delivered below the 73 dB threshold for the full range of engine speeds tested, and that 80% engine braking power was delivered below the 73 dB threshold for almost all of the engine speeds tested. Furthermore, the level of noise produced in connection with the 69% and 80% power levels of engine braking were considerably less than those produced with maximum braking power.

Figure 74:
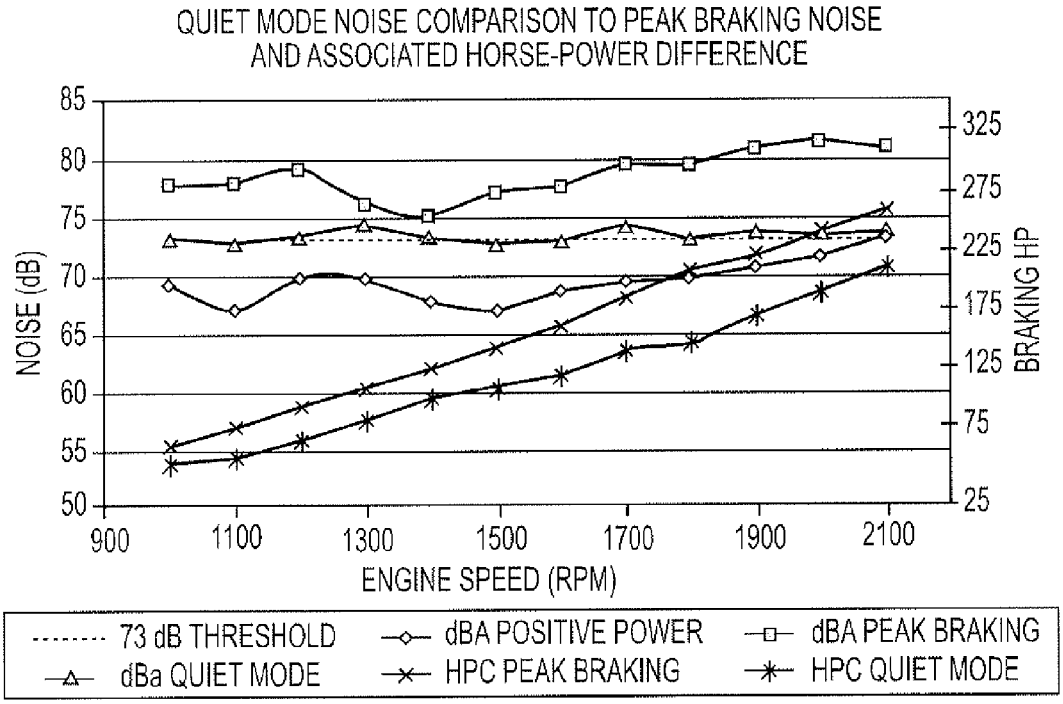

With reference to Tables 4 and 5 below, and FIG. 74, which is based on this data, a determination was made of the crank angle position that would keep the braking noise level at approximately 73 dBs for the range of 1000 to 2100 RPMs. Table 4 is a comparison of braking horse power for a VVA system operated in quiet mode and a VVA system operated to deliver peak braking power. Table 5 is a comparison of the noise level of a two-position fixed time system operated to carry out compression-release at 55 and 30 degrees before TDC.

TABLE 4

| | PEAK BRAKING POWER | | | 73 dBA QUIET MODE | | | |
|---|---|---|---|---|---|---|---|
| RPM | Angle | HPC Peak Braking | dBA Peak Braking | Angle | HPC Quiet Mode | dBA Quiet Mode | HP % Difference |
| 2100 | −30 | 260 | 80.8 | −55 | 216 | 73.6 | 83.07692308 |
| 2000 | −30 | 245 | 81.5 | −55 | 196 | 73.3 | 80 |
| 1900 | −30 | 225 | 80.8 | −55 | 178 | 73.5 | 79.11111111 |
| 1800 | −30 | 212 | 79.3 | −55 | 156 | 73.0 | 73.58490566 |

TABLE 4-continued

| | PEAK BRAKING POWER | | | 73 dBA QUIET MODE | | | |
|---|---|---|---|---|---|---|---|
| RPM | Angle | HPC Peak Braking | dBA Peak Braking | Angle | HPC Quiet Mode | dBA Quiet Mode | HP % Difference |
| 1700 | −30 | 192 | 79.4 | −50 | 149 | 74.2 | 77.60416667 |
| 1600 | −30 | 169 | 77.6 | −50 | 130 | 72.9 | 76.92307692 |
| 1500 | −30 | 154 | 77.0 | −45 | 120 | 72.5 | 77.92207792 |
| 1400 | −25 | 136 | 75.0 | −40 | 113 | 73.4 | 83.08823529 |
| 1300 | −25 | 120 | 76.2 | −40 | 96 | 74.4 | 80 |
| 1200 | −20 | 106 | 79.1 | −40 | 80 | 73.3 | 75.47169811 |
| 1100 | −15 | 90 | 78.0 | −40 | 67 | 72.8 | 74.44444444 |
| 1000 | −15 | 76 | 77.9 | −35 | 61 | 73.2 | 80.26315789 |

TABLE 5

| RPM | HPC Mech. Timing (−30) | dBA Mech. Braking | HPC Mech. Timing (−55) | dBA Quiet Mech. Braking | HP % Difference | dBA Difference |
|---|---|---|---|---|---|---|
| 2100 | 206 | 80.8 | 216 | 73.6 | 83.07692308 | 7.2 |
| 2000 | 245 | 81.5 | 196 | 73.3 | 80 | 8.2 |
| 1900 | 225 | 80.8 | 178 | 73.5 | 79.11111111 | 7.3 |
| 1800 | 212 | 79.3 | 156 | 73.0 | 73.58490566 | 6.3 |
| 1700 | 192 | 79.4 | 138 | 71.5 | 71.875 | 7.9 |
| 1600 | 169 | 77.6 | 121 | 70.5 | 71.59763314 | 7.1 |
| 1500 | 154 | 77.0 | 104 | 70.6 | 67.53246753 | 6.4 |
| 1400 | 133 | 76.0 | 91 | 70.6 | 68.42105263 | 5.4 |
| 1300 | 113 | 77.6 | 76 | 68.7 | 67.25663717 | 8.9 |
| 1200 | 95 | 77.7 | 64 | 70.5 | 67.36842105 | 7.2 |
| 1100 | 79 | 77.5 | 54 | 70.2 | 68.35443038 | 7.3 |
| 1000 | 66 | 74.4 | 45 | 69.0 | 68.18181818 | 5.4 |

It is evident from the data shown in Table 4 that a quiet mode of braking can be provided with a VVA system at a range of between approximately 73% to 83% of peak braking power. It is evident from the data in Table 5 that a fixed time engine brake with just two compression-release event timing positions could provide an engine with peak braking and quiet mode braking at a power level of between approximately 67% to 83% of peak braking horsepower.

Figure 75:
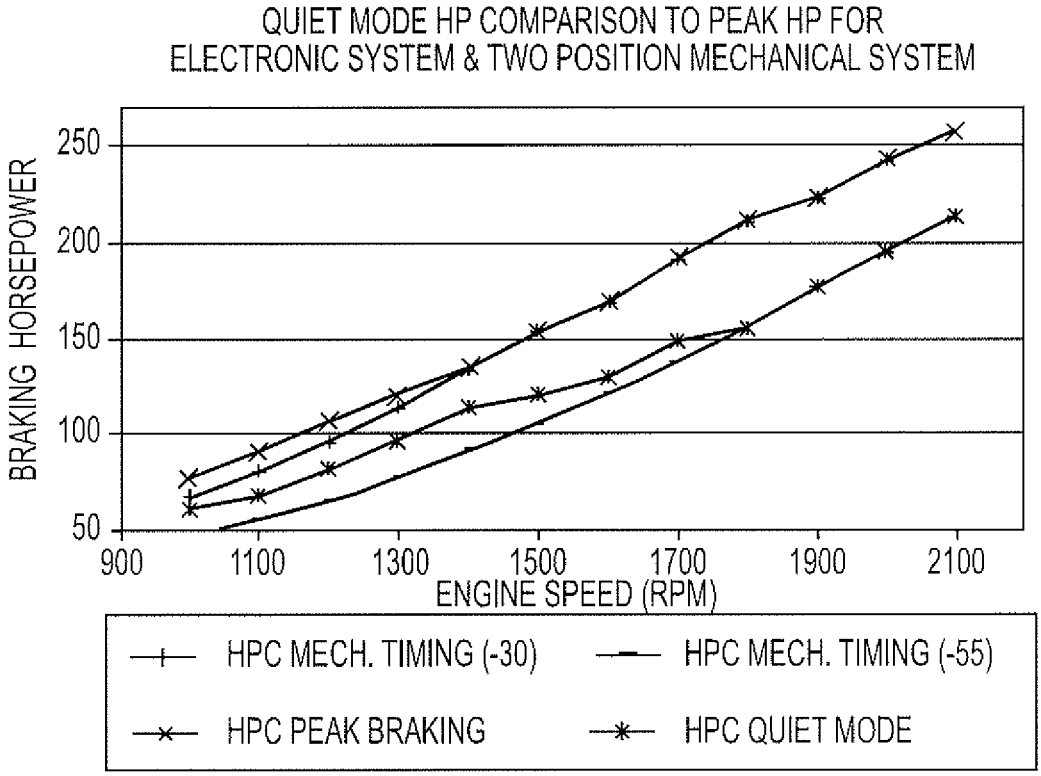

A VVA system could provide pronounced improvement in middle to low RPM peak engine braking power. The increase in braking power that is realized with a VVA system at mid to low levels may be traded back for reduced noise levels so that the VVA system in fact delivers braking power comparable to fixed time braking systems at much reduced noise levels. The data plotted in FIG. 75 is instructive.

Reference will now be made in detail to a control algorithm 910 shown in FIG. 76 used to accomplish engine valve timing control based on engine temperature information. The control algorithm 910 may be used in connection with the operation of at least one engine valve 400. It is contemplated that the valve actuation system may be used to operate at least one intake valve and/or at least one exhaust valve. In the preferred embodiment of the present invention, the control algorithm 910 starts with the step 912 of determining the current temperature of an engine fluid, such as the operating oil supply. This temperature determination may be made using any conventional means for measuring temperature. In a similar and preferred embodiment shown in FIG. 77, the control algorithm 910 starts with the step 913 of determining the current viscosity of the engine fluid using any conventional means of measuring or calculating viscosity. It is also contemplated that both temperature and viscosity may be measured in the first step of yet another alternative embodiment.

Figure 76:
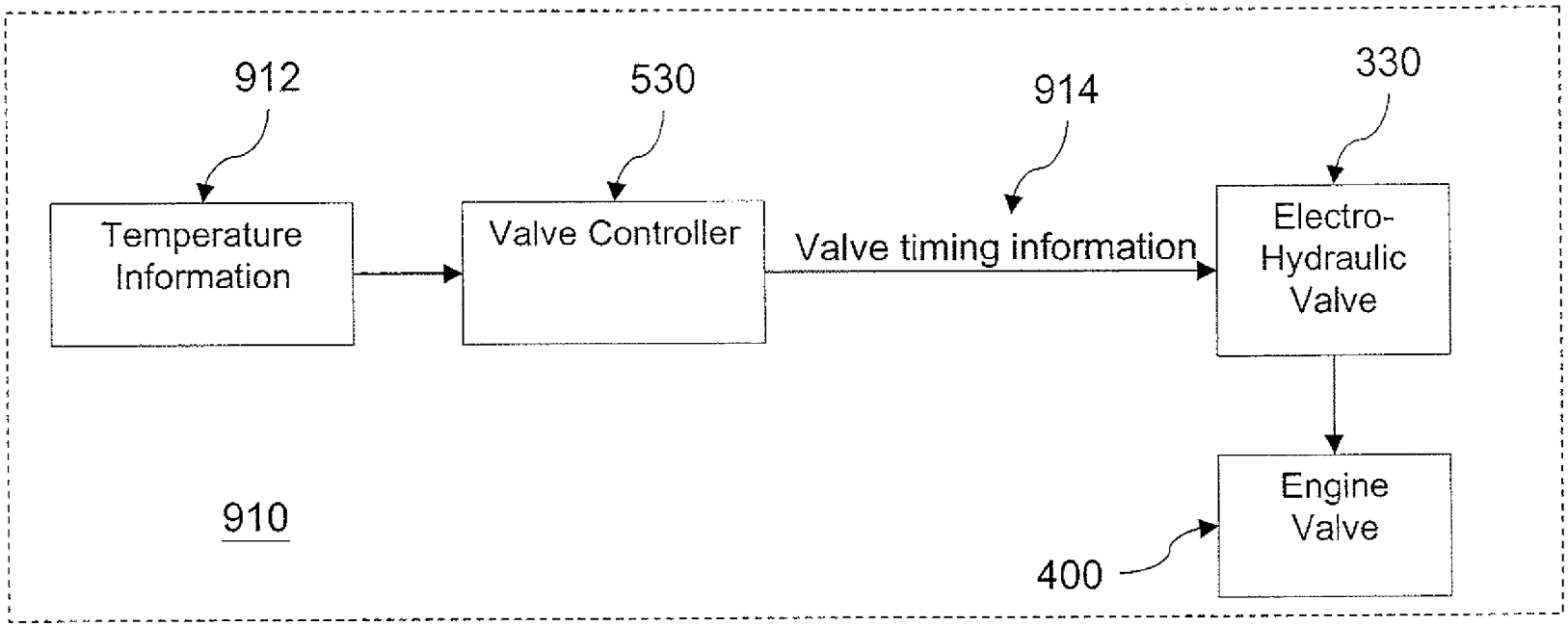
FIG. 76 is a flow chart illustrating an algorithm for controlling the operation of at least one engine valve in response to measured or calculated temperature information.
Figure 77:
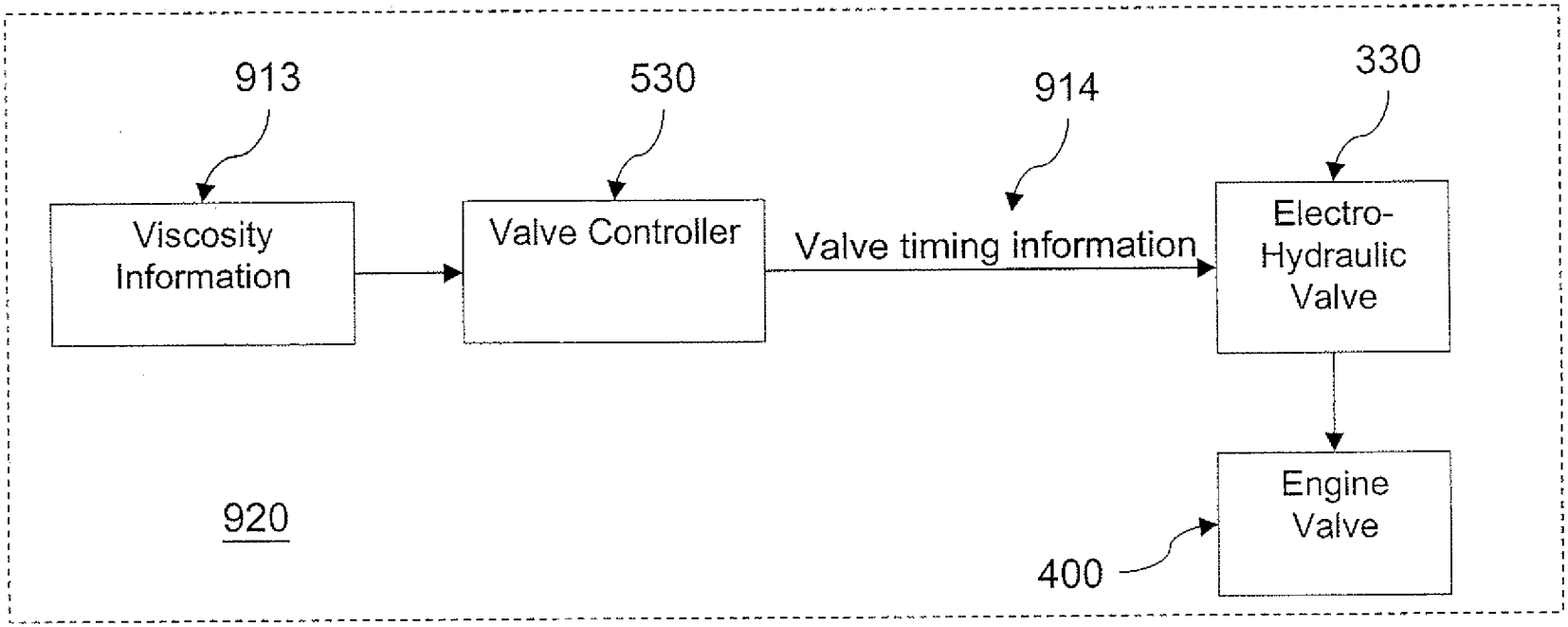
FIG. 77 is a flow chart illustrating an algorithm for controlling the operation of at least one engine valve in response to measured or calculated viscosity information.

With continued reference to FIGS. 76 and 77, the engine fluid for which temperature and/or viscosity is measured is hydraulic fluid. The present control algorithms, however, are not limited to the measurement of hydraulic fluid to control the operation of at least one valve. It is contemplated that other temperatures, such as the temperature of a coolant, the engine itself, and/or some other temperature may be used to calculate a valve actuation timing modification called for due to variation in the viscosity of the hydraulic fluid. Moreover, the measuring of the viscosities of other engine fluids to calculate or estimate the viscosity of the engine oil viscosity is also considered to be well within the scope of this portion of the present invention.

The current temperature or viscosity information determined during the steps 912 and 913 is communicated to a control assembly 530. In response to the received temperature or viscosity information, the control assembly 530 determines and communicates valve timing information 914 to the operating assembly 330, which may be an electro-hydraulic trigger valve. The operating assembly 330, in turn, is used to control operation of the at least one engine valve 400 (i.e. engine valve opening and closing times).

Figure 78:
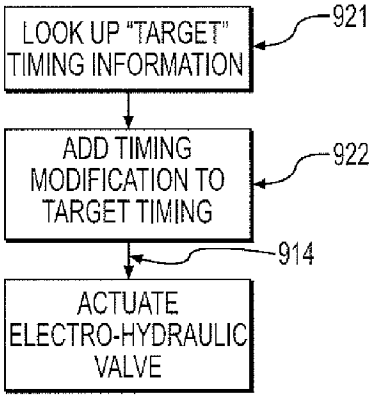
FIG. 78 is a flow chart illustrating an algorithm for controlling the operation of at least one engine valve in response to sensed changes in hydraulic fluid viscosity.

With reference to FIGS. 76, 77, and 78, the functioning of the control assembly 530 will now be described. Predetermined target valve timing information 921 is stored in the control assembly 530. After receiving the current temperature or viscosity information during the steps 912 and 913, the control assembly 530 adds a positive or negative timing modification 922 to the target valve timing information 921 and communicates the modified valve timing information 914 to the operating assembly 330. The modified valve timing information 914 may call for the advance or delay of engine valve opening and/or closing times as compared with the predetermined target valve timing information 921. The operating assembly 330 is actuated accordingly.

It is contemplated that the functioning of control assembly 530 could be altered in an alternative embodiment of the control algorithm. For example, during high temperature operation when engine fluids have relatively low viscosity, control assembly 530 effects a timing modification that results in a delay, rather than an advance or a very small advance, in the actuation of the engine valve 400. Regardless of the current temperature, however, there is always a timing modification effected by control assembly 530. As a result, advantages such as controlling emissions, improving braking, predicting the output of braking output, limiting noise, and improving overall system performance are provided.

Figure 80:
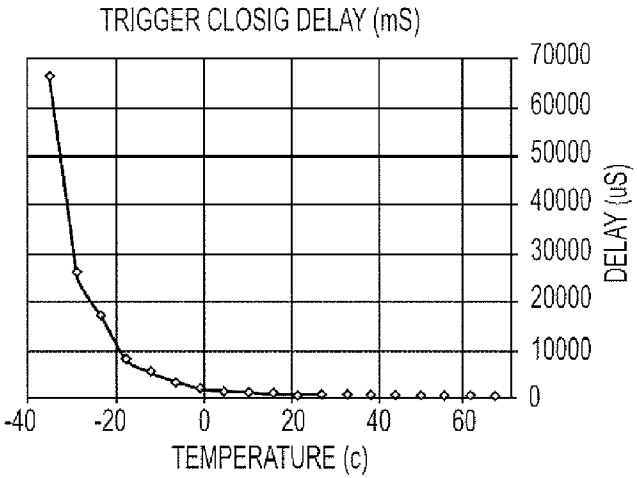
FIGS. 79-80 are graphs illustrating the effect of modifying the opening and closing of an electro-hydraulic valve in response to temperature.
Figure 79:
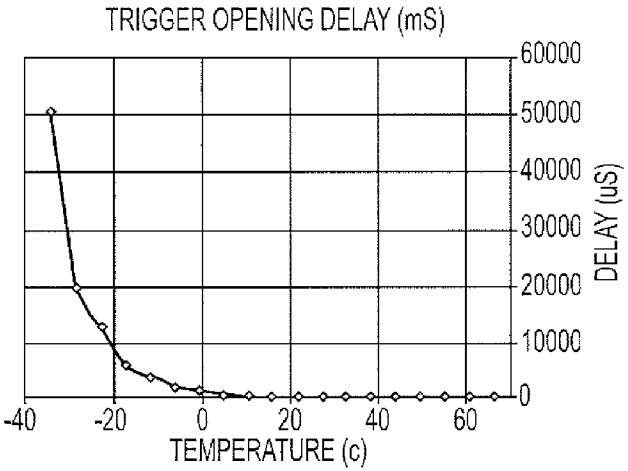

In one embodiment of the invention, the control algorithm 910 (FIGS. 76 and 77) controls the operation of the at least one valve 400 (FIG. 6) based upon information contained in a valve opening modification table, an example of which is shown in FIG. 79, and a valve closing modification table, an example of which is shown in FIG. 80. The opening modification and closing modification tables define the relationship between the current temperature (or viscosity) and the corresponding amount of timing modification. The information represented in the opening modification table and the closing modification table is stored, for example, in electronic memory, which may be part of the control assembly 530. The control assembly 530 determines the required timing modification based on the information stored in opening modification table and closing modification table.

The information represented in the opening modification table may include data similar to the following:

TABLE 6

| Modification of Valve Opening | | | |
|---|---|---|---|
| Oil Temp. (° C.) | Opening Modification (mS) | Oil Temp. (° C.) | Opening Modification (mS) |
| −40 | 84940 | 22 | 3447 |
| −26 | 19542 | 28 | 3340 |
| −13 | 7602 | 35 | 3273 |
| −4 | 5070 | 45 | 3210 |
| 3 | 4249 | 85 | 3128 |
| 10 | 3827 | 120 | 3111 |
| 16 | 3566 | 170 | 3109 |

The information represented in the closing modification table may include data similar to the following:

TABLE 7

| Modification of Valve Closing | | | |
|---|---|---|---|
| Oil Temp. (° C.) | Closing Modification (mS) | Oil Temp. (° C.) | Closing Modification (mS) |
| −40 | 100000 | 22 | 3551 |
| −26 | 24475 | 28 | 3413 |
| −13 | 8953 | 35 | 3326 |
| −4 | 5661 | 45 | 3244 |
| 3 | 4593 | 85 | 3137 |
| 10 | 4045 | 120 | 3116 |
| 16 | 3706 | 170 | 3113 |

An example of the operation of the control algorithm 910 shown in FIG. 76 will now be described with reference to a plot of the data in the opening modification table shown in Table 6 and FIG. 79. During the first step 912, the current temperature of an engine fluid is determined to be −40° C. The current temperature information determined during the first step 912 is communicated to the control assembly 530. Based on the information contained in Table 6 and FIG. 79, the control assembly 530 determines that the required amount of advance in the opening time of the valve is 84940 microseconds (μS). Once this value is determined, it is added to the target timing information to calculate when power needs to be applied to the operating assembly 330 such that the actual opening of the operating assembly 330 provides for the correct time of opening of the engine valve 400.

Similarly, an example of the operation of the present invention will now be described with reference to the data in the closing modification Table 7, which is plotted in FIG. 80. During the first step 912, the current temperature of the engine fluid is determined to be −40° C. The current temperature information is communicated to the control assembly 530, which determines that the required amount of delay in the closing of the valve is 100000 μS. Once this value is determined, it is added to the target timing information to calculate when power needs to be removed from the operating assembly 330 such that the actual closing of the operating assembly 330 provides for the correct time of closing of the engine valve 400.

The preferred embodiment, as shown in Tables 6 and 7, uses two, much smaller, two-dimensional tables of modifications to the valve timing at normal operating temperatures, rather than the traditional use of multiple, large two dimensional tables mapping the timing of valve events at each of several lower temperatures. This decreases the memory size utilized by several orders of magnitude. Furthermore, this method is easier to implement, is much more cost effective, and is easier to calibrate by the user. Other versions of modification tables, such as tables with differently defined temperature to timing relationships, are considered to be well within the scope of the present invention.

It will be apparent to those skilled in the art that variations and modifications of the present invention can be made without departing from the scope or spirit of the invention. For example, the shape and size of the pivoting bridge may be varied, as well as the relative locations of the surface for contacting the piston, the surface for contacting the valve stem, and the pivot point. Furthermore, it is contemplated that the scope of the invention may extend to variations in the design and speed of the trigger valve used, and in the engine conditions that may bear on control determinations made by the controller. The invention also is not limited to use with a particular type of valve train (cams, rocker arms, push tubes, etc.). It is further contemplated that any hydraulic fluid may be used in the invention. Thus, it is intended that the present invention cover all modifications and variations of the invention, provided they come within the scope of the appended claims and their equivalents.

We claim:

1. A valve actuation system for controlling at least one engine valve, comprising:

a) a hydraulic lost motion system having:

(i) a first piston disposed in a first piston chamber, being moveable by an engine cam shaft, (ii) a second piston disposed in a second piston chamber;

(iii) at least one engine valve being moveable by the second piston; and (iv) a hydraulic circuit configured to permit hydraulic communication between the first piston chamber and the second piston chamber;

b) a solenoid valve in hydraulic communication with the hydraulic circuit; and c) a controller configured to selectively actuate the solenoid valve to permit a flow of fluid within the hydraulic circuit for controlling the operation of the at least one engine valve in response to (i) a temperature proximate a portion of the hydraulic lost motion system, (ii) an engine load value, (iii) at least one engine operating mode and (iv) an engine speed value.

2. The valve actuation system of claim 1, wherein the temperature is of the hydraulic lost motion system.

3. The valve actuation system of claim 2, wherein the temperature is of hydraulic fluid of the hydraulic lost motion system.

4. The valve actuation system of claim 3, wherein the hydraulic fluid is engine oil.

5. The valve actuation system of claim 1, wherein the controller is configured to operate the valve actuation system in response to a plurality of engine operating modes.

6. The valve actuation system of claim 5, wherein the plurality of engine operating modes include at least two of (i) a warm up mode, (ii) a normal mode and (iii) a transient mode.

7. The valve actuation system of claim 5, wherein the controller is configured to access timing information for at least two of the plurality of engine operation modes, the timing information including opening and closing time information for at least one of the solenoid valve and the engine valve.

8. The valve actuation system of claim 7, wherein the opening and closing time information is a function of engine speed.

9. The valve actuation system of claim 7, wherein the opening and closing time information is a function of engine load.

10. The valve actuation system of claim 7, wherein the opening and closing time information is a function of engine crank angle position.

11. The valve actuation system of claim 7, wherein the controller is configured to recalibrate the opening and closing time information based on engine operation data.

12. The valve actuation system of claim 1, wherein the controller is configured to determine timing information for a plurality of intake valve opening events and a plurality of intake valve closing events.

13. The valve actuation system of claim 1, wherein the controller is configured to determine timing information for at least three intake valve opening events and at least three intake valve closing events.

14. The valve actuation system of claim 1, wherein the controller is configured to determine timing information for a plurality of solenoid valve opening events and a plurality of solenoid valve closing events based on engine speed values and engine load values.

15. The valve actuation system of claim 1, wherein the controller is configured to determine timing information for at least three solenoid valve opening events and at least three solenoid valve closing events based on engine speed values and engine load values.

16. The valve actuation system of claim 1, wherein the controller is configured to access timing information for an engine warm up mode based on temperature of the hydraulic lost motion system and engine speed.

17. The valve actuation system of claim 1, wherein the controller is configured to access timing information for a normal mode of engine operation based on at least one of (i) engine speed and (ii) percent change in engine load.

18. The valve actuation system of claim 1, wherein the controller is configured to access timing information for a transient mode of engine operation based on rate of change of engine load.

19. The valve actuation system of claim 1, wherein the controller is configured to delay the opening of the solenoid valve based on at least one of (i) an engine load value, (ii) an engine operating mode and (iii) an engine speed value.

20. The valve actuation system of claim 1, wherein the controller is configured to advance the opening of the solenoid valve based on at least one of (i) an engine load value, (ii) an engine operating mode and (iii) an engine speed value.

21. The valve actuation system of claim 1, wherein the controller is configured to delay the closing of the solenoid valve based on at least one of (i) an engine load value, (ii) an engine operating mode and (iii) an engine speed value.

22. The valve actuation system of claim 1, wherein the controller is configured to advance the closing of the solenoid valve based on at least one of (i) an engine load value, (ii) an engine operating mode and (iii) an engine speed value.

23. The valve actuation system of claim 1, wherein the at least one engine valve includes an intake valve.

24. The valve actuation system of claim 2, wherein the controller is configured to determine timing information for a plurality of solenoid valve opening events and a plurality of solenoid valve closing events based on temperature of the hydraulic lost motion system.

25. The valve actuation system of claim 24, wherein the temperature is of hydraulic fluid.

26. The valve actuation system of claim 1, wherein the first piston is moveable by at least one cam lobe on the engine cam shaft, and wherein the controller is further configured to selectively actuate the solenoid valve when the at least one cam lobe causes movement of the first piston.

27. The valve actuation system of claim 1, wherein the at least one engine valve is movable by the second piston via at least one intermediate valve train component.

28. The valve actuation system of claim 1, wherein the first piston is movable by the engine cam shaft via at least one intermediate valve train component.

* * * * *